US012672752B2

(12) United States Patent
Giammanco et al.

(10) Patent No.: US 12,672,752 B2
(45) Date of Patent: Jul. 7, 2026

(54) MOP

(71) Applicant: 2XL Corporation, Bolingbrook, IL (US)

(72) Inventors: Robert L. Giammanco, Hinsdale, IL (US); Morad Ghassemian, Oak Park, IL (US); Curtis Leroy Cruver, IV, Elmhurst, IL (US)

(73) Assignee: 2XL Corporation, Bolingbrook, IL (US)

( * ) Notice: Subject to any disclaimer, the term of this patent is extended or adjusted under 35 U.S.C. 154(b) by 343 days.

(21) Appl. No.: 18/557,162

(22) PCT Filed: Apr. 18, 2022

(86) PCT No.: PCT/US2022/025205

§ 371 (c)(1),
(2) Date: Oct. 25, 2023

(87) PCT Pub. No.: WO2022/231881

PCT Pub. Date: Nov. 3, 2022

(65) Prior Publication Data

US 2024/0215792 A1 Jul. 4, 2024

Related U.S. Application Data

(60) Provisional application No. 63/179,989, filed on Apr. 26, 2021.

(51) Int. Cl.

| | |
|---|---|
| ***A47L 13/24*** | (2006.01) |
| ***A47L 11/40*** | (2006.01) |
| ***A47L 13/42*** | (2006.01) |

(52) U.S. Cl.

CPC ..... *A47L 13/24* (2013.01); *A47L 11/4008* (2013.01); *A47L 11/4041* (2013.01); *A47L 11/4069* (2013.01); *A47L 13/42* (2013.01)

(58) Field of Classification Search

CPC ..... A47L 13/24; A47L 13/42; A47L 11/4008; A47L 11/4041; A47L 11/4069; A47L 11/26; A47L 11/4047

USPC ..... 15/99, 228

See application file for complete search history.

(56) References Cited

U.S. PATENT DOCUMENTS

| | | | |
|---|---|---|---|
| 899,725 | A | 9/1908 | Goodier |
| 899,726 | A | 9/1908 | Goodier |
| 1,130,064 | A | 3/1915 | Buchanan |
| 2,452,744 | A | 11/1948 | Gardner |
| 2,690,582 | A | 10/1954 | Sundell |
| 2,828,501 | A | 4/1958 | Brown, Sr. |
| 4,121,315 | A | 10/1978 | Buser |
| 4,510,642 | A | 4/1985 | Ingermann et al. |
| D281,362 | S | 11/1985 | Ingermann et al. |

(Continued)

FOREIGN PATENT DOCUMENTS

| | | | |
|---|---|---|---|
| KR | 10-2014-0081631 | A | 1/2014 |
| WO | 2006/046053 | A1 | 5/2006 |

(Continued)

*Primary Examiner* — Peter M Poon

(74) *Attorney, Agent, or Firm* — Erickson Law Group, PC

(57) ABSTRACT

A mop is disclosed. In some embodiments, the mop has a head, a shaft, and an absorbent substrate. The head is connected to an end of the shaft. An absorbent substrate roll arrangement usable with a mop and a method of cleaning a floor are also disclosed.

9 Claims, 53 Drawing Sheets

(56) References Cited

U.S. PATENT DOCUMENTS

| | | | | |
|---|---|---|---|---|
| 4,550,467 | A | 11/1985 | Johnson et al. | |
| 4,562,610 | A | 1/1986 | Davis et al. | |
| 6,032,318 | A | 3/2000 | McLaughlin et al. | |
| 6,223,378 | B1 | 5/2001 | Watellier | |
| 6,735,806 | B2 | 5/2004 | Blum et al. | |
| 6,859,976 | B2 * | 3/2005 | Plankenhorn ..... | A47L 11/4069 15/364 |
| 6,904,638 | B2 | 6/2005 | Flynn et al. | |
| 7,223,036 | B2 | 5/2007 | Chang | |
| 8,555,449 | B2 | 10/2013 | Garcia | |
| 2002/0011813 | A1 | 1/2002 | Koselka | |
| 2003/0033681 | A1 | 2/2003 | Blum et al. | |
| 2003/0041404 | A1 | 3/2003 | Flynn et al. | |
| 2003/0159223 | A1 | 8/2003 | Plankenhorn | |
| 2005/0196225 | A1 | 9/2005 | Chang | |
| 2009/0097902 | A1 * | 4/2009 | Lemmon ..... | A47L 11/4008 15/104.93 |
| 2009/0158542 | A1 | 6/2009 | Noble | |
| 2012/0167918 | A1 | 7/2012 | Garcia | |
| 2016/0015236 | A1 | 1/2016 | Gold | |

FOREIGN PATENT DOCUMENTS

| | | | | |
|---|---|---|---|---|
| WO | WO-2016191624 | A1 * | 12/2016 | ..... A47L 11/4041 |
| WO | 2020/123276 | A1 | 6/2020 | |

* cited by examiner

MOP

This application claims the benefit of and priority to U.S. Patent Application No. 63/179,989, filed Apr. 26, 2021, which is hereby incorporated by reference in its entirety.

FIELD OF THE INVENTION

This invention relates in general to mops.

BACKGROUND OF THE INVENTION

Mops have been used to clean floors. At least one of the present inventors recognized the need for an improved mop.

SUMMARY OF THE INVENTION

A mop is disclosed. In some embodiments, the mop has a shaft, a head, and an absorbent substrate. The head is connected to an end of the shaft. The head has a nose and an absorbent substrate supply. The absorbent substrate extends from the absorbent substrate supply and over the nose.

In some embodiments, the head comprises a stop member. The stop member has a plurality of teeth. The stop member is movable between an engaged position where the teeth engage with the absorbent substrate and a disengaged position.

In some embodiments, the mop comprises an operating surface having a surface roughness configured to prevent the advancement of the absorbent substrate when the operating surface is engaged against the absorbent substrate.

In some embodiments, the head has a collection roller and a motor operably connected to the collection roller to drive rotation of the collection roller. The absorbent substrate is connected to the collection roller and drawn by the rotation of the collection roller.

In some embodiments, the head has an operating surface. The absorbent substrate extends over the operating surface from the absorbent substrate supply to a collection roller.

The operating surface comprises a surface roughness configured to prevent advancement of the absorbent substrate from the absorbent substrate supply when the operating surface is engaged against the absorbent substrate.

In some embodiments, the head has a collection roller and a collection roller release mechanism. The absorbent substrate is connected to the collection roller. The collection roller release mechanism has a latch. The latch is movable between a secured position and a released position. In the secured position the latch supports an end of the collection roller within the head. In the released position, an exit path at an end of the collection roller is unobstructed by the latch.

In some embodiments, the mop has an absorbent substrate. The head comprises a supply roller. The absorbent substrate is mounted to a supply roller. The head has a supply roller first axle housing, and a supply roller second axle housing, a first axle drop-in channel, and a second axle drop-in channel. The first axle drop-in channel is connected to the supply roller first axle housing. The second axle drop-in channel is connected to the supply roller second axle housing. The supply roller is removably mounted to rotate at opposite ends in the first and second axle housings. The drop-in channels direct the supply roller into the supply roller first axle housing and the supply roller second axle housing.

In some embodiments, the head has a supply roller, an operating surface, and an axel brake mechanism at a first axle housing of the head. The supply roller is mounted to rotate in the head. The absorbent substrate extends over the operating surface from the supply roller. The axle brake mechanism is configured to frictionally engage the supply roller. The axle brake mechanism is configured to increase a rotational resistance of the supply roller.

In some embodiments, the head has a supply roller and an axel brake mechanism at a first axle housing of the head. The absorbent substrate supply is mounted to a supply roller within the head. The axle brake mechanism is configured to frictionally engage the supply roller and increase a rotational resistance of the supply roller. In some embodiments, the axle braking mechanism has a friction spring positioned within the first axle housing to frictionally engage the supply roller. In some embodiments, the axle brake mechanism has a friction sleeve mounted at a terminal end of the supply roller and positioned in the first axle housing.

In some embodiments, the nose of the head has an upper operating surface, a lower operating surface, and a terminal end. The upper operating surface and the lower operating surface converge toward the terminal end. The absorbent substrate extends over the nose and between the absorbent substrate supply and a collection roller.

In some embodiments, the mop has a motor and a substrate advancement controller. The head has a collection roller and an operating surface. The absorbent substrate extends across the operating surface and to the collection roller. The motor is operably connected to the collection roller to drive a rotation of the collection roller. The absorbent substrate is advanceable from the absorbent substrate supply by the rotation of the collection roller.

In some embodiments, the substrate advancement controller is configured to instruct an operation of the motor to rotate the collection roller a predefined duration to advance the absorbent substrate. In some embodiments, the substrate advancement controller is configured to instruct an operation of the motor to rotate the collection roller a predefined duration depending on an amount of prior advancement of the absorbent substrate. In some embodiments, the substrate advancement controller is configured to instruct an operation of the motor to rotate the collection roller to advance the absorbent substrate a predefined distance depending on an amount of prior advancement of the absorbent substrate.

A method of cleaning a floor is disclosed. A first curved operating surface of a nose of a head of a mop is placed on the floor behind a soiling substance on the floor. The first operating surface and a second operating surface of the nose converge toward a terminal end of the nose. The first curved operating surface is slid forward toward the soiling substance.

The first curved operating surface is rocked on the floor toward a rearward portion of the operating surface causing a forward portion of the operating surface to lift up from the floor and to lift the soiling substance from the floor.

Another method of cleaning a floor is disclosed. A first curved operating surface of a nose of a head of a mop is placed on a soiling substance on the floor. The first operating surface and a second operating surface of the nose converge toward a terminal end of the nose. The first curved operating surface is rocked on the floor toward a rearward portion of the first curved operating surface causing a forward portion of the first curved operating surface to lift up from the floor and to lift the soiling substance from the floor.

An absorbent substrate roll arrangement usable with a mop is disclosed. In some embodiments, the arrangement has an absorbent substrate having a wound portion and a lead portion. The lead portion extends from the wound portion. The lead portion has a distal end and a proximal end. The proximal end is adjacent the wound portion. The proximal end of the lead portion is releasably fixed to a layer of the wound portion.

Numerous other advantages and features of the present invention will become readily apparent from the following detailed description of the invention and the embodiments thereof, from the claims, and from the accompanying drawings.

DETAILED DESCRIPTION

The following description is presented to enable any person skilled in the art to make and use the invention. For the purposes of explanation, specific nomenclature is set forth to provide a plural understanding of the present invention. While this invention is susceptible of embodiment in many different forms, the drawings and description provided herein, of specific embodiments of the invention is provided with the understanding that the present disclosure is to be considered as an exemplification of the principles of the invention and is not intended to limit the invention to the specific embodiments illustrated.

Figure 1:
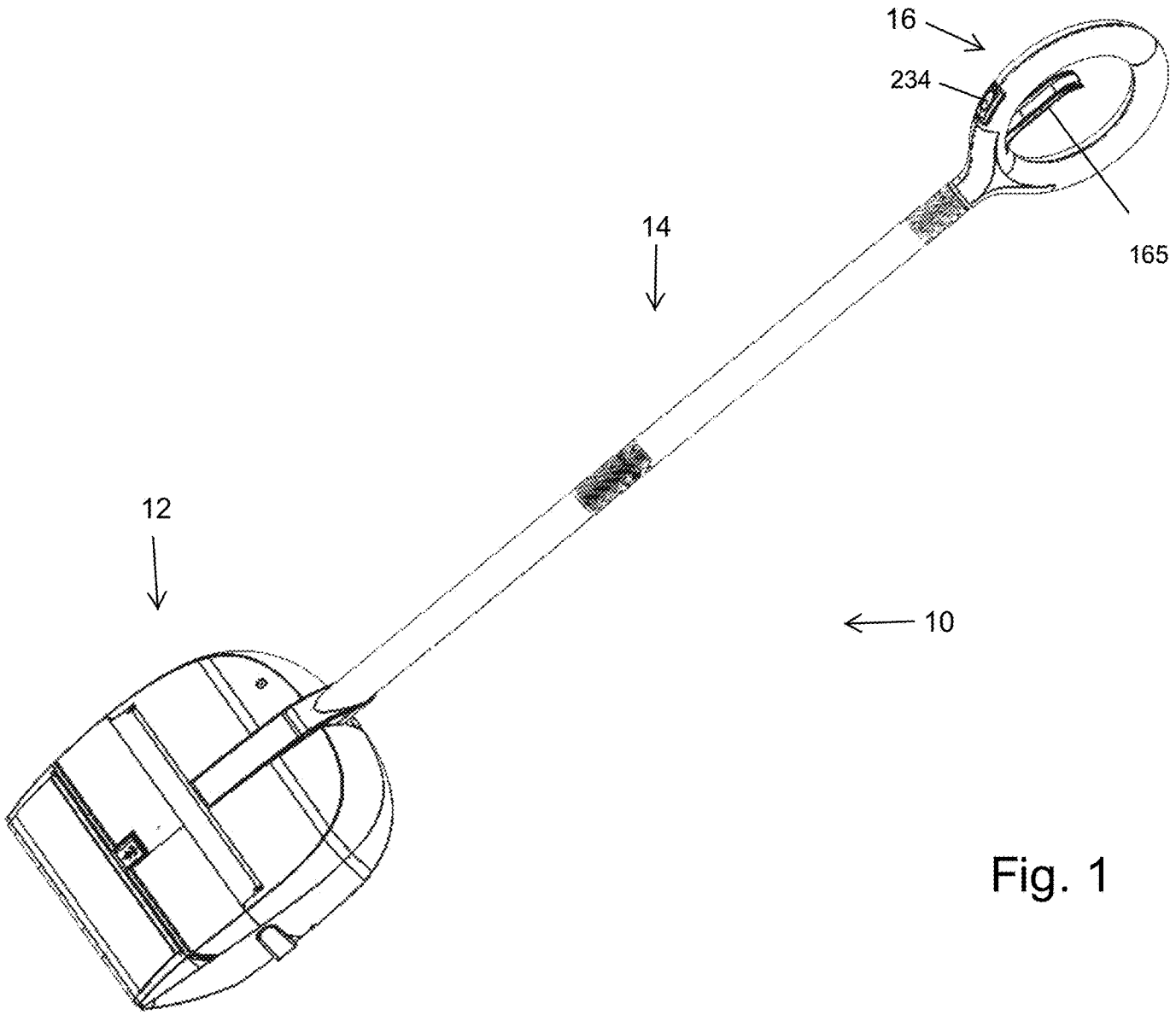
FIG. 1 is a top perspective view of a first embodiment mop of the present invention.

FIG. 1 shows a mop 10 of the invention. The mop comprises a head 12 and shaft 14. The shaft 14 comprises a handle 16 opposite the head 12.

Figure 7:
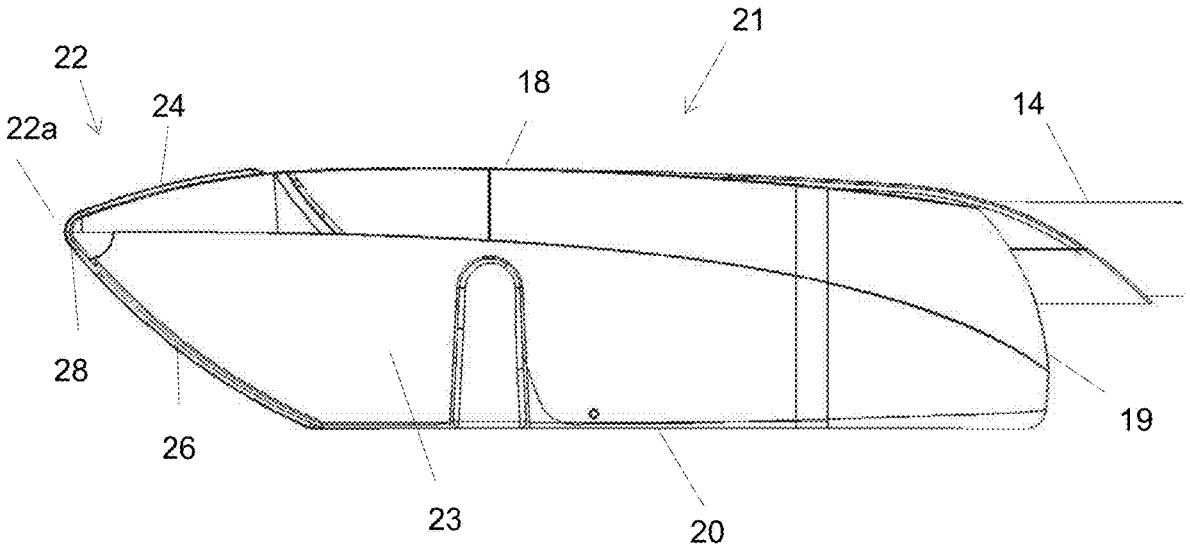
FIG. 7 is a right side view of a head of the mop of FIG. 1.
Figure 8:
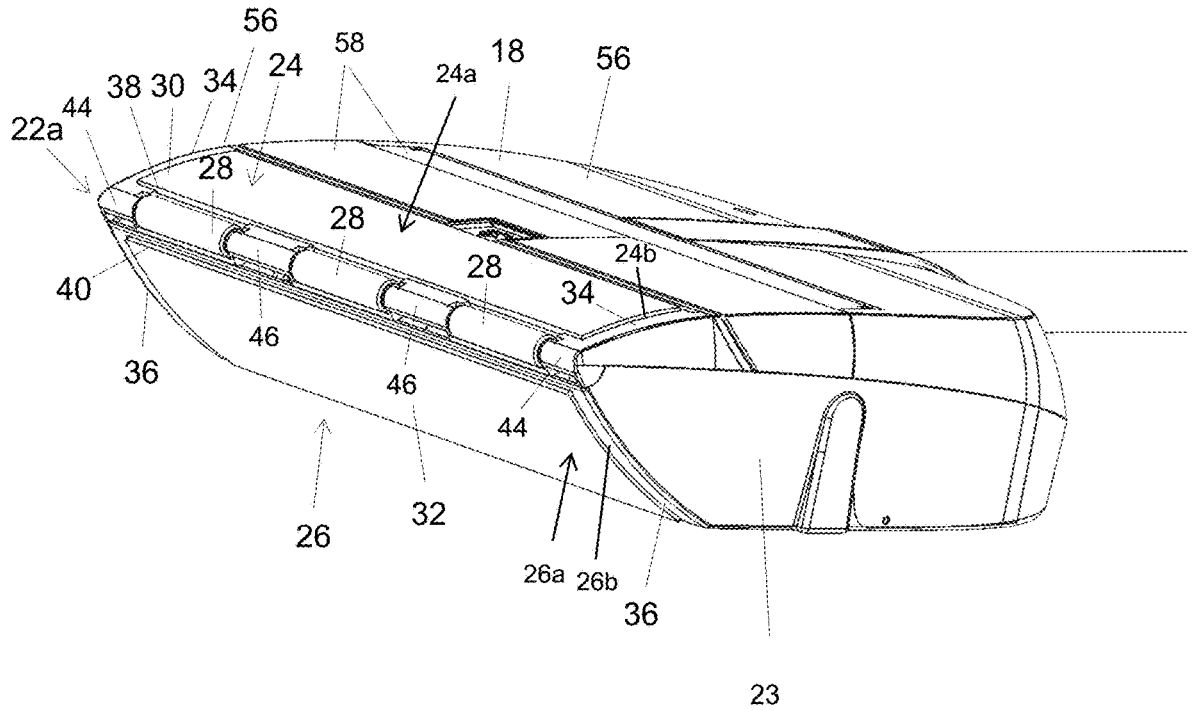
FIG. 8 is a right side perspective view of the head of the mop of FIG. 1.
Figure 10:
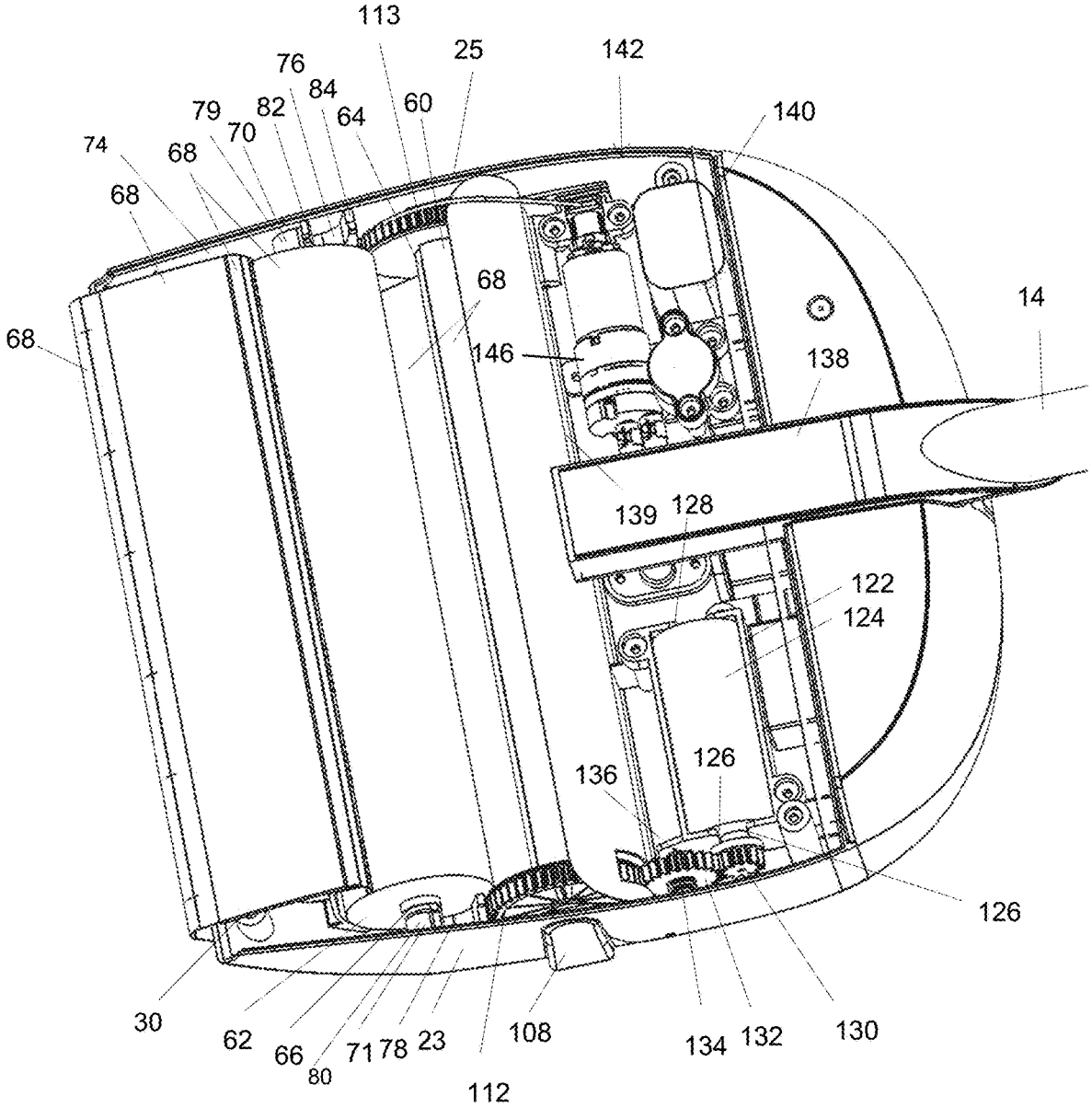
FIG. 10 is a top perspective view of the head of the mop of FIG. 1 with certain portions not shown.

The head 12 comprises housing 21 with a top 18, a back 19, a bottom 20, a nose 22, a first side 23, and a second side 25, as labeled at least in FIGS. 7, 8, and 10. The nose 22 is opposite the back 19. The shaft 14 meets the head 12 at the back 19 opposite the nose 22. The nose comprises a top or first converging portion 24, and a bottom or second converging portion 26. In some embodiments, the nose also comprises one or more rollers 28.

As shown in FIGS. 7 and 8, the first converging portion 24 comprises a wall 24*a*. The wall 24*a* comprises a first upper operating surface 24*b* and a first pad 30. The pad is mounted to the first upper operating surface. The second converging portion 26 comprises a wall 26*a*. The wall 26*a* comprises a first lower operating surface 26*b* and a second pad 32. The pad is mounted to the first lower operating surface. In some embodiments, the pads 30, 32 are fixed to respective operating surfaces 24*b*, 26*b* so that the pad conforms to the shape and/or contour of the respective operating surface 24*b*, 26*b*. In some embodiments, the outer surface of each pad 30, 32 matches the shape and/or contour of the respective operating surface 24*b*, 26*b*. In some embodiments, the pads 30, 32 are not used.

The first pad 30 is raised from the perimeter portions 34 surrounding or partially surrounding the pad 30. The second pad 32 is raised from the perimeter portions 36 surrounding or partially surrounding the pad 32. The pads 30, 32 maybe flat or curved.

Figure 32:
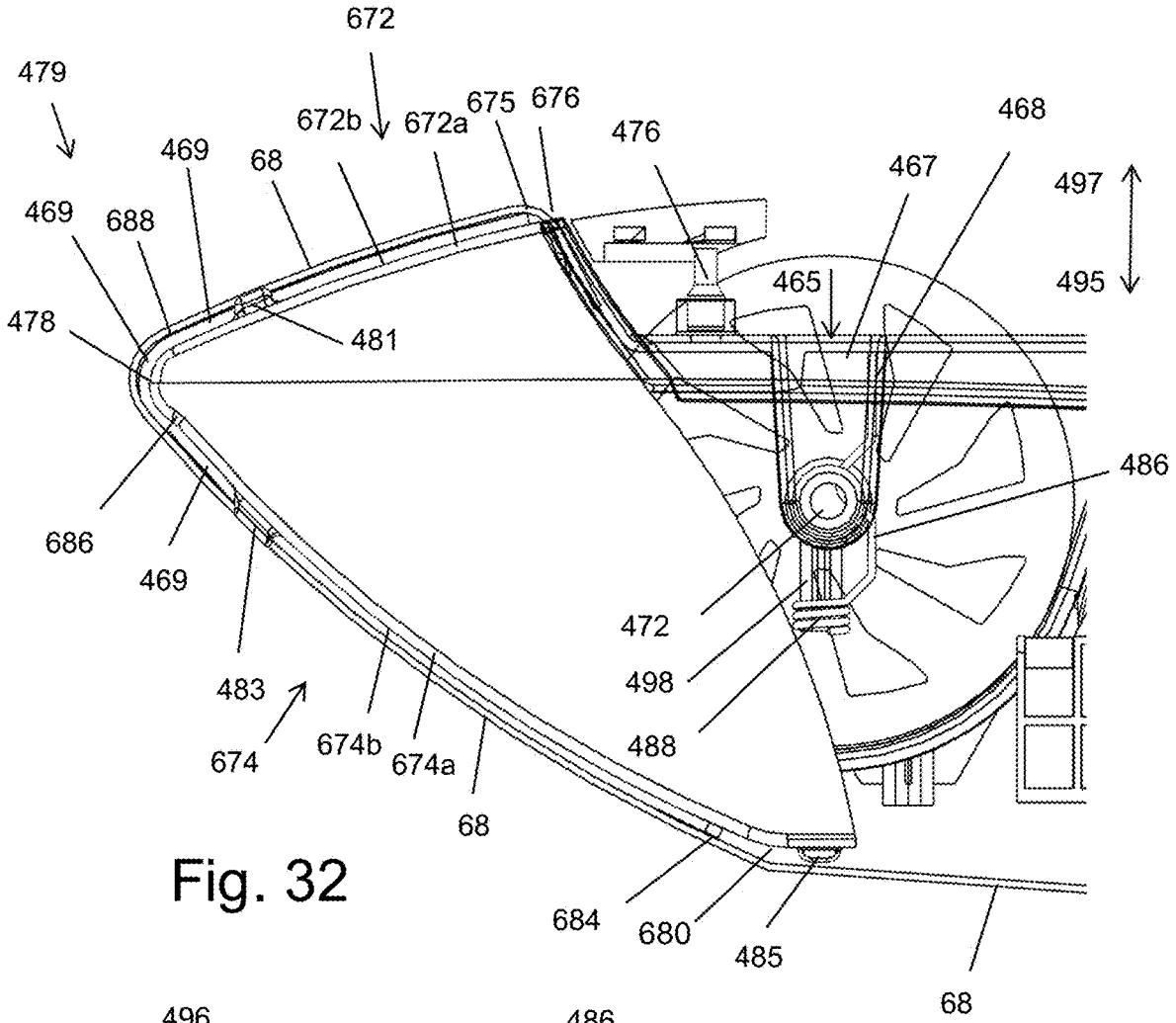
FIG. 32 is a side view of a portion of the mop head of FIG. 31 with the housing shown transparently.

The nose 22 comprises a front or terminal end 22*a*. In some embodiments, the front end 22*a* comprises the rollers 28. In some embodiments, the rollers are located between a front end 38 of the first pad 30 and a front end 40 of the second pad 32. The embodiment shown in FIG. 8 comprises three rollers 28. In some embodiments, only one wide roller is used. In some embodiments, two rollers are used. In some embodiments, more than three rollers are used. In some embodiments, no rollers are used, such as shown in the embodiment of FIG. 32.

Figure 9:
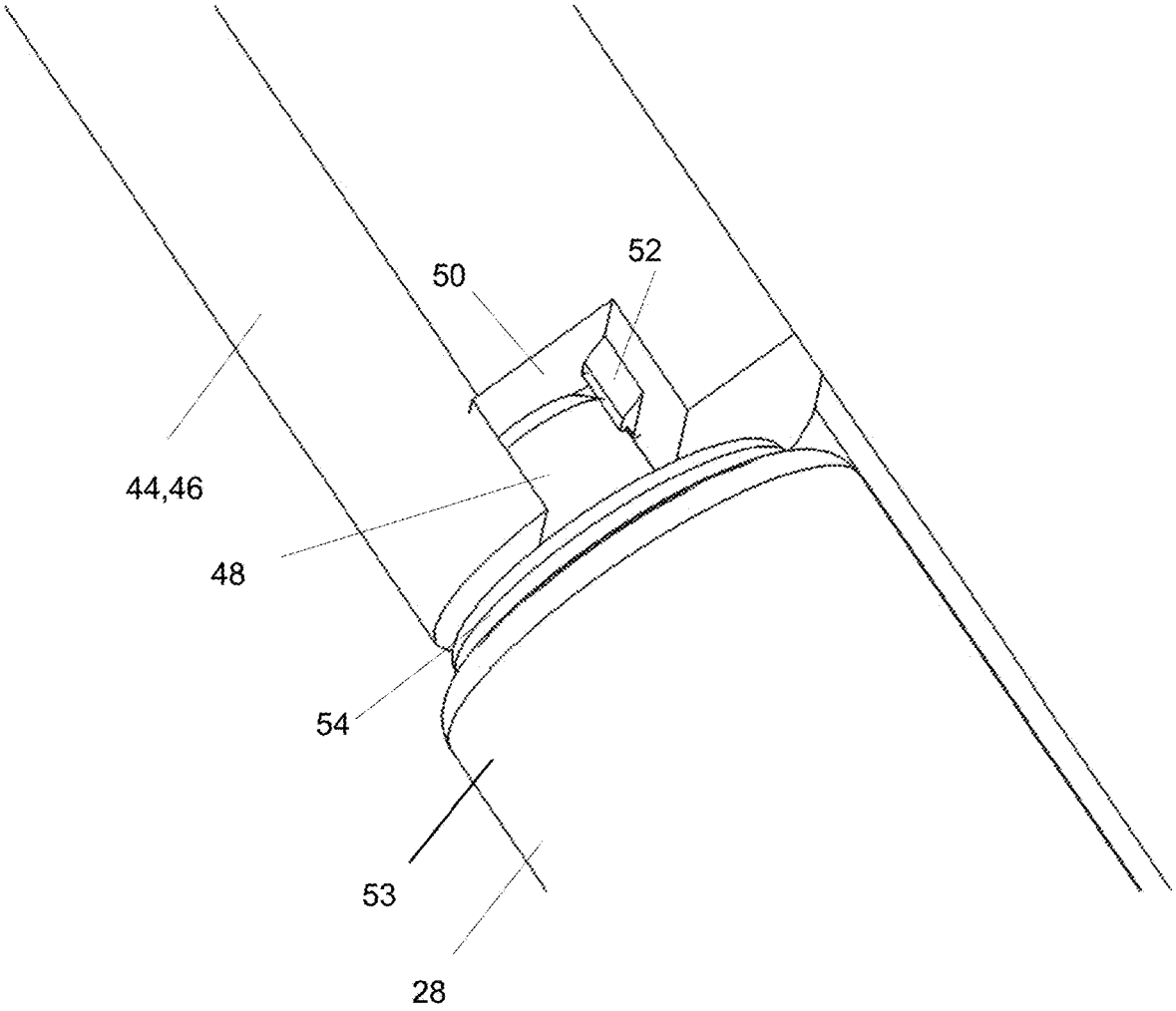
FIG. 9 is a partial top perspective view of a roller of the head of the mop of FIG. 1.

Referring to FIG. 9, the opposite ends of each roller 28 comprise spindles 48. The spindles 48 are housed in roller support members 44, 46. The roller support members comprise recesses 50 for receiving the spindles. The spindles are free to rotate within the recesses 50. The recesses 50 may comprise a stop 52 extending from one or more walls of the recess to hold the spindle of the roller within an operating area of the recess. In some embodiments, the spindle can be removed from the recess by applying an overcoming force to cause the spindle to overcome the stop. In some embodiments, the rollers comprise a rubber exterior 53 mounted to a core 54 of the rollers.

FIG. 10 shows the head 12 with the top cover 56 and top door 58 not shown to show internal components. The head comprises a collection roller 60 and a supply roller 62. The supply roller comprises a supply roller shaft 66 and the collection roller comprises a collection roller shaft 64. An absorbent substrate 68 is joined to and/or wound around and extends between the shafts 64, 66 of the respective roller 60, 62. The supply roller, when comprising the absorbent substrate such as wound around the shaft, provides an absorbent substrate supply for the mop. In some embodiments, the shaft 64 and/or shaft 66 are made of or comprise a rigid paper, paperboard, corrugated paperboard, corrugated fiberboard, plastic, and/or metal. In some embodiments, the shaft 64 and/or shaft 66 has a solid core and cross-section. In some embodiments, the shaft 64 and/or shaft 66 is a tube with a hollow core.

In some embodiments, the absorbent substrate 68 is a woven substrate or a non-woven substrate. In some embodiments, the non-woven substrate and/or woven substrate comprise natural and/or synthetic fibers. In some embodiments, the substrate comprises paper and/or fabric, including paper substrates, and fabrics. In some embodiments, the absorbent substrate is a fabric towel or paper towel. In some embodiments, the absorbent substrate can have a thin thickness, such as a thickness in the range of 1/32nd of an inch to 1/8th of an inch, inclusive. In some embodiments, the substrate can have a thickness in the range of greater than 1/8th of an inch to, and including, 3/8th of an inch. The absorbent substrate 68 extends from the supply roller 62 out a top opening 65 along the first pad 30, around the front end 22*a* of the nose 22, along the second pad 32, through the bottom opening 63 and to the collection roller 60. In some embodiments, the bottom opening 63 and the top opening 65 are elongated slots extending at least the width of the absorbent substrate 68, which may comprise a substantial portion of the width of the head 12.

The supply roller shaft 66 is journaled to rotate in axle housings 70, 71. The axle housings are attached, affixed, or integrally formed with the sidewalls 74 of the housing 21. First and second channels 76, 78 are aligned with the axle housings 70, 71, respectively. The axle housings 70, 71 are open a respective first or second channel 76, 78 providing an entry path and an exit path to the respective axle housings 70, 71. Then channels 76, 78 provide drop-in paths for the supply roller.

The axle housings each comprise an operating location 79, 80 where the roller shaft operates, including rotates. Referring to housing 70, the channel 76 is bounded on opposite side by sidewalls 82, 84. The sidewalls 82, 84 provide a curved path to the operating location 79 at the bottom of the channel 76. When the supply roller shaft is installed in the channels 76, 78, gravity and/or user pushing downward will cause the roller shaft to move to the bottom of the channel and into the operating location 79, 80. The operating location provides a cylindrical or semi cylindrical housing within which the supply roller shaft 66 rotates. The collection roller 60 is mounted rearward of the supply roller 62 within the housing 21.

In some embodiments, aligning the supply roller shaft 66 with the channels 76,78 and releasing the roller shaft into the channels 76, 78 is sufficient for gravity to cause the roller shaft to travel to the respective operating location of the respective axle housing. In some embodiments, aligning the roller shaft with the channels 76,78 and releasing the roller shaft into the channels, along with a downward push toward the operating location by the user, is sufficient to cause the roller shaft to travel to the operating location of the respective axle housing. Therefore, in some embodiments, the channels allow the supply roller 62 to be installed by a drop-in action of the user. In some embodiments, the user can withdraw the supply roller by pulling the collection roller upward so that the supply roller shaft travels upward out of the channels 76, 78.

Figure 11:
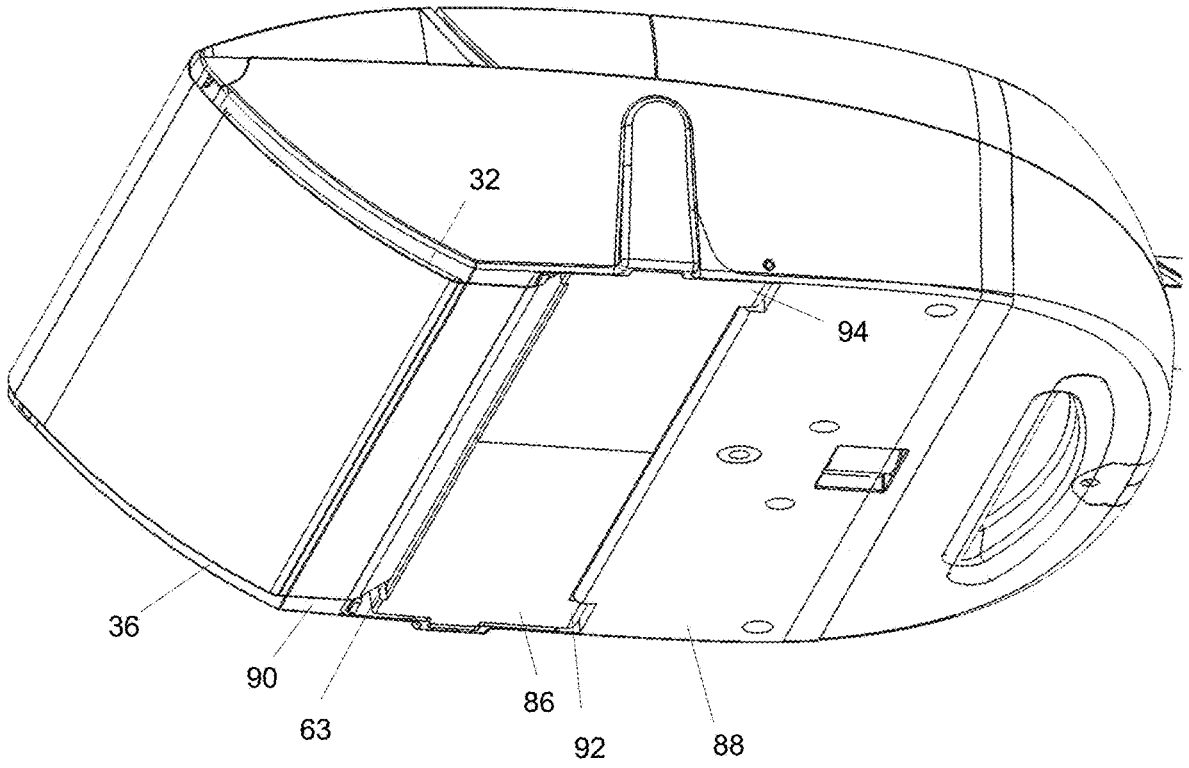
FIG. 11 is a bottom perspective view of the head of the mop of FIG. 1.
Figure 12:
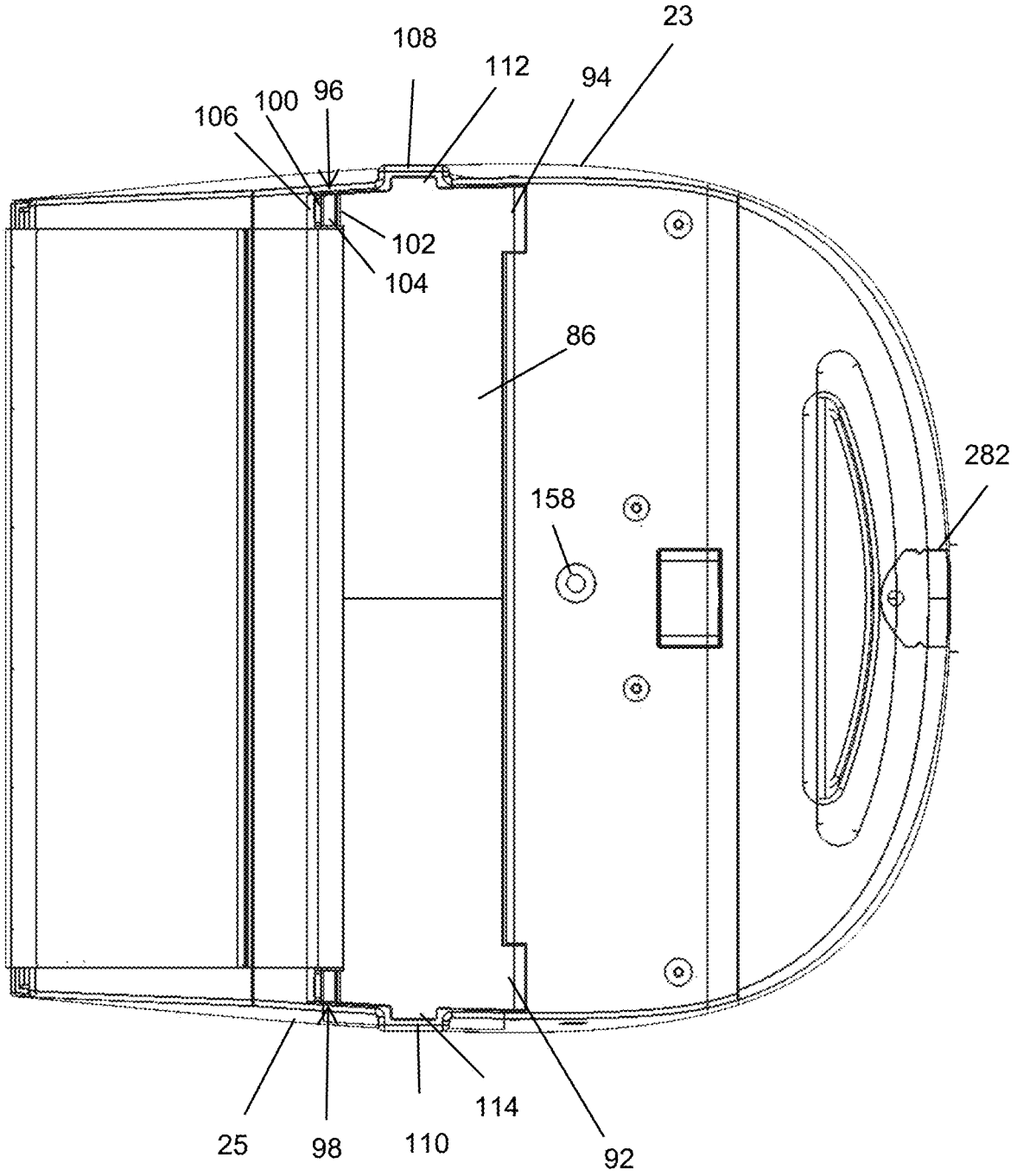
FIG. 12 is a bottom view of the head of the mop of FIG. 1.

FIGS. 11 and 12 shows bottom views of the head. The housing 21 comprises a bottom door 86, a bottom rear floor 88, and a forward intermediate portion 90. The bottom opening 63 is located between the bottom door 86 and the intermediate portion 90. The second pad 32 is forward of the intermediate portion 90 and the absorbent substrate 68 extends along the intermediate portion 90 before reaching the bottom opening 63. The bottom door 86 is pivotally attached to the bottom rear floor 88 at hinges 92, 94. In some embodiments, the bottom door can be release by compressing the release tabs 96, 98, labeled in FIG. 12, toward the rear of the head. When released the bottom door will swing downward about hinges to at, about, or further than ninety degrees from the position of the bottom rear floor 88. In some embodiments, a bottom door 86 is not used, such as in the embodiment of FIG. 37.

The release tabs are identical so only tab 96 will be described in detail. The tab is fixed or formed with the door 86. The tab comprises a front segment 100, a back segment 102 and a cross segment 104. The cross segment joins the front segment to the back segment at a top end of each segment. Therefore, the tab comprises a U-shape with the front and back segment comprising the legs of the "U." The tabs bias the front segment 100 against a front wall 106 of a recess in the intermediate portion 90. The contact and friction between the front segment and the wall 106 keeps the tab in the recess and the door in the closed position.

Figure 13:
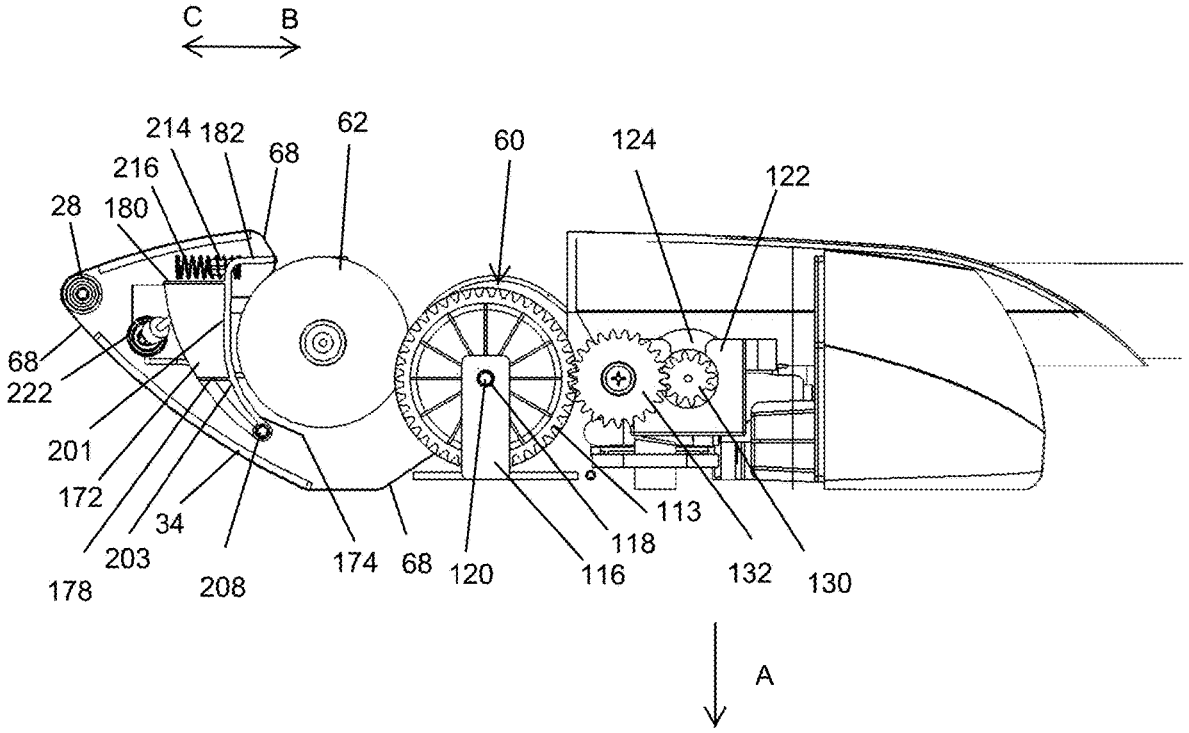
FIG. 13 is a right side view of the head of the mop of FIG. 1 with certain portions not shown.

In some embodiments, the side walls of the sides 23, 25 each comprise a roller carriage receiver 108, 110. The receivers 108, 110 protrude laterally from the surrounding portions of the sidewalls. The receivers 108, 110, comprise recesses 112, 114 where carriages 116 (side 23 not shown) are received. In some embodiments, the carriages 116 are elongated as shown in FIG. 13. The carriages 116 are identical on each side of the housing. In some embodiments, a roller gear 113 may be provided on each side of the roller 60 so that the roller can be reversibly installed. In some embodiments, a roller gear 113 is only provided on one side of the roller, the side that is in gear communication with the drive motor 124.

The carriages 116 comprise a journal 118 for receiving an axle 120 fixed to a roller gear 113. The roller gear 113 is fixed or operably connected to the roller 60. The axle 120 rotates within the journal 118.

To remove the roller 60, the bottom door 86 is opened, if a bottom door is used. Then the carriages 116 are drawn downward in the direction A of FIG. 13. The movement of carriages 116 brings downward the roller gear 113 and the roller 60. In the alternative, the user can draw the roller 60 downward, which will cause the carriages to move downward along the recesses 112, 114 and out the bottom of the recesses 112, 114. In some embodiments, a roller release mechanism is provided for releasing the collection roller 60, such as the roller release mechanism 520 as discussed below.

A motor housing 122 is provided behind the roller 60. In some embodiments, the housing is attached to or formed with the bottom rear floor 88. The motor housing 122 contains a motor 124. The housing 122 has four sidewalls. The longitudinal end side walls of the housing 122 each comprise an opening 126, 128. Opening 126 allows a motor output shaft to extend beyond the housing 122. The motor drives the motor output shaft 129 to rotate. A drive gear 130 is fixed to the motor output shaft. An idle gear 132 is enmeshed with and driven by the drive gear 130. The idle gear is mounted to rotate with shafts or stubs 134 (opposite side not shown) on opposite sides of the idle gear rotatably mounted to the wall of side 25 and an internal support wall 136. The support wall 136 may join with the motor housing 122. The idle gear is enmeshed with the roller gear 113. The idle gear is driven by the drive gear and therefore drives the roller gear 113, which drives the roller 60 to rotate.

Figure 20:
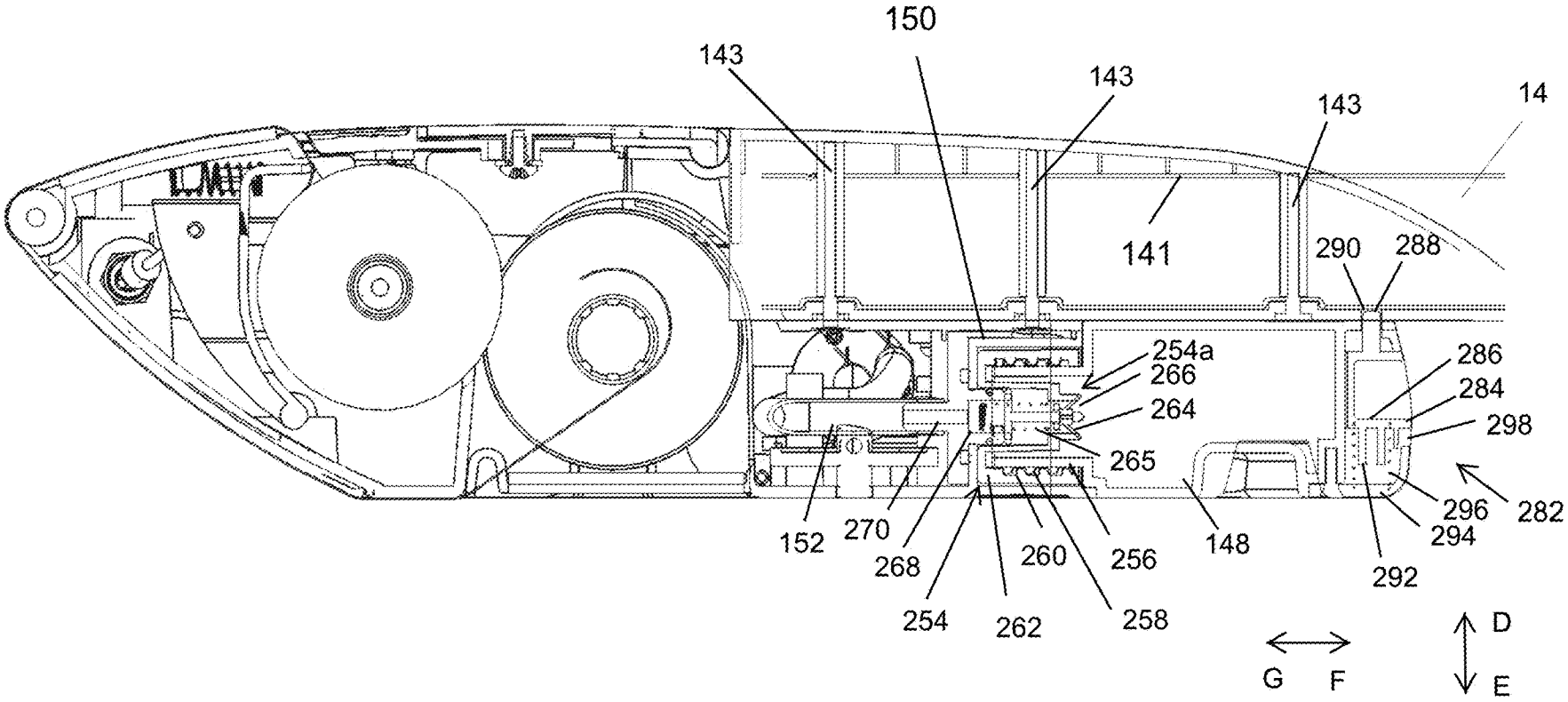
FIG. 20 is a side section view of the head of the mop of FIG. 1 taken along plane 20-20 of FIG. 6.

The shaft 14 opposite of the handle is received in a shaft housing 138 of the head 12, as labeled in FIG. 10. The shaft housing 138 extends from a rear of the head toward a mid-portion of the head as is shown in FIG. 10. The shaft housing may be supported on a first cross member support 139 at a forward end of the housing and a second cross member 140 rearward of the first cross member support. The shaft housing comprises an elongated cylindrical chamber 141 (FIG. 20) to receive and hold the shaft. The shaft is fixed to the shaft housing by pins 143 (FIG. 20) and thereby held to the head. Between the first and second cross members 139, 140 is a rear chamber 142, as labeled in FIG. 10. The cylindrical chamber 141 extends into or above the rear chamber 142 as shown in FIGS. 10, 13, and 20.

The head comprises a fluid pump system. The fluid pump system comprises a fluid pump 146, fluid supply conduit 152 and a fluid reservoir 148. The fluid reservoir is behind and attached to the rear chamber 142. The fluid reservoir comprises an enclosed space for holding a fluid. In some applications, the fluid is water or a cleaning solution or agent. In some embodiments and applications, the cleaning solution or agent comprises one or more of vinegar, disinfectants, floor cleaners, wood cleaners, tile cleaners, ammonia solutions, other cleaning solution, or a combination thereof. The reservoir comprises an exit opening 266 that is closed by the valve cap 262, as shown in FIG. 20. The user removes the cap 262, such as by unscrewing it from the reservoir to provide access for filling the reservoir with fluid. The user places the cap 262 on or in the fill port, such as by screwing in, to seal the fluid within the reservoir.

The housing 21 comprises a recess 150 for receiving a projection assembly 254 of the reservoir. The fluid supply conduit 152 is fluid-tight fitted to the outlet 151 of the reservoir 148, such as by a clamp 153. The opposite end of the supply conduit 152 is fluid-tight fitted to a pump inlet 154 of the fluid pump 146, such as by a clamp 153*a*. The fluid pump is connected to a pump motor 144. The pump motor drives the fluid pump to pump fluid from the supply conduit (from the reservoir) to a pump outlet 156. An output conduit 157 is fluid-tight fitted to the pump outlet 156, such as by a clamp 153*b*. The opposite end of the output conduit 157 is connected to a dispensing port 158. The dispensing port extends through the bottom rear floor 88.

The fluid pump is operably connected to a pump handle 165 on the handle 16. The pump handle actuates a pump switch (not shown) when the pump handle is moved up. In some embodiments, when the pump handle actuates a pump switch, an electronic circuit is completed causing the fluid pump 146 to operate and pump fluid as powered by the power source 166. In some embodiments, an operation of the pump handle signals the controller 301 and the controller directs the fluid pump to operate and pump fluid as powered by the power source 166. Therefore, in some embodiments, the controller 301 controls the operation of the fluid pump.

When the pump operates it draws fluid from the reservoir and causes the fluid to dispense through the dispensing port. In operation when the mop head is on a floor surface, fluid dispensed through the dispensing port will go onto the floor where it can come in contact with the absorbent substrate 68 and through movement, such as a back-and-forth movement, of the mop head and the exposed absorbent substrate 68, via the handle, cause a cleaning of the floor. In some embodiments, the pump switch is connected to the fluid pump by a wire and/or one or more intermediate components. A power source 166, such as a battery, is provided within the chamber 142. The power source is secured to the floor 88 by a power source housing 145, which may be secured to the floor with fasteners. The power source is connected, such as by wire(s), to and powers each of the fluid pump/fluid motor and the drive motor 124.

In some embodiments, the pump operates when the pump handle is depressed or contracted by a user and stops operation when the pump handle is released. In some embodiments, the controller is configurable by a user to set a duration of operation of the fluid pump for each user depression or contraction of the handle. Therefore, in some embodiments, the fluid pump will operate for a predefined duration of time each time the pump handle is actuated. In some embodiments, the predefined duration of time of fluid pump operation is set by the actuation of a duration switch (not shown) on the handle or head of the mop. In some embodiments, a pump handle is not provided and instead a pump button or switch is provided adjacent the advance switch or button 234 on the handle 16 and the fluid pump is operable by the pump button or switch.

In some embodiment, the pump handle 165 is connected to and operates a manual pump (not shown). Therefore, instead of the fluid pump 146 being driven by the electronic pump motor 144, a manual pump can be provided that pumps fluid to dispense through the dispensing port via the mechanical movement of the pump handle in at least one direction. Therefore, an actuation of the handle moves a pumping element within the manual fluid pump and draws fluid from the reservoir and causes the fluid to dispense through the dispensing port.

Figure 14:
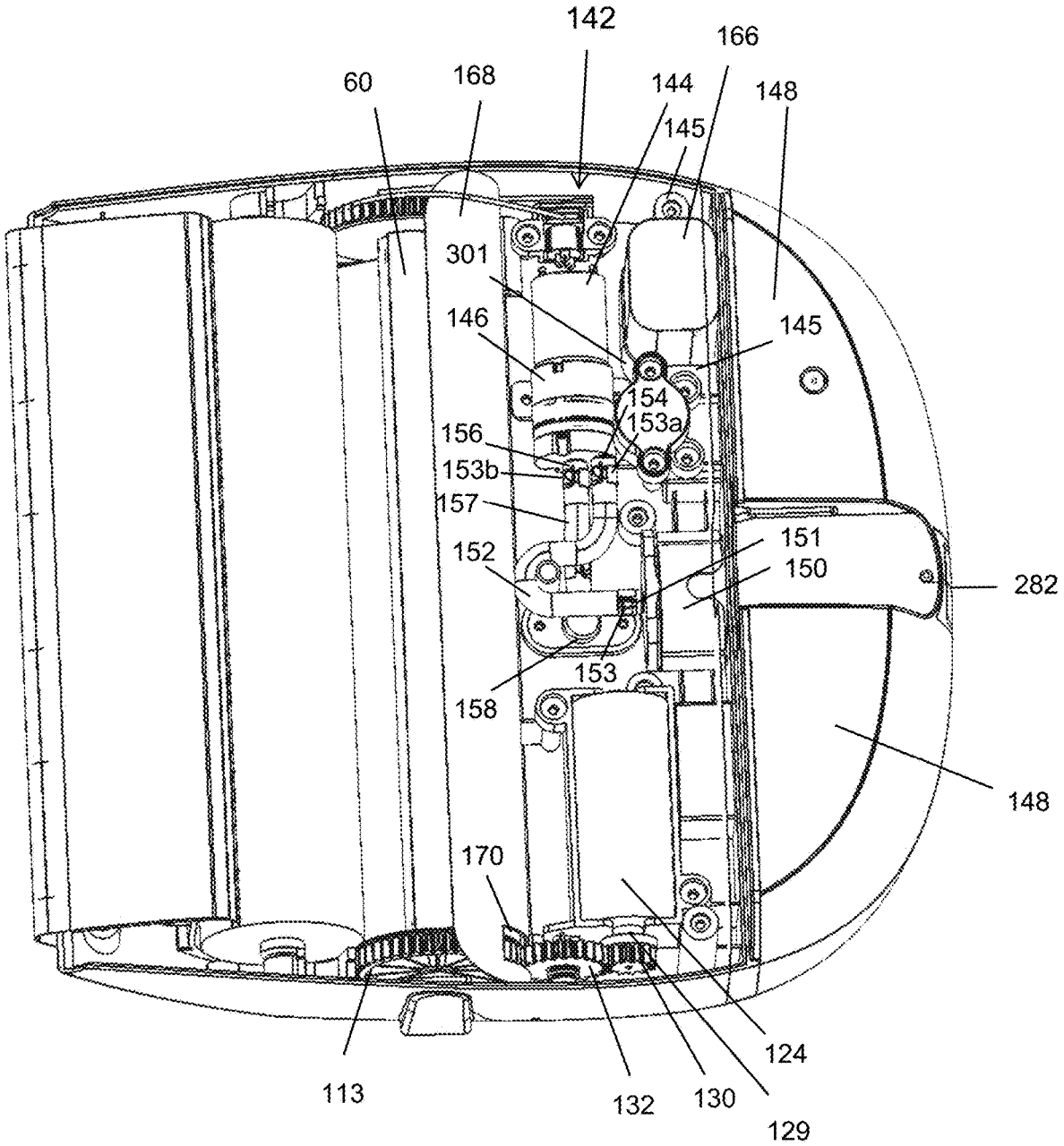
FIG. 14 is a top perspective view of the head of the mop of FIG. 1 with certain portions not shown.

A shield 168 extends between chamber 142 and the collection roller 60. In some embodiments, the shield is curved toward the roller 60 to cover a portion of the area above roller 60 as shown in FIG. 14. The shield 168 may comprise a gear opening 170 to allow roller gear 113 to extend partially into, and enmesh with idle gear 132.

Figure 15:
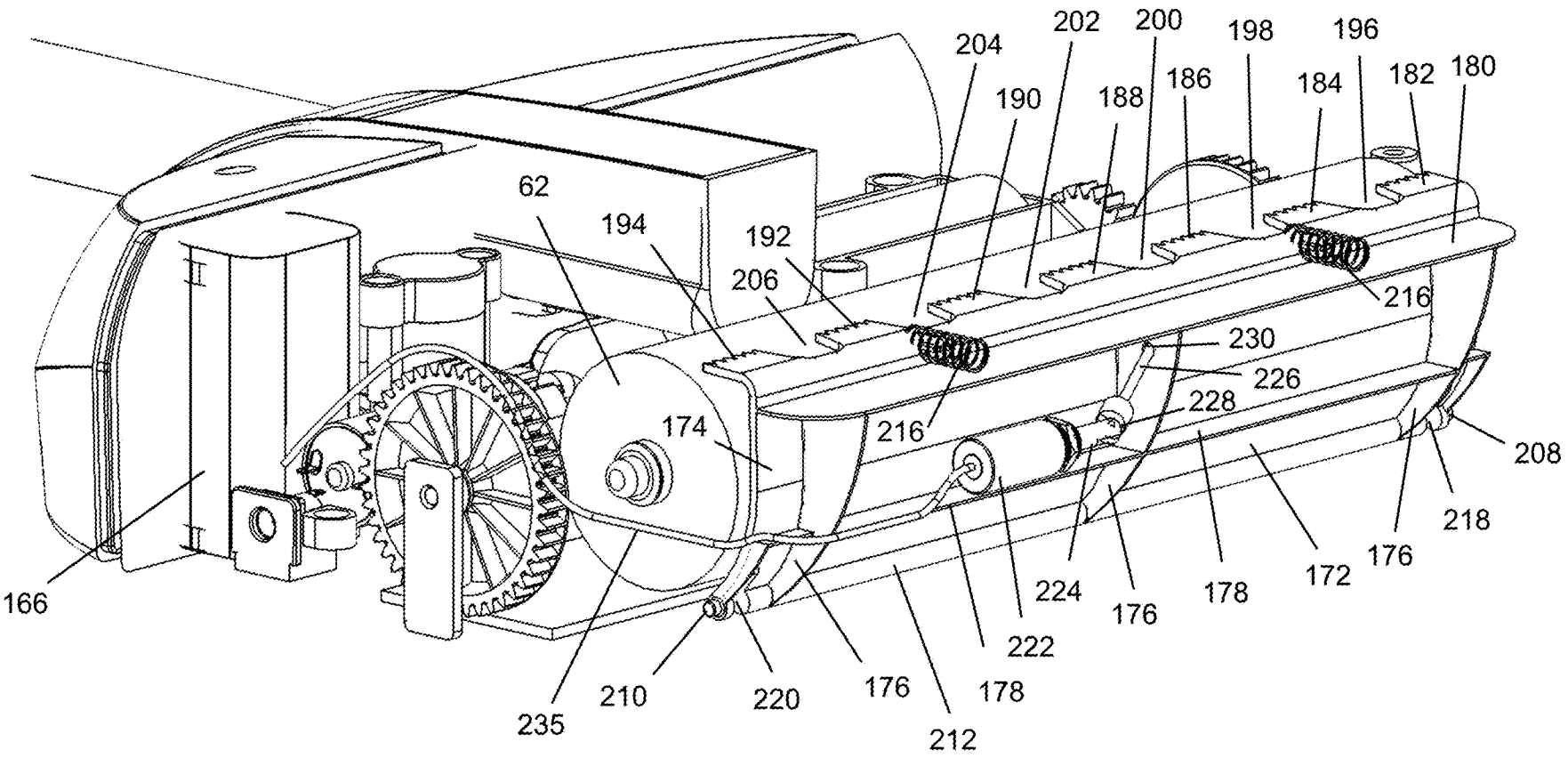
FIG. 15 is a front perspective view of the head of the mop of FIG. 1 with certain portions not shown.

The head comprises a stop member 172, as shown in FIGS. 13 and 15. The stop member 172 comprises a facing member 174, a plurality of support members 176, 178, 180, a plurality of grippers 182, 184, 186, 188, 190, 192, 194, and first and second pivot shafts, 208, 210. The stop member 172 comprises an upper portion 201, which may be straight, and a lower portion 203, which may be curved. The grippers 182, 184, 186, 188, 190, 192, 194 extend from the top of the portion 201. In some embodiments, the grippers extend transverse to the upper portion. In some embodiments, the grippers are perpendicular to the upper portion. In some embodiments, the grippers are integrally formed with the upper portion 201. In some embodiments, the grippers and the upper portion have a curved intersection as shown in FIG. 13.

In some embodiments, adjacent grippers are spaced apart from each other by intervening gaps 196, 198, 200, 202, 204, 206. In some embodiments, the grippers are not spaced apart and one unified gripper extends along the width of the stop member.

The first and second pivot shafts 208, 210 are located opposite of the grippers at a bottom of the stop member. The first and second pivot shafts 208, 210 are located on opposite sides of the stop member 172. The shafts 208, 210 are pivotally mounted in corresponding recesses of pivot housings 211 (not shown for side 25) in the inside of the first side 23, the second side 25 of the housing 21. Therefore, the stop member can pivot at the shafts 208, 210 toward (direction B) and away (direction C) from the supply roller 62, as labeled in FIG. 13.

The vertical support members 176 intersect with the horizontal support members 178, 180 and the bottom support member 212 to provide the facing member 174 with structural rigidity and support. The top horizontal support member 180 has a depth extending away from the facing member that is greater than a depth of the middle support member 178. The vertical support members 176 have a depth extending away from the facing member that is greatest at the top of the support member and least at the bottom of the support member as shown in FIG. 15. In some embodiments, the members 176, 178, 180, and/or 212 are integrally formed on or with facing member 174.

Figure 16:
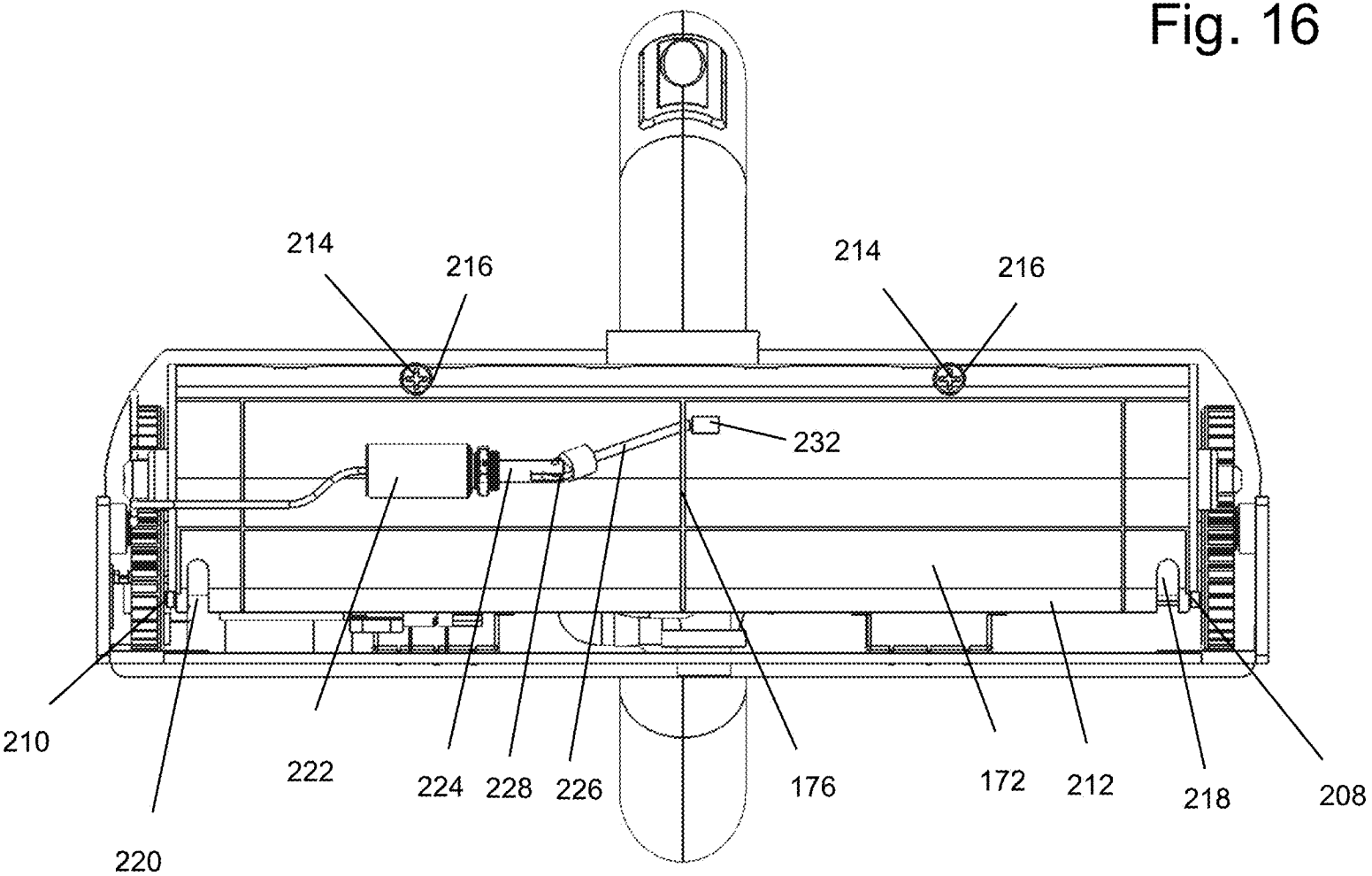
FIG. 16 is a front view of the head of the mop of FIG. 1 with certain portions not shown.
Figure 17:
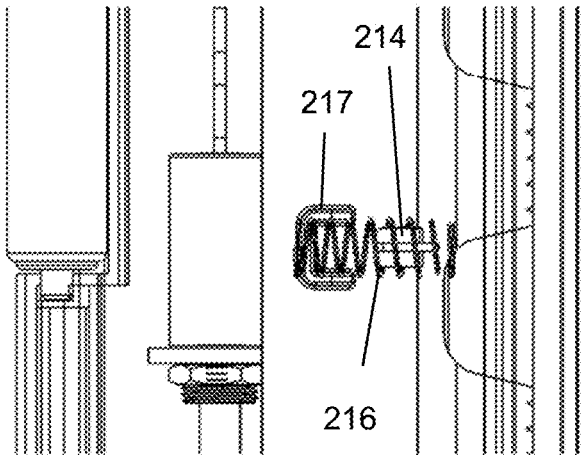
FIG. 17 is a top view of a portion of the head of the mop of FIG. 1 with certain portions not shown.
Figure 18:
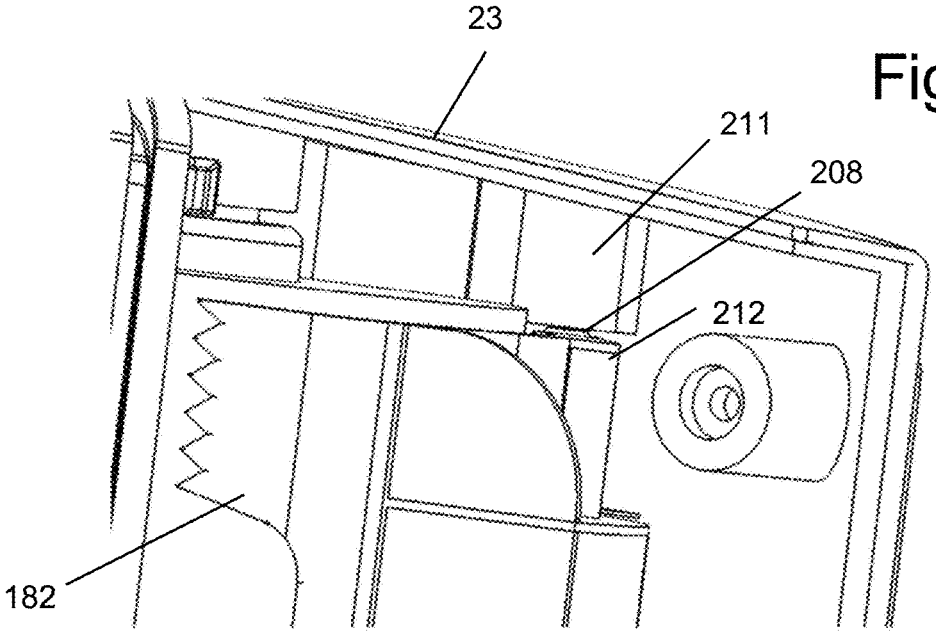
FIG. 18 is a top perspective view of a portion of the head of the mop of FIG. 1 with certain portions not shown.

Above the top horizontal support member 180 are one or more spring mounts 214 and one or more springs 216. The spring mounts 214 have and a X-configuration or cross-configuration, as can be seen in FIGS. 13, 15, and 16. The terminal ends of the arms of the X-configuration or cross-configuration contact or are in close proximity to the interior of the spiral springs. The spring mounts support the springs internally and assist in holding the springs in place relative to the stop member. As shown in FIG. 17, the springs bias the grippers toward the supply roller 62, in the direction B of FIG. 13. The springs are supported in a front stop 217 on housing 21 under the first converging portion 24, opposite of the spring mounts 214. In some embodiments, the front stop 217 is U-shaped.

In some embodiments, as shown in FIGS. 15 and 16, the stop member 172 comprises first and second slots 218, 220 adjacent the first and second shafts 208, 210, which provide a gap between the shafts and the interior portions of the bottom member 212. Frame support members (not shown) on an interior side opposite of the bottom covering portion 26, of the housing can be received in the slots for allowing a more compact configuration of the head 12. In some embodiments, the stop member is a stop bar.

The mop comprises a stop member operation system. The operation system comprises an actuator 222 and an advance switch or button 234 as shown in FIGS. 13 and 15. The actuator comprises an output shaft 224 that operably drives the stop member 172 to a released position from an engaged position. In some embodiments, the output shaft is connected to a linking shaft 226. The linking shaft 226 is connected or fixed to the stop member 172. In some embodiments, the linking shaft 226 is connected to the output shaft at a pivot joint 228. The pivot joint allows the linking shaft to angle from the output shaft to the stop member 172. In some embodiments, the linking shaft extends to or through an aperture 230 in the center vertical support member 176. A stop element 232 is located at the end of the linking shaft on a side of the support member 176 opposite of the actuator 222. The stop element 232 secures the linking shaft to the support member 176 at the aperture 230.

The actuator 222 is powered by the power source 166 via a cable 235, as shown in FIG. 15. The actuator may also be connected or controlled by a controller 301 (FIG. 14). The actuation of the switch 234 instructs or signals to the controller to actuate or cause the actuation of the actuator. In some embodiments, the power source is connected to the switch and the actuator to create a circuit. The actuator may be connected to the power source and/or the switch by one or more wires.

When a user actuates the switch 234, the controller 301 instructs or causes the powering of the actuator to move the output shaft 224 of the actuator to retract to the released position, which retracts the linking shaft, which retracts the stop member 172 away from the supply roller 66 in the direction C of FIG. 13. The teeth disengage from contact with and grip of the outer layer of absorbent substrate 68 spooled on the supply roller. Then the controller 301 instructs or causes the powering of the drive motor 124, which causes the output shaft of the drive motor to cause the gear 113 to rotate counterclockwise, which causes the collection roller 60 to draw absorbent substrate 68 on it. The drawn absorbent substrate collected on the collection roller may be dirty or soiled by prior exposed cleaning use on the head. This draws the absorbent substrate 68 from the supply roller 62 toward the collection roller 60 thereby advancing clean absorbent substrate from the supply roller to be exposed at least along the top converging portion 24 or a portion thereof. Optionally, controller 301 can be configured to cause the motor to operate to advance the clean absorbent substrate such that clean absorbent substrate extends along all or a portion of the bottom converging portion 26. And further optionally, controller 301 can be configured to cause the motor to operate to advance the clean absorbent substrate such that clean absorbent substrate from the supply roller extends along all or a portion of the intermediate portion 90. Therefore, the controller 301 can be configured to draw a pre-defined amount of clean absorbent substrate from the supply roller on to all or a portion of the path of absorbent substrate extending about the nose of the head.

When the advancing/drawing of the absorbent substrate is complete, the controller 301 will instruct or otherwise cause the actuator to release or will move the output shaft of the actuator toward the extended position. The springs 216 will drive or assist in moving the stop member to an engaged position so that the grippers engage, contact, and grip the absorbent substrate 68 and stop absorbent substrate from further advancing from the supply roller 62. The stop member engagement with the absorbent substrate 68 can be on the supply roll or the engagement can be downstream from the supply roller as shown in FIG. 13.

The collection roller is stopped from rotation in at least one direction when not rotated by the motor 124. In some embodiments, the collection roller is stopped from rotating in either directions about the collection roller shaft. Stopping the collection roller from rotation in an unspooling direction opposite the rotational direction that collects more absorbent substrate around the collection roller prevents reverse runout or unspooling of the absorbent substrate from the collection roller. In use of the mop, the friction of the absorbent substrate against the external surface, such as the floor, depending on the direction of use, will cause a pull against the absorbent substrate away from the collection roller. A pull of the absorbent substrate away from the collection roller can occur when the mop is operated on the bottom converging portion 26 and the mop is moved backwards on an external surface away from the terminal end 22*a* of the nose. A pull of the absorbent substrate away from the collection roller can also occur when the mop is operated on the top converging portion 24 and the mop is moved forwards on an external surface toward the terminal end 22*a* of the nose.

Without stopping the collection roller from rotation in the unspooling direction, the absorbent substrate can unspool and become excessively loose about the nose and may inhibit satisfactory operation of the mop on the external surface. Therefore, the absorbent substrate that extends about the nose is stopped from spooling out from the supply roller by the stop member 172 contact with the absorbent substrate and the absorbent substrate is stopped from unspooling from the collection roller by the motor stopping the rotation of the collection roller.

In some embodiments, the motor stops the rotation of the collection roller in one or both directions when the motor is not operating to rotate the motor output shaft and the collection roller, either by a brake within or connected to the motor applied against the output shaft of the motor or due to the friction the motor causes against the motor output shaft when the motor is not operating to rotate the output shaft and the collection roller.

In some embodiments, the actuator is oriented so that the output shaft 224 is parallel to the upper portion 201 of the facing member 174. The direction of motion of the output shaft is not transverse to the facing member 174 of the stop member 172.

In some embodiments, the area occupied by a full supply roller overlaps the area occupied by a full collection roller as can be seen in FIGS. 13 and 20. However, since both of the supply roller and the collection roller will not be full at the same time this overlap does not cause operation problems. In general, the supply roller will start in a full condition and the collection roller will start in an empty or near empty condition. As absorbent substrate is advanced by the user operating the advance button 234, the size of the supply roller will decrease as the size of the collection roller increases. This is because new absorbent substrate from the supply roller will become used absorbent substrate collected on the collection roller. In some embodiments, the area of overlap between the supply roller area and the collection roller area is between 1 and 33 percent or up to and including one-third. In some embodiments, the area occupied by a full supply roller does not overlap the area occupied by a full collection roller and the supply roller and the collection roller are housed in their own compartments or are otherwise physically separated such as provided third embodiment head 460.

Figure 19:
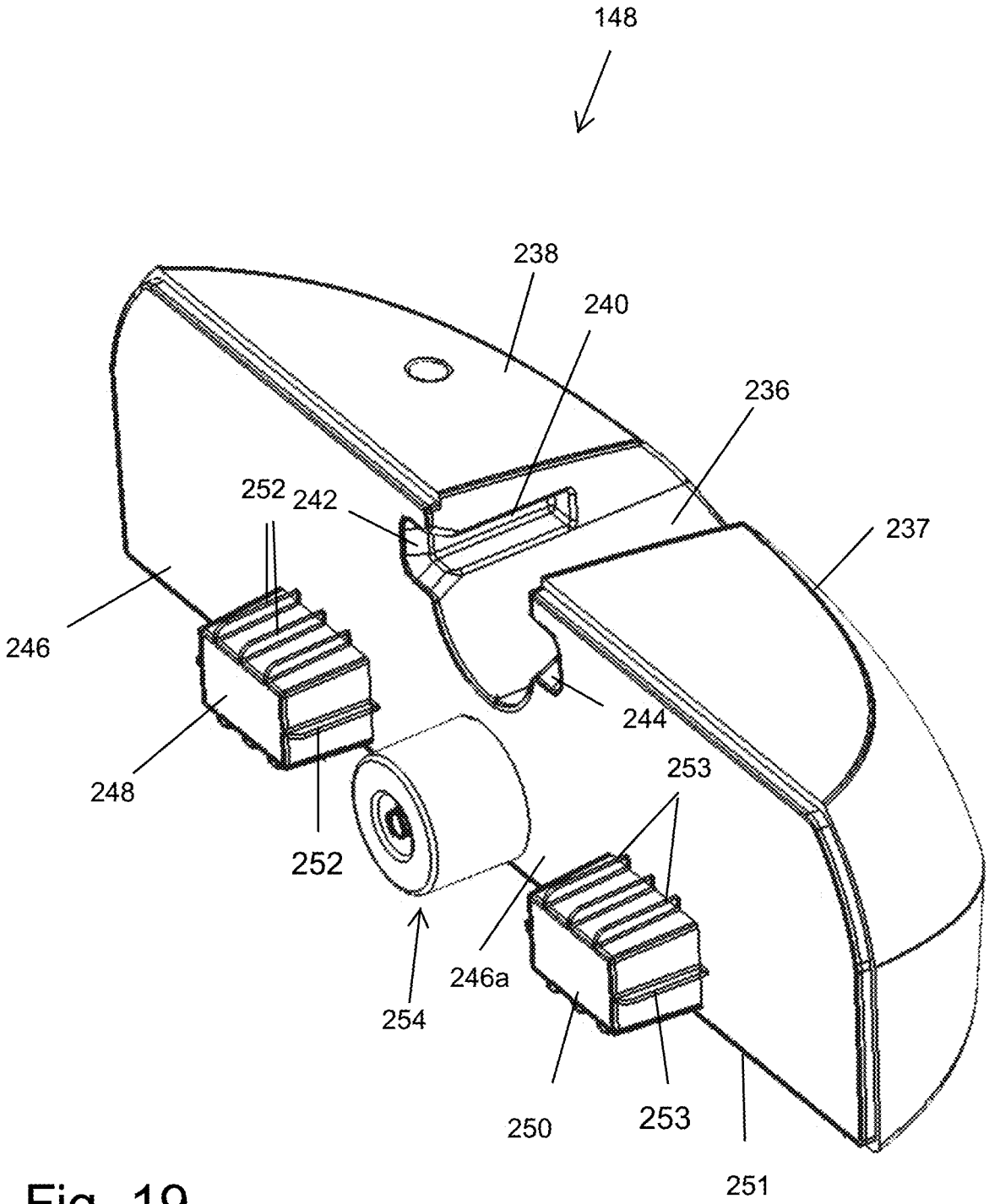
FIG. 19 is a perspective view of a reservoir of the mop of FIG. 1.

FIG. 19 shows the reservoir 148 removed from the head 12. The reservoir 148 comprises a shaft recess 236 that extends from a back side 237 of the reservoir to a front side 246 of the reservoir and interrupts a top side 238 of the reservoir. The shaft recess 236 comprises opposite side guide recesses 240 (not shown for right side but extending from 244). The guide recesses 240 comprise entry mouths 242, 244 which are enlarged vertically and laterally as compared to the corresponding dimensions of the shaft recesses as shown in FIG. 19. The reservoir comprises two alignment blocks 248, 250 which are located on a lower portion of the front side 246, at or adjacent a bottom edge 251 of the front side 246. Each side of the alignment blocks that are transverse to the face of the front side 246 comprise fins 252, 253. Between the alignment blocks is a reservoir outlet projection assembly 254 at the reservoir outlet 254*a*.

The outlet projection assembly 254 comprises a projection element 256 comprising a plurality of threads 258 and a valve cap 262, as shown in FIG. 20. The threads are releasably (by screwing) engaged by the valve cap 262, which comprises corresponding thread grooves 260. The valve cap 262 comprises a valve 264 provided in an exit opening 266. The valve is biased to a closed position by a spring 265, which closes the exit opening 266 to fluid passage. The spring bias is overcome by a head 268 of the valve contacting a stop 270 of the housing 21. When the reservoir is attached to the housing 21 the stop 270 drives the valve 264 to an open position allowing liquid to flow from the reservoir 148 into the supply conduit 152.

Figure 21:
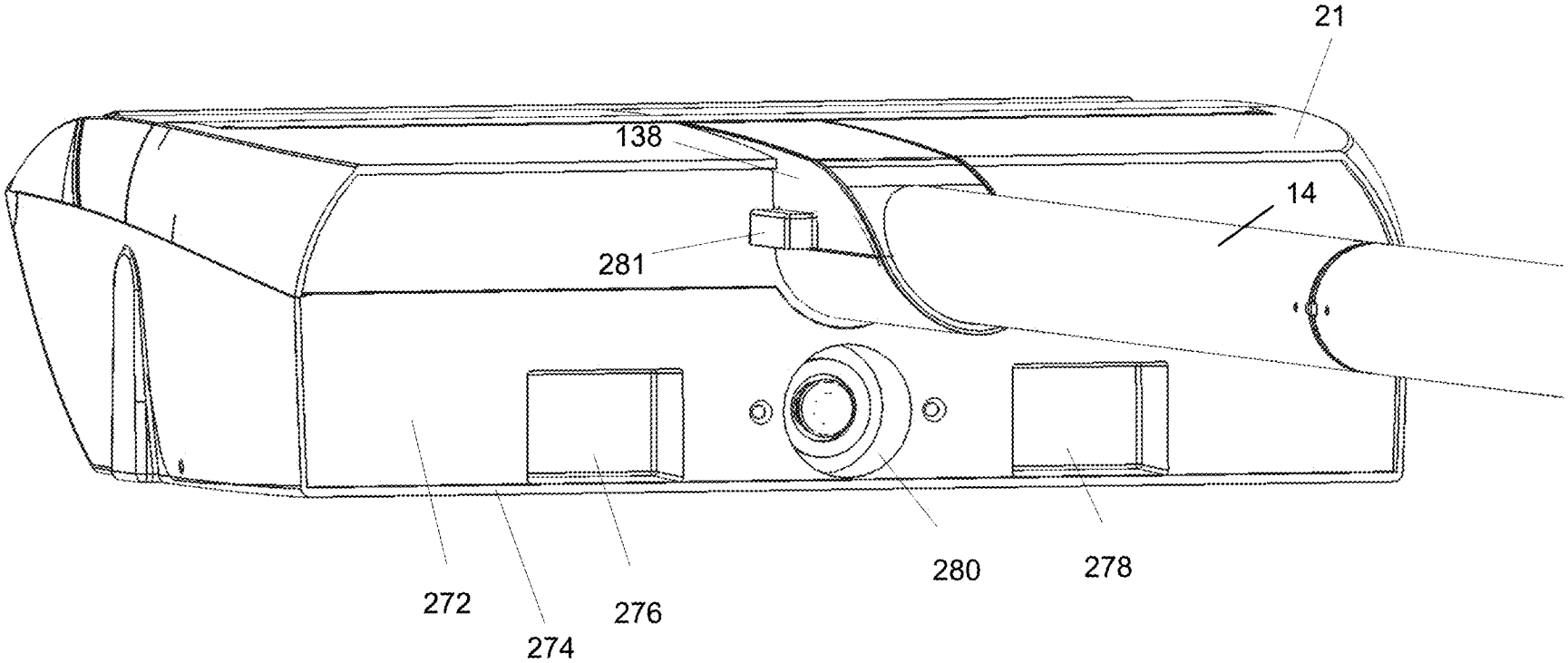
FIG. 21 is a rear perspective view of a portion of the mop of FIG. 1.

Referring to FIG. 21, in some embodiments, a back face 272 of the housing 21 is flat or substantially flat, yet the back face 272 can be other shapes that conform to the shape of the front side 246 of the reservoir. For example, in some embodiments, the front wall 246*a* of the front side 246 of the reservoir is convex on an external side about the reservoir outlet 254*a* and is concave on an internal side about the reservoir outlet 254*a* to draw fluid to the reservoir outlet 254*a*. Then the front face 272 of the housing is concave to match the convexity of the external side of front face 246.

The back face 272 of the housing 21 comprises guide block recesses 276, 278. The guide block recesses are located at or adjacent a bottom edge 274 of the back face 272. The back face 272 further comprises an inlet recess 280. The shaft housing 138 comprises side alignment projections 281 (not shown for right side of FIG. 21) on opposite sides of the shaft housing adjacent the back face 272.

As shown in FIG. 20, at the rear of the reservoir 148 is a lock mechanism 282 for securing the reservoir 148 to the shaft 14 and the housing 21. The mechanism 282 comprises a button 284. The button comprises a recess 286 for receiving a user's finger or thumb. On a top end of the button 284 is a locking member 288. In some embodiments, the locking member is an elongated shaft. The locking member 288 is received in the lock recess 290 of the shaft 14 adjacent the locking mechanism and reservoir. Opposite the locking member 288 about the button 284 is a spring guide 292 and a spring 296. The spring 296 extends between the button 284 and a base portion 294. The spring extends around the spring guide 292.

When a user presses the button 284 down in the direction E of FIG. 20, the locking member 288 will be drawn down with the button and withdrawn from the lock recess 290 against the bias of the spring 296. The gap 298 will be closed by the lowered position of the button 284 and may contact an adjacent portion of the base portion 294, which closes the gap. When the locking member 288 is withdrawn from the lock recess 290, the reservoir can be withdrawn from engagement with the housing 21 in the direction F of FIG. 20. Then the user can remove the valve cap 262 by unscrewing it via the threads from the reservoir 148 to allow the user access to the opening to the reservoir to fill or refill the reservoir with liquid. Once filling or refilling is complete the valve cap 262 can be reinstall by screwing the cap via the threads on to the projection element 256 of the reservoir 148.

Then the reservoir can be reinstalled by aligning the alignment blocks 248, 250 with the guide block recesses 276, 278 respectively and aligning the alignment projections 281 with the guide recesses 240, and the shaft recess 236 with the shaft 14 and/or shaft housing 138. Further, the reservoir outlet projection assembly 254 is aligned with the inlet recess 280. Then the user may push the reservoir 148 toward the housing 21 in the direction G, shown in FIG. 20, so that the stop 270 engages the head 268. Once the locking member 288 is aligned with the lock recess 290 the spring bias provided by spring 296 will drive the locking member up in direction D into the recess 290 and secure the reservoir against withdraw away from the housing 21 in the direction F.

Figure 22:
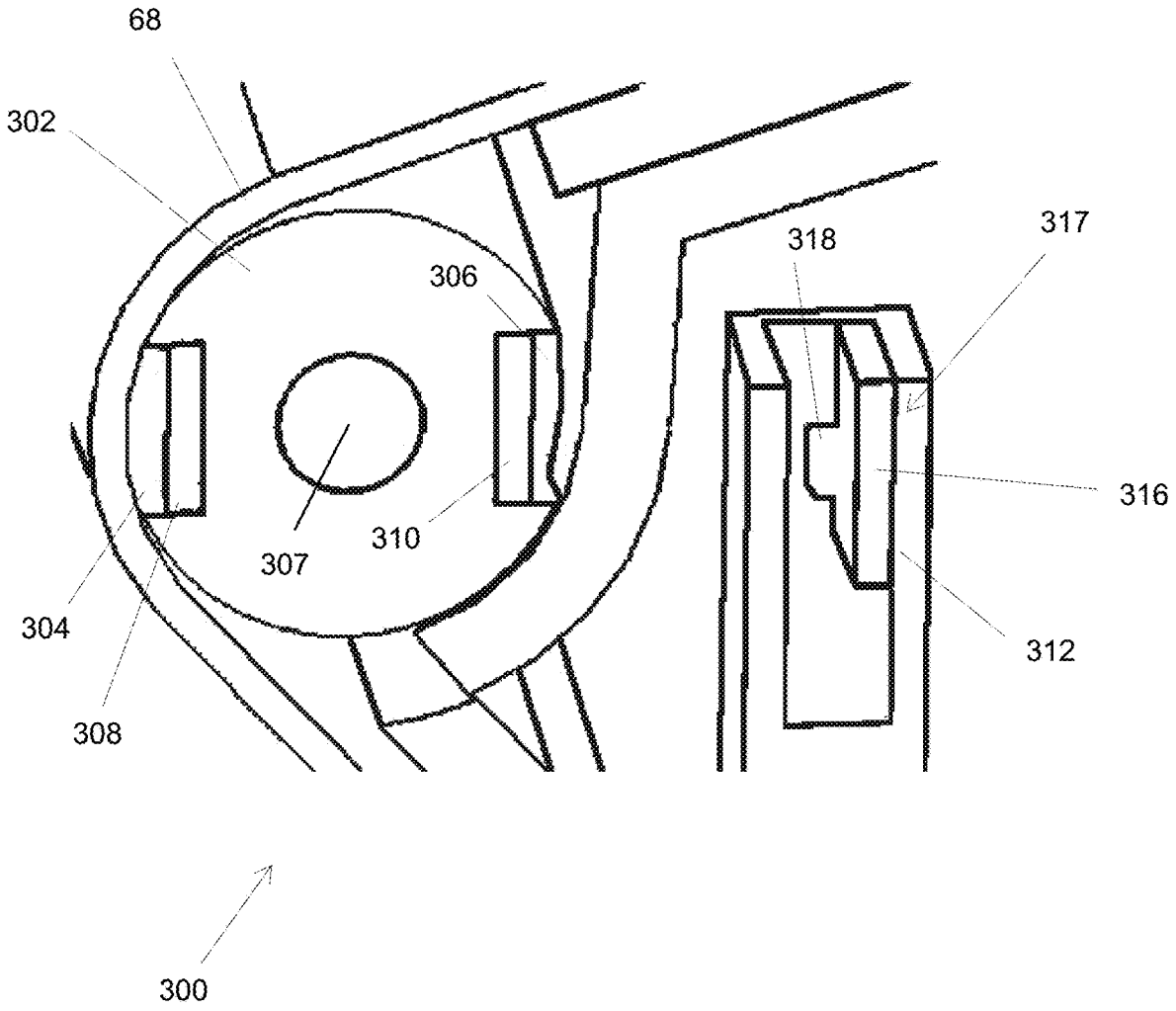
FIG. 22 is a partial right side perspective view of a portion of the head of the mop of FIG. 1.

FIG. 22 shows a portion of a substrate advancement measurement system 300. The system 300 comprises a sensor 317 and a substrate advancement controller. In some embodiments, the substrate advancement controller is the controller 301, which may be housed with or below the battery 140 (FIG. 14), in the removable battery unit 616 (FIGS. 45-48), or elsewhere in the housing 21. In some embodiments, the system 300 comprises one or more sensor elements 308, 310, which are capable of detection by the sensor 317.

In some embodiments, the system 300 comprises alternative embodiment idle roller(s) 302 in place of one or more of rollers 28. The roller 302 comprise sensor recesses 304, 306, which may be located on opposite sides of a center 307 of the roller 302. The recesses 304, 306 comprise the sensor elements 308, 310. In some embodiments, the sensor elements are magnets. In some embodiments, the roller only comprises one recess 304 and one sensor element 308.

The sensor 317 is mounted adjacent to the roller 302 so that a field of detection of the sensor 317 is able to read or detect at least the sensor element that is closest to the sensor (element 310 as shown in FIG. 22). The sensor 317 may comprise a base 316 and a sensing nub 318. The sensor 317 may be mounted to a sensor support 312 that positions the sensor 317 adjacent the roller as shown in FIG. 22.

The controller 301 is in communication with the sensor 317, such as by wired or wireless connection. The controller 301 is in communication with the motor 124, by wired or wireless connection.

In some embodiments, the sensor 317 detects the number of times the sensor element(s) passes the detection field of the sensor. In some embodiments, the sensor 317 also detects the direction of rotation of the sensor element passing. In some embodiments, the controller is configured to count the number of passes of the sensor element(s) in or through the detection field of the sensor 317 to determine the amount of advancement of the absorbent substrate 68.

In some embodiments, the controller is configured to instruct an operation of the motor to rotate the collection roller a predefined duration depending on an amount of prior advancement of the absorbent substrate. The operation of the motor comprises the rotation of the motor output shaft 129. In some embodiments, the controller is configured to calculate or determine the distance/amount of prior advancement of the absorbent substrate 68 by counting the number of passes of the sensor element(s). The controller may know the advancement of the absorbent substrate that corresponds to a pass or given number of passes. For example, if the roller 62 has a circumference of 2 inches and it is desired to advance the absorbent substrate 68 by 4 inches when a user selects to advance the absorbent substrate, such as by pressing the switch 234, then after 2 rotations of the roller, the controller will instruct the motor to stop or will end or terminate operation of the motor which stops the advancement of the roller 60 and thereby roller 62. In that case, the sensor 317 has reported a predefined movement, such as a number of rotation counts or partial rotations via the field of detection of the sensor 317.

In some embodiments, the sensor can detect the location of the sensor element about its axis of rotation with the roller 302, so that the sensor can detect and the controller 301 can know partial rotational positions of the roller 302.

In some embodiments, sensors 317 are not used and the controller is configured to control and cause the motor 124 output shaft to rotate a predefined amount, which will cause the collection roller to rotate a predefined amount, which will draw absorbent substrate 68 from the supply roller a predefined amount exposing the clean absorbent substrate from the supply roller on the nose or a portion of the nose.

In some embodiments, the amount of prior advancement of the absorbent substrate may be determined by the controller counting the number of prior advancements of the substrate such as indicated by prior initiations of the operation of the motor to rotate the collection roller. For example, the controller can track each time the switch 234 is pressed to advance the absorbent substrate and keep a total of the number of times that the switch is pressed. In some embodiments, the total advancements is reset or restarted when a new supply roller is installed. In some embodiments, the total advancements is reset by the user's press of a button (not shown) at the time a new supply roller is installed in the mop. It may not be necessary to use a sensor, such as sensor 317, in order to control the amount of advancement by the controller. In some embodiments, the amount of prior advancement of the absorbent substrate may be determined by an amount of prior rotation of the collection roller as indicated by a duration of prior motor operation.

In some embodiments, the controller 301 is configured to instruct the operation of the motor to cause the motor to rotate a predefined amount of time which corresponds to a predefined advancement of clean absorbent substrate from the supply roller, pulled by the rotation of the collection roller and the absorbent substrate connection to the collection roller. In some embodiments, the controller is configured to cause the motor to advance for a longer amount of time, or number of rotation(s) or partial rotation(s), when the collection roller is empty and a shorter amount of time when the collection roller is almost full.

In some embodiments, the controller is configured to reduce the duration of the operation of the motor to rotate the collection roller depending on the amount of prior rotation of the collection roller. In some embodiments, the controller is configured such that the duration of operation of the motor is reduced compared to an immediately prior operation of the motor. In some embodiments, the controller is configured such that the duration of operation of the motor is reduced compared to each prior operation of the motor following an installation of the supply roller in the mop. As mentioned above the mop may comprise a reset button (not shown) or may comprise a sensor to detect the installation of a new supply roller. Therefore, as the supply roller and collection roller will usually be changed at the same time, the controller will know when a new supply roller has been installed.

In some embodiments, the controller 301 is configured to instruct an operation of the motor to rotate the collection roller to advance the absorbent substrate a predefined distance. The controller is configured to determine a current distance of advancement of the absorbent substrate while the motor is operating based on the rotation of the idle roller 302 as reported by the sensor 317. The controller is configured to terminate operation of the motor when the current distance of advancement equals the predefined distance. Therefore, in some embodiments, the real-time rotation of the roller 302 is reported to the controller by the sensor 317 and the controller operates the motor, and therefore the absorbent substrate advancement, in dependance on the real-time rotation of the roller as reported by the sensor 317. In some embodiments, the controller is configured to instruct an operation of the motor to rotate the collection roller to advance the absorbent substrate a predefined distance depending on an amount of prior advancement of the absorbent substrate.

In some embodiments, the controller 301 is configured to progressively or at predefined times or intervals, reduce a duration of operation of the motor each time the user presses the button 234 to account for the increase in the diameter of the collection roll due to the collecting thereon of dirty or used absorbent substrate. When the collection roller has more collected absorbent substrate around it, it will have a larger diameter. The predefined rotation of a larger diameter roll a pre-defined amount of time or duration will collect more absorbent substrate than the same predefined rotation of a smaller diameter roll. Therefore, when the collection roller is empty or close to empty more rotations or partial rotations of the collection roller will be required to advance the same amount of absorbent substrate from the supply roller as when the collection roller is closer to full of absorbent substrate wound around the collection roller.

In some embodiments, the controller is configured to instruct an operation of the motor to rotate the collection roller a predefined duration to advance the absorbent substrate. In some embodiments, the predefined duration is in the range of 1 to 3 seconds, inclusive. The predefined duration can be selected or set depending the output speed of the motor and the desired amount of advancement of the absorbent substrate, in the area between the supply roller to the collection roller. In some embodiments, at each press or activation of switch 234, the controller can be configured to advance the same predefined duration, rather than changing the duration or distance based on an amount of prior advancement of the absorbent substrate.

Figure 23A:
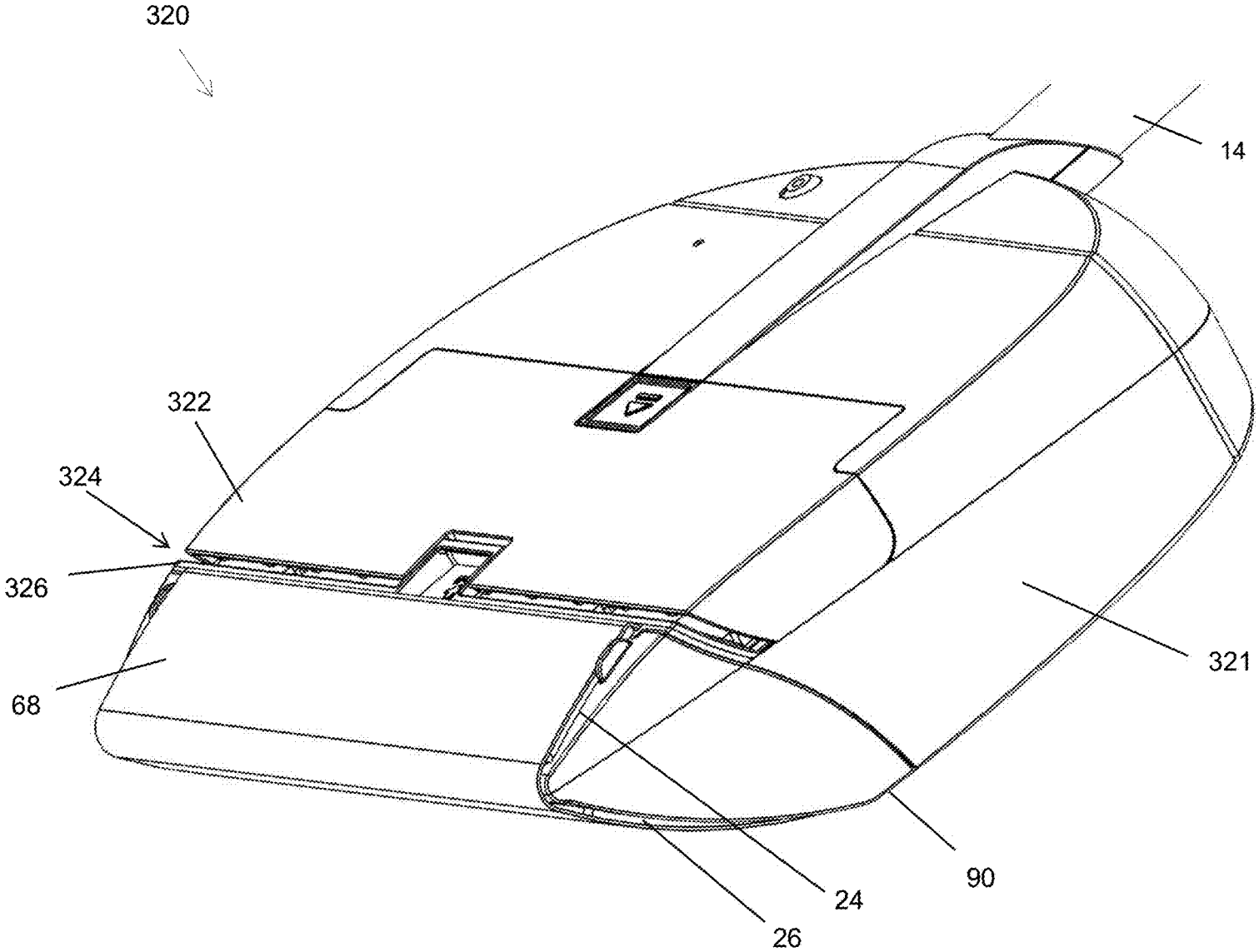
FIG. 23A is a perspective view of a second embodiment mop head usable with the mop of FIG. 1 in place of the mop head shown in FIG. 1.
Figure 23B:
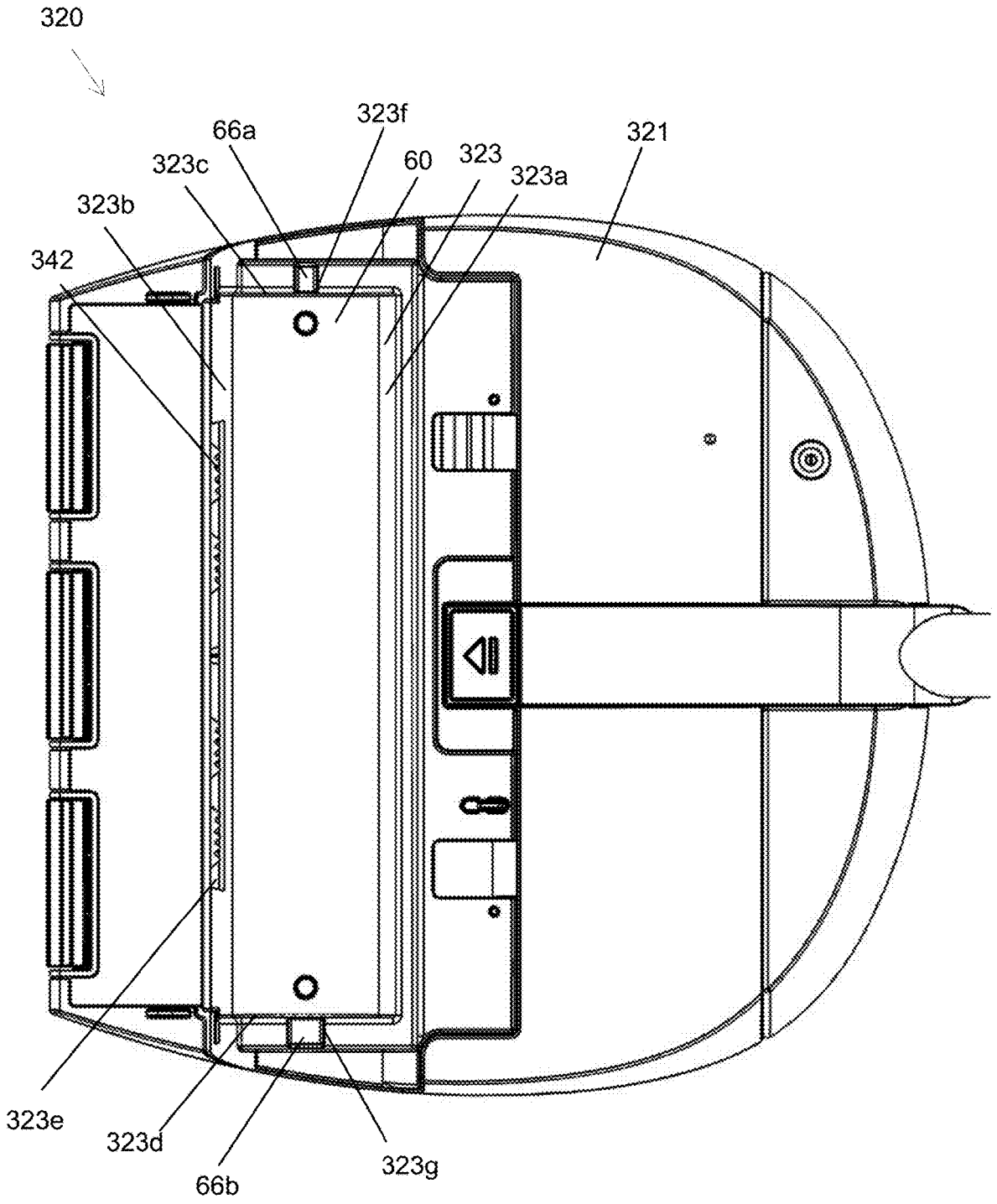
FIG. 23B is a top view of the mop head of FIG. 23A.
Figure 24:
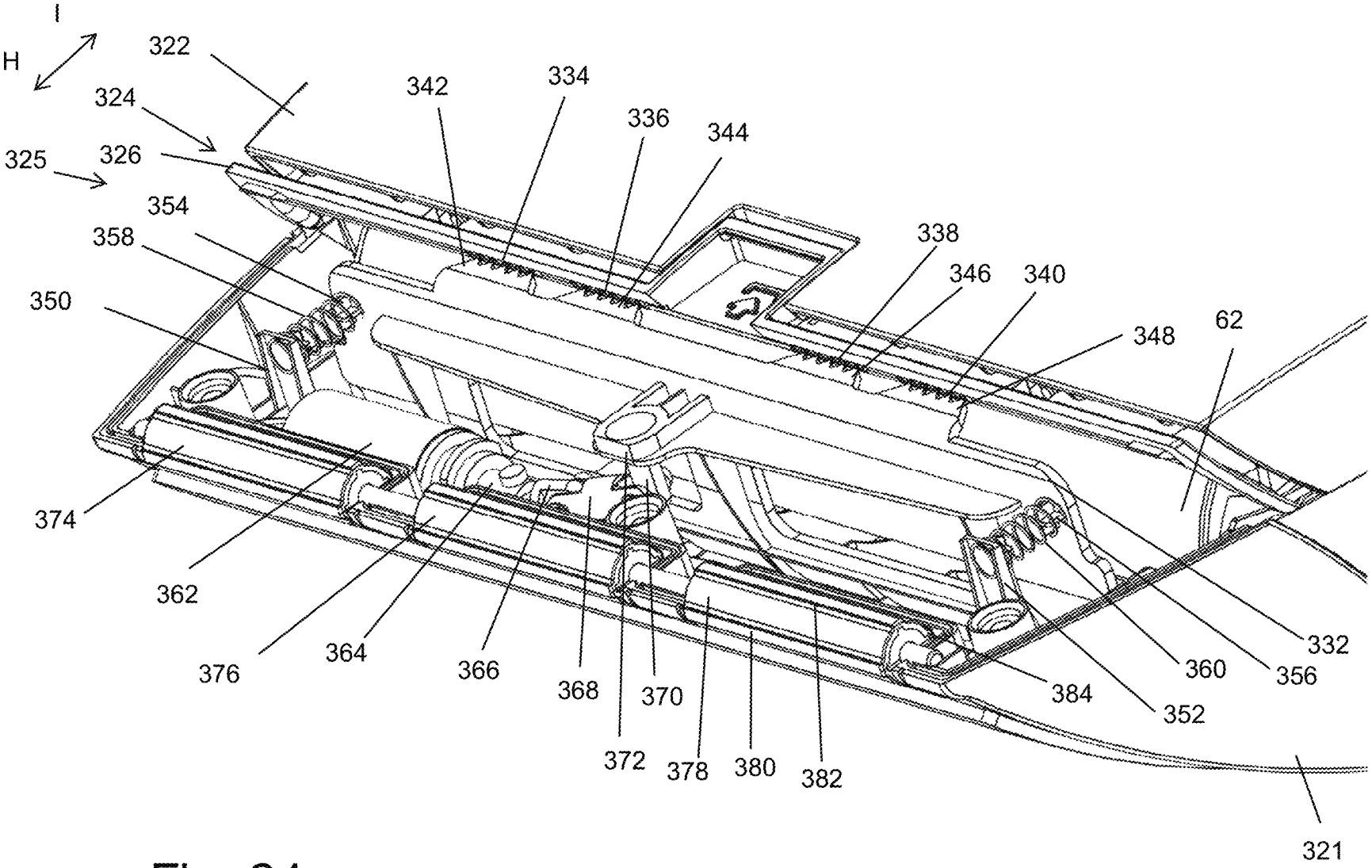
FIG. 24 is a perspective view of the mop head of FIG. 23A with certain parts not shown.

FIGS. 23A, 23B, and 24 show a second embodiment mop head 320 usable with mop 10 in place of head 12 or usable with mop 459 in place of head 460. The mop head 320 is the same as head 12, except as shown in the drawings and described herein.

The head 320 comprises a supply chamber 323. The supply chamber 323 comprises the supply roller 60. The supply chamber comprises a rear wall 323*a*, a front wall 323*b*, a first lateral end wall 323*c*, a second lateral end wall 323*d*, and a bottom wall (not shown).

Opposite the bottom wall of the supply chamber is an open top that is closeable by the cover 322. The front wall 323*b* comprises a teeth opening 323*e*, which may be rectangular. The lateral end walls 323*c*, 323*d* each comprise an axle housing 323*f*, 323*g*. The axle housings 323*f*, 323*g* are for receiving opposite ends 66*a*, 66*b* of the supply roller shaft 66. The supply chamber and/or supply roller, when comprising the absorbent substrate such as wound around the shaft, provides an absorbent substrate supply for the mop.

The head 320 comprises a stop mechanism 325 comprising a first stop member 332 and a second stop member 324. The first stop member 332 is in place of stop member 172 of head 12. The top door 322 comprises the second stop member 324. The second stop member 324 comprises a front wall 326. The front wall comprises a plurality of teeth receivers 334, 336, 338, 340 spaced apart along the front wall as shown in FIG. 24.

Figure 25:
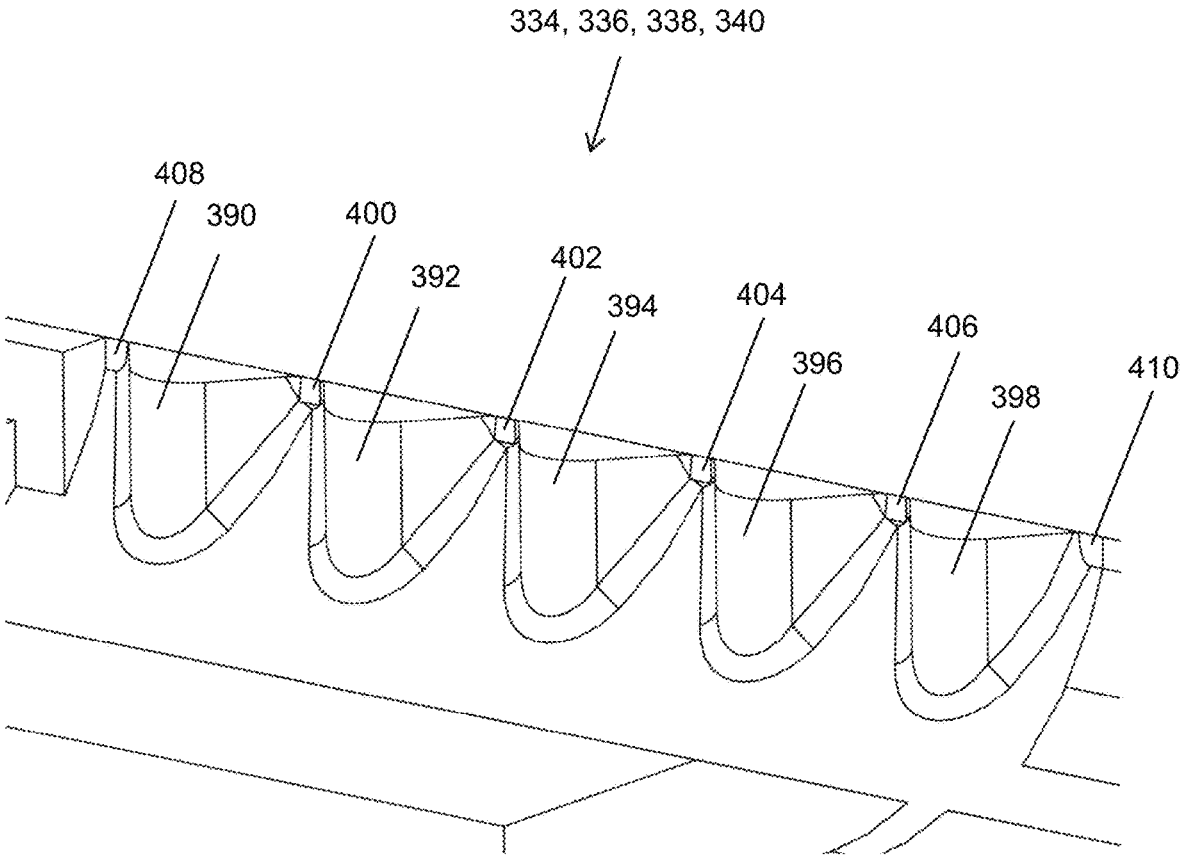
FIG. 25 is a perspective view of a portion of a second stop member of the mop head of FIG. 23A.
Figure 26:
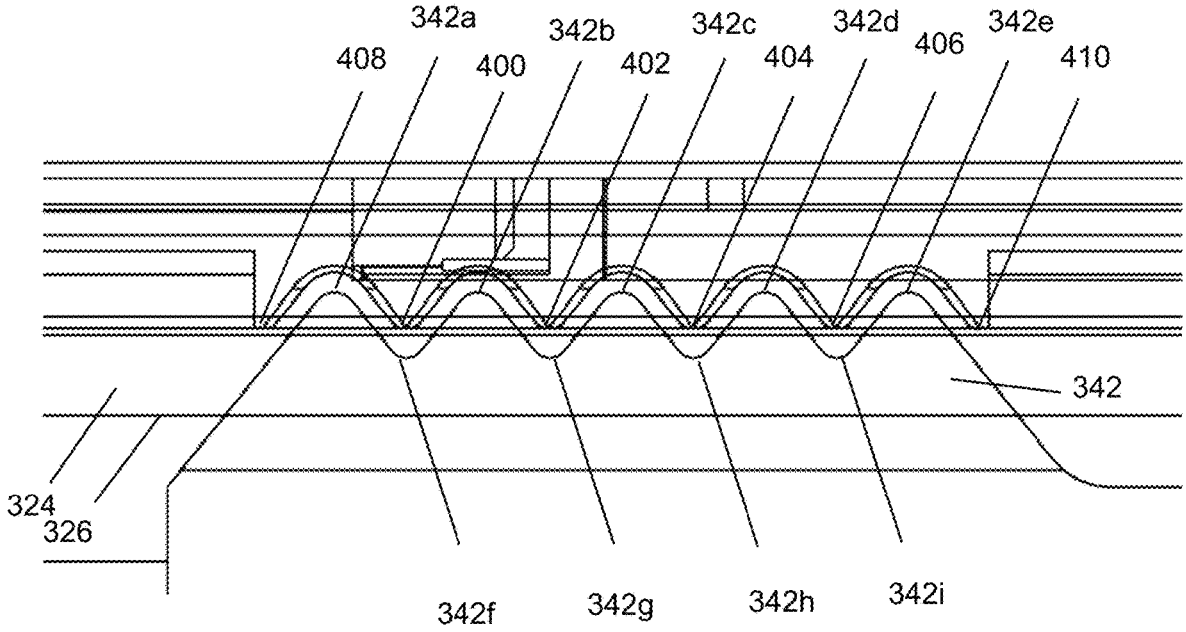
FIG. 26 is a top transparent view of a portion of the head of FIG. 23A showing a portion of the second stop member and a portion of a first stop member.

FIGS. 25 and 26 show the teeth receivers 334, 336, 338, 340 in additional detail. The receivers comprise a plurality of recesses 390, 392, 394, 396, 398. The recesses may be U-shaped as shown in FIG. 26, or other shaped. The recesses are separated by intervening walls 400, 402, 404, 406, which may act as teeth. The end walls 408 and 410 at opposite ends of the recesses may also act as teeth.

Stop member 332 comprises a plurality of grippers 342, 344, 346, 348. Each of the grippers are the same therefore only gripper 342 will be described in detail. FIG. 26 shows that gripper 342 comprises a plurality of gripper teeth 342*a*, 342*b*, 342*c*, 342*d*, 342*e*. The gripper comprises a plurality of recesses 342*f*, 342*g*, 342*h*, 342*i* interspaced between adjacent gripper teeth as shown in FIG. 26.

Each of the gripper teeth 342*a*, 342*b*, 342*c*, 342*d*, 342*e* align with and are received into the respective recesses 390, 392, 394, 396, 398 of the teeth receiver 334. Each of the walls or teeth 400, 402, 404, 406 of the teeth receivers are aligned with and received into the respective recesses 342*f*, 342*g*, 342*h*, 342*i* between the teeth of the gripper. The absorbent substrate 68 is therefore gripped between the teeth of the grippers and the teeth of the teeth receivers.

In some embodiments, the second stop member 324 does not have teeth receivers 334, 336, 338, 340 and instead is flat plane or provides a continuous surface for the grippers 342, 344, 346, 348 to grip the absorbent substrate against. In some embodiments, the second stop member is a second stop bar. In some embodiments, the first stop member 332 does not have grippers 342, 344, 346, 348 and instead comprises a flat plane or provides a continuous surface for engaging with and stopping movement of the absorbent substrate. In some embodiments, the first stop member is a first stop bar.

The stop member 332 is pivotally mounted to housing using pivot shafts (not shown) of head 12 in the same manner as stop member 172 is pivotally mounted to housing 21. Therefore, the stop member can pivot at the shafts toward (direction I of FIG. 24) and away (direction H) from the supply roller 62 and the second stop member 324.

The first stop member 332 comprises spring posts 354, 356 opposite the grippers at each end of the stop member as shown in FIG. 24. The housing of mop head 320 comprises spring stops 350, 352. Two springs 358, 360 are located between and contact the respective spring stops 350, 352 on one side and the stop member 332 at the spring posts 354, 356 on the other of the spring. The spring stops are fixed to the interior of the housing. The spring biases the first stop member 332 toward second stop member 324 and therefore the grippers toward the teeth recesses, and the absorbent substrate 68 therebetween.

An actuator 362 is operable to draw the first stop member 332 away from the second stop member 324 via linking shafts 366, 368, 370 joined to the stop member 332 at a center mount 372.

In some embodiments, the stop member operation system comprises the actuator 362 and the switch 234. The actuator comprises an output shaft 364 that is operably moves the stop member 332 from an engaged position with absorbent substrate 68 between the teeth and recesses to a released position away from the second stop member and the absorbent substrate 68 released. In some embodiments, the output shaft 364 is connected to linking shafts 366, 368, 370. The link shaft 379 is joined to the stop member 332 at a center mount 372. In some embodiments, the linking shafts 366, 368, 370 connect at pivot joints. The pivot joints allow one or more of the linking shafts to angle from the output shaft to the stop member 332 and to translate and transmit movement of the output shaft to movement of the first stop member.

In some embodiments that movement of the first stop member 332 and the actuator 362 is controlled by the controller 301 in the same manner as described for stop member 172 and actuator 222. The actuator 362 is powered by the power source 166. The actuator may also be connected or controlled by the controller 301. The actuation of the switch 234 signals to the controller to actuate or cause the actuation of the actuator. In some embodiments, the power source is connected to the switch and the actuator to create a circuit. The actuator may be connected to the power source and/or the switch by one or more wires.

When a user actuates the switch 234, the controller 301 instructs or causes the powering of the actuator to move the output shaft 224 of the actuator to retract to the released position, which retracts the linking shaft, which retracts the stop member 332 away from the second stop member 324 in the direction H of FIG. 24. The teeth disengage from contact with and grip of the outer layer of absorbent substrate 68 spooled on the supply roller. Then the controller 301 instructs or causes the powering of the drive motor 124, which causes the output shaft of the drive motor to cause the gear 113 to rotate counterclockwise, which causes the collection roller 60 to draw absorbent substrate 68 on it. This draws the absorbent substrate 68 from the supply 66 roller toward the collection roller 60 thereby advancing clean absorbent substrate from the supply roller to be exposed at least along the top converging portion 24 or a portion thereof. Optionally, controller 301 can be configured to cause the motor to operate to advance the clean absorbent substrate such that clean absorbent substrate extends along all or a portion of the bottom converging portion 26. And further optionally, controller 301 can be configured to cause the motor to operate to advance the clean absorbent substrate such that clean absorbent substrate from the supply roller extends along all or a portion of the intermediate portion 90. Therefore, the controller 301 can be configured to draw a pre-defined amount of clean absorbent substrate from the supply roller on to all or a portion of the path of absorbent substrate extending about the nose of the head.

When the advancing/drawing of the absorbent substrate is complete, the controller 301 will instruct or otherwise cause the actuator 362 to release or will move the output shaft of the actuator toward the extended position. The springs 358, 360 drive or assist in moving the stop member to an engaged position so that the grippers engage, contact, and grip the absorbent substrate 68 on the supply roller 62 and stop absorbent substrate from further advancing from the supply roller 62. The teeth of the grippers 342, 344, 346, 348 will be received in the recesses of the respective teeth receivers 334, 336, 338, 340. The teeth of the gripper and the teeth of the teeth receivers will grip opposite sides of the absorbent substrate 68. In some embodiments, the teeth of the grippers will be biased, by the springs and/or actuator, to press the absorbent substrate 68 against the deepest part of the recesses of the teeth receiver and to hold the absorbent substrate thereto.

As explained above regarding head 12, the collection roller is stopped from rotation in at least one direction when not rotated by the motor 124. In some embodiments, the collection roller is stopped from rotating in either directions about the collection roller shaft. Stopping the collection roller from rotation in an unspooling direction opposite the rotational direction that collects more absorbent substrate around the collection roller prevents reverse runout or unspooling of the absorbent substrate from the collection roller. The absorbent substrate that extends about the nose is stopped from spooling out from the supply roller by being gripped between the first and second stop members 332 and it is stopped from unspooling from the collection roller by the motor stopping the rotation of the collection roller. In some embodiments, the motor stops the rotation of the collection roller in one or both directions when the motor is not operating to rotate the motor output shaft and the collection roller, either by a brake within or connected to the motor or due to the friction the motor causes against the motor output shaft when the motor is not operating to rotate the output shaft and the collection roller.

In some embodiments, the second stop member 324 is biased toward the first stop member. The second stop member is mounted to the door 322. The door 322 is pivotal about hinges 424, 426 between an open position providing access to roller 62 within the housing 321 and a closed position shown in FIG. 23A. The door in the open position is at between 45 to 90 degrees, inclusive, to its closed position orientation. The ends 425, 427 of the hinges 424, 426 are pivotally mounted in mounts (not shown) of the housing 321 of the mop to allow the door to move between the open and closed positions.

Figure 27:
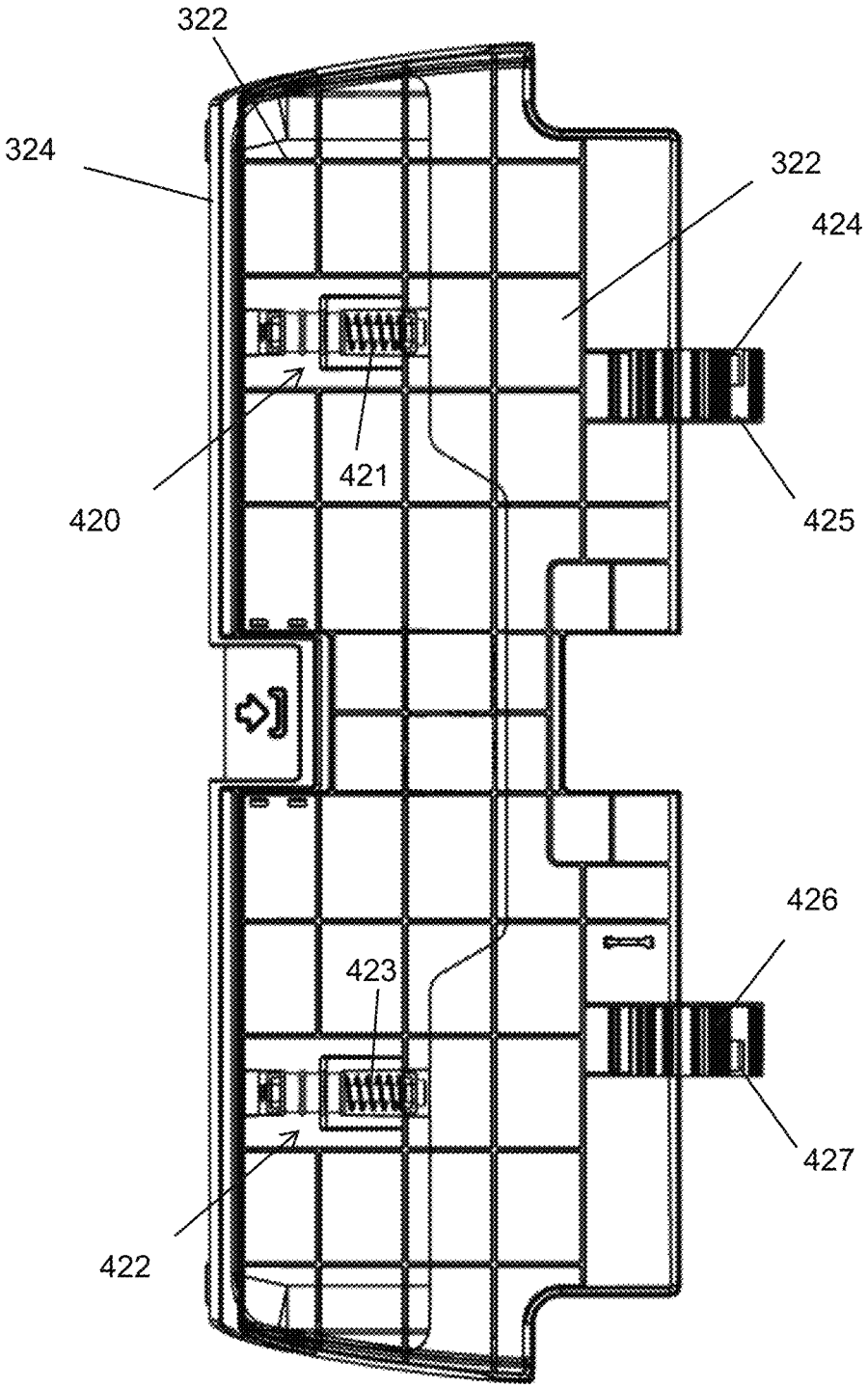
FIG. 27 is a top view of a top door and the second stop member of the mop head of FIG. 23A where the top door is shown transparently.
Figure 28:
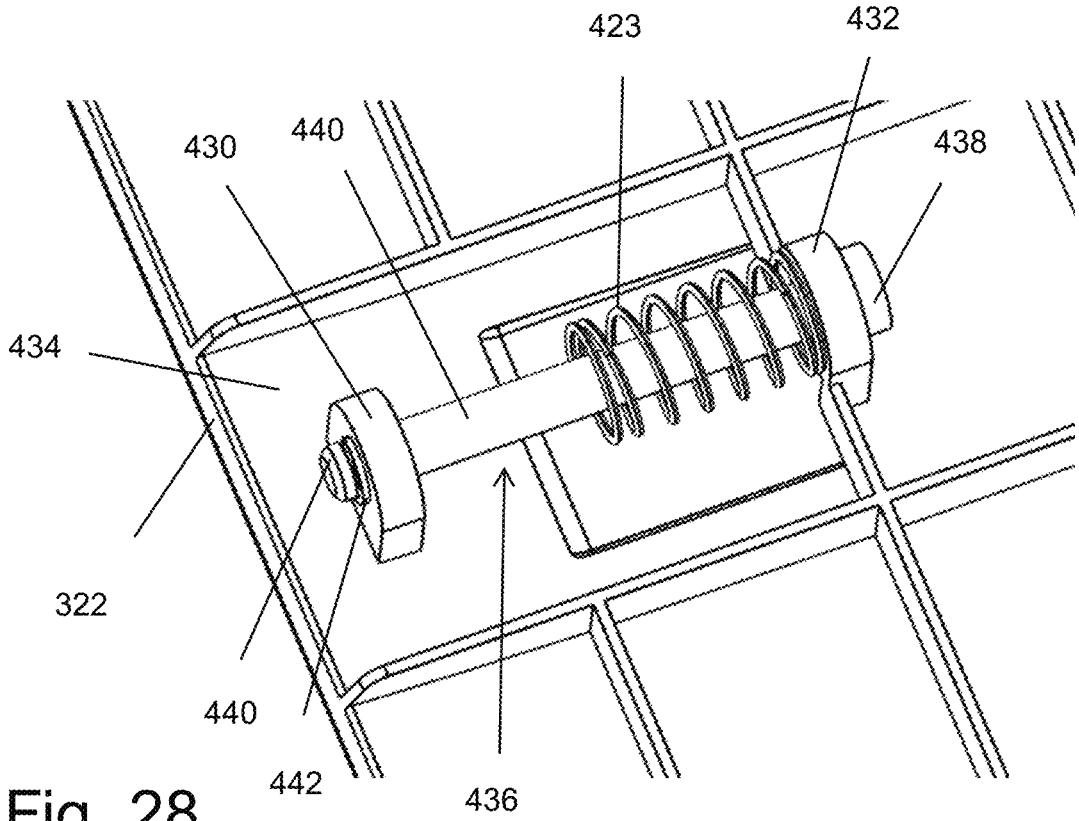
FIG. 28 a is bottom perspective view of a portion of the top door of FIG. 27.
Figure 29:
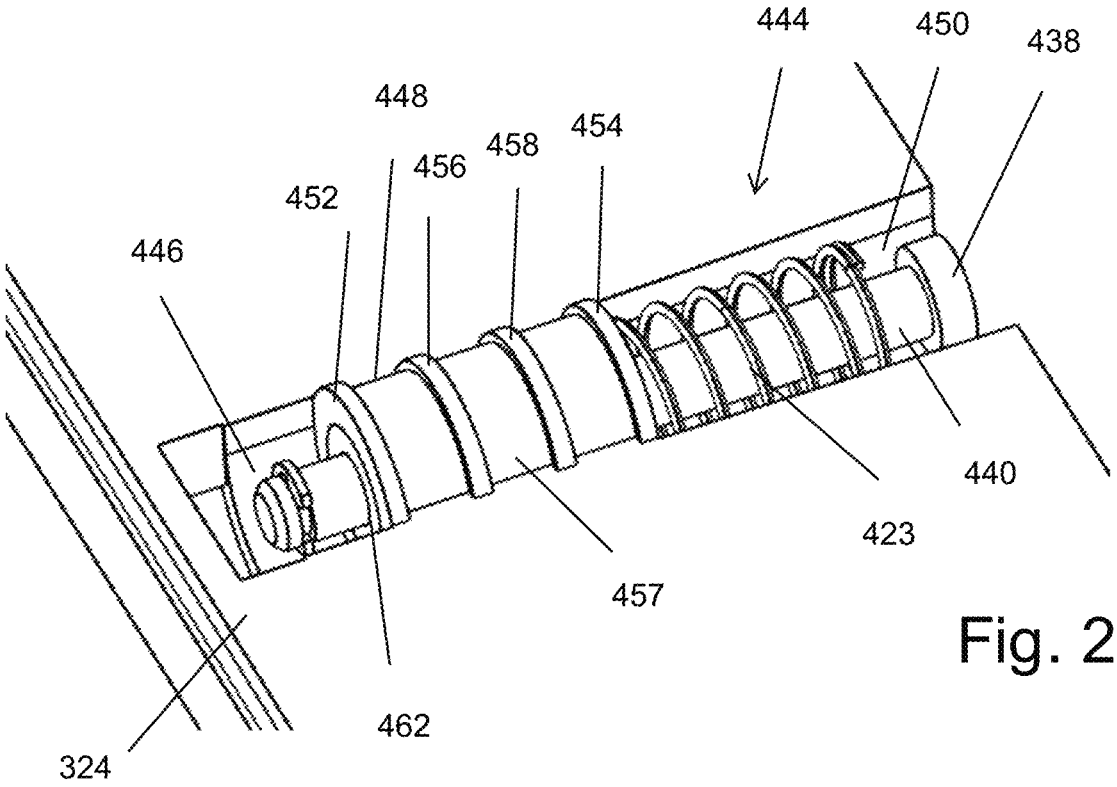
FIG. 29 a is top perspective view of a portion of the second stop member of FIG. 27.

FIG. 27 shows a top view of the door and the second stop member 324 where the door is shown transparently. The door and the second stop member comprise spring mechanisms 420, 422 each comprising springs 421, 423, respectively, to bias the second stop member 324 toward the first stop member in the direction H of FIG. 24. The spring mechanisms 420, 422 are the same so only spring mechanism 422 will be described in detail.

The spring mechanism 422 comprises end blocks 430, 432. The door comprises the end blocks 430, 432, which are fixed or formed to or with the underside 434 door 322. The end blocks are spaced apart and comprise a pin aperture for receiving guide pin 436. The guide pin 436 comprises a head 438 and a shaft 440 extending from the head 438. The head is larger than the shaft and larger than the pin aperture of end block 432. Therefore, the head cannot move past the end block 432. At a terminal end of the shaft opposite the head is an annular recess sized to receive a retaining clip 442. The retaining clip comprises a diameter or width that is wider than the diameter or width of the pin aperture of end block 430. When the retaining clip is within the annular recess, the pin, at the clip, cannot move past the end block 430 toward block 432.

The spring mechanism 422 comprises a lower housing 444. The second stop member comprises the lower housing 444. The housing comprises a forward recess portion 446, a second recess portion 448, and a rear recess portion 450. The second recess portion comprises a front retaining ring 452, a rear retaining ring 454, and two retaining arches 456, 458. A retained block 457 is located between the front and rear retaining rings 452, 454 and under the two retaining arches 456, 458 within the second recess portion 448.

The spring 420 is within the rear recess portion 450. The terminal end of the pin extends into the forward recess 446. The shaft of the pin extends through each of the spring 423, the retained block 457, the front retaining ring 452, and the rear retaining ring 454. The end block 430 is located in the forward recess portion 446. The end block 432 is in the rear recess portion 450.

Figure 30A:
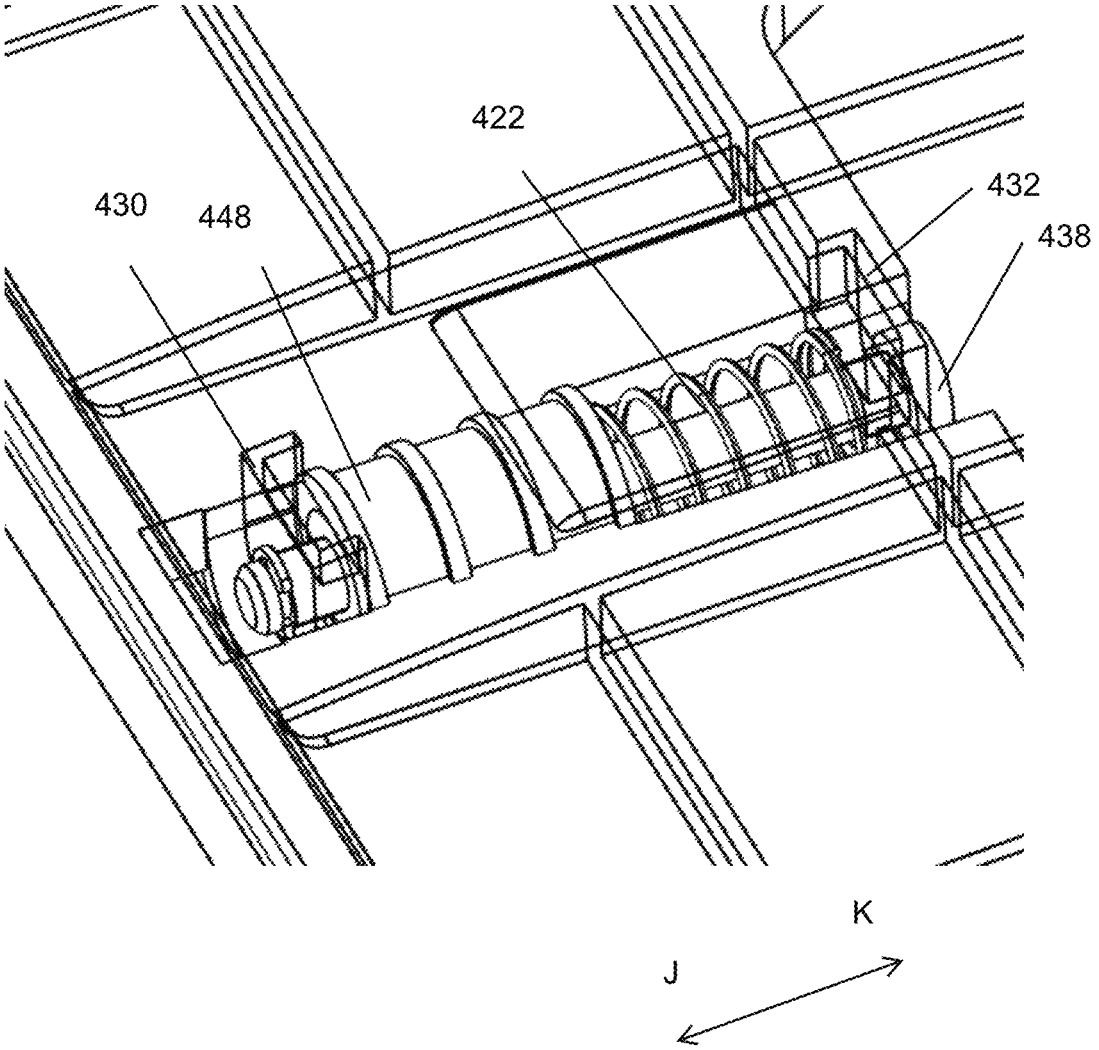
FIG. 30A is a top perspective view of the top door and the second stop member of the mop head of FIG. 27 where the top door is shown transparently.

The second stop member is biased forward in the direction J of FIG. 30A and toward the first stop member. The spring is blocked at the rear by end block 432. Movement of the second stop member back in the direction K and away from the first stop member causes the retained block 457 and the rear retaining ring 454 to move in the direction K. This movement of the retained block 457 and the rear retaining ring 454 compresses the spring 422 between the retained block 457 and the end block 432. The compressed spring biases the second stop member forward in the direction J to reduce spring compression and therefore spring potential.

The forward bias of the second stop member, and the rear bias of the first stop member, causes the absorbent substrate 68 located therebetween to be gripped on both sides by the respective first and second stop members to prevent movement of the absorbent substrate 68. When a user actuates the switch 234 to retract the first stop member, the first stop member is retracted beyond the point where the second stop member reaches the end of the second stop member's range of motion in the forward direction (direction J). The end of the forward range of motion occurs when the front retaining ring 452 contacts the end block 430. Therefore, the end block 430 defines the end of the forward range of motion of the second stop member. When the second stop member reaches the end of its forward range of motion, the first stop member can continue to retract to release the grip on the absorbent substrate 68 and allow the absorbent substrate 68 to move relative to the first and second stop members, such as to advance new absorbent substrate from roller 62.

FIG. 24 shows that rollers 374, 376, 378 may comprise ribs 380, 382, 384 (not labeled for rollers 374, 376 and not shown for the bottom rib of roller 378). The ribs engage with the absorbent substrate 68 as it passes around the nose to assist in advancement of the absorbent substrate 68 around the nose. In some embodiments, each roller comprises four ribs, each rib is spaced ninety degrees about the roller. Any number of ribs can be used, such as 1, 2, 3, 4, or more per roller.

Figure 30B:
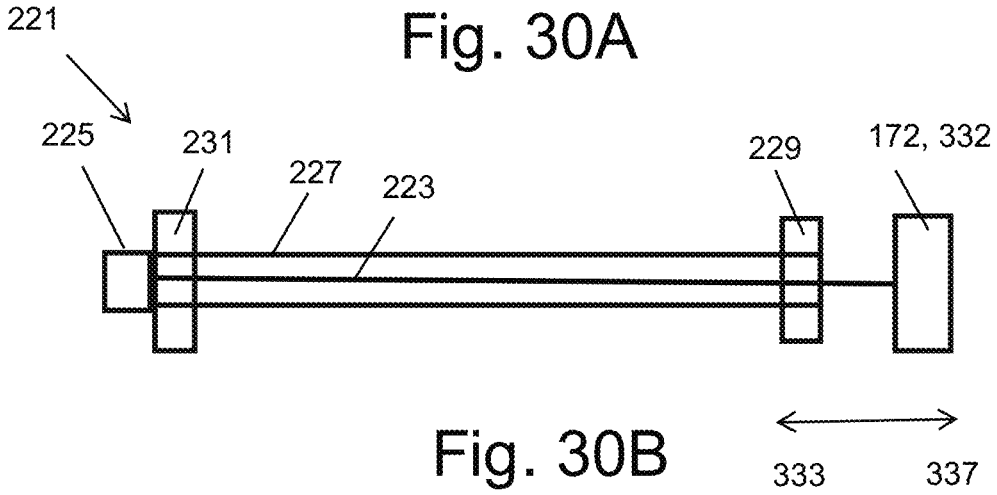
FIG. 30B is side block diagram view of a second embodiment stop member operation system.

In some embodiments, the mop comprises a second embodiment stop member operation system 221 comprising a cable 223 and a lever 225, as shown in FIG. 30B, instead of an actuator 222 and the switch 234. In some embodiments, the cable extends through a conduit 227. The conduit is mounted at a first mount 229 adjacent the stop member 172, 332 (shown block-diagrammatically in FIG. 30B) within the housing 21, 321 at a terminal end of the conduit. The conduit is mounted at a second mount 231 at or adjacent the handle 16. The conduit and cable can extend through the shaft 14 to the handle 16. The first and second mounts 229, 231 hold the conduit stationary. To release the stop member 172, 332 from the absorbent substrate, the user pulls the lever 225 back in the direction 333. The lever 225 is connected to the cable 223, which is connected to the stop member 172, 332, Therefore, moving the lever 225 in the direction 333 moves the stop members 172, 332 away from the absorbent substrate in the direction H of FIG. 24 or direction C of FIG. 13. This disengages the stop member from the absorbent substrate and allows the absorbent substrate to be advanced from the supply roller toward the collection roller. When the lever 225 is released the spring bias of the springs 216, 358, 360 will drive the stop member toward and to engage with the absorbent substrate in the direction I of FIG. 24 or B of FIG. 13. The springs will also drive the lever and the cable in the direction 337 of FIG. 30B via and following the stop member 172, 332.

Figure 31:
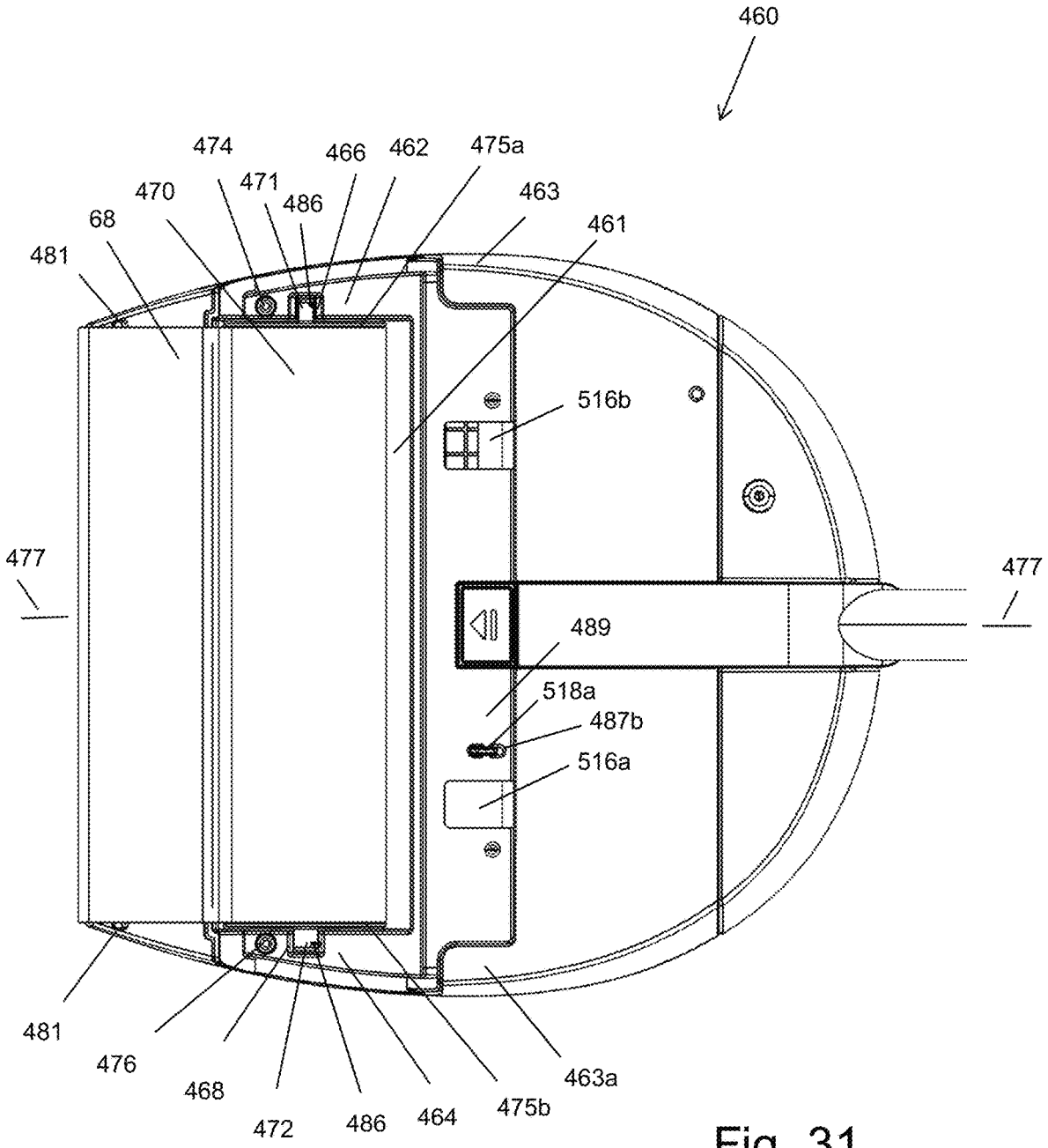
FIG. 31 is a top view of a third embodiment mop head usable with the mop of FIG. 50 or with the mop of FIG. 1 in place of the mop head shown in FIG. 1, with certain parts not shown including the top door.
Figure 50:
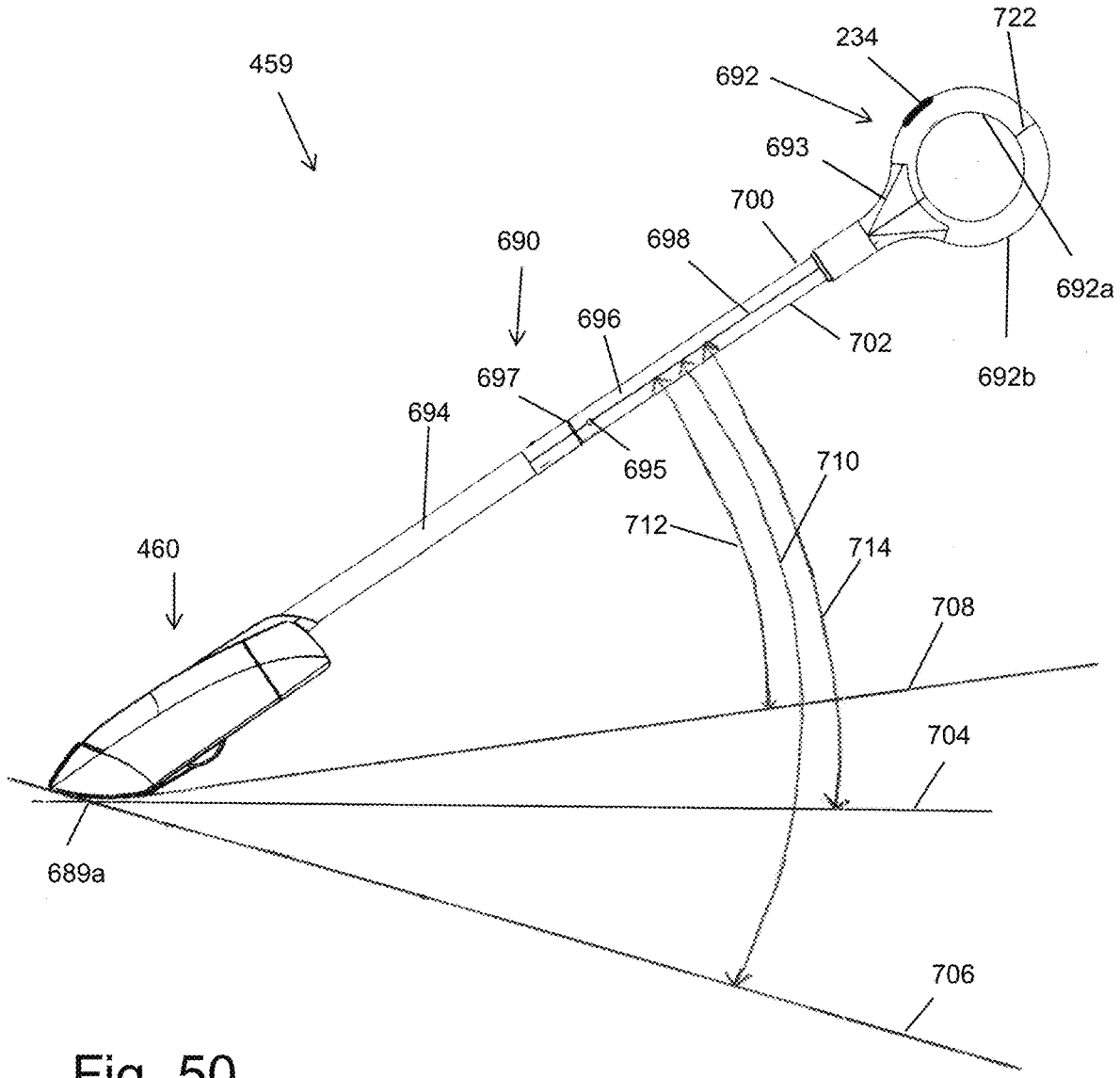
FIG. 50 is a side view of a second embodiment mop comprising the mop head of FIG. 31 in a first orientation of use.

FIG. 31 shows a third embodiment mop head 460 useable with mop 10 in place of head 12 and with the second embodiment mop 459 (FIG. 50). The mop head 460 is the same as head 12, except as shown in the drawings and described herein.

The supply roller 470 is the same as roller 62, except that roller 470 comprises end disks 475*a*, 475*b*. The absorbent substrate 68 is located between the end disks. The head comprises a supply chamber 461 and the supply chamber 461 comprises the supply roller. The supply chamber 461 is enclosed by the cover 515. The roller 470 comprises a supply roller shaft 503 extending between the end disks 475*a*, 475*b* and comprising opposite ends 471, 472. The ends of the supply roller shaft are receivable in axel housing 466, 468 formed in portions 462, 464 of the housing 463 of the head 460 at opposite lateral ends of the supply chamber 461.

The head comprises a supply roller braking mechanism. In some embodiments, the supply roller braking mechanism comprises one or more friction springs 486 and the axles housings 446, 468. The axle housings 466, 468 are mirror image identical about a mid-plane 477 of the head 460. Therefore, only axle housing 466 will be described in detail.

In some embodiments, the axle housing 466 comprises a U-shaped perimeter, as shown in FIGS. 32 and 34. The axle housing comprises a channel 467 and an operating location 473. The channel is open to the operating location 473. The channel 467 provides a drop-in path 465 from the open top toward the operation location 473 at the bottom. The rear side wall 480 and a portion of the bottom wall 482 of each axle housing comprises a spring aperture 484, which in some embodiments is an elongated aperture as shown in FIG. 34A. A friction spring 486 extends through the spring aperture 484.

Figure 33:
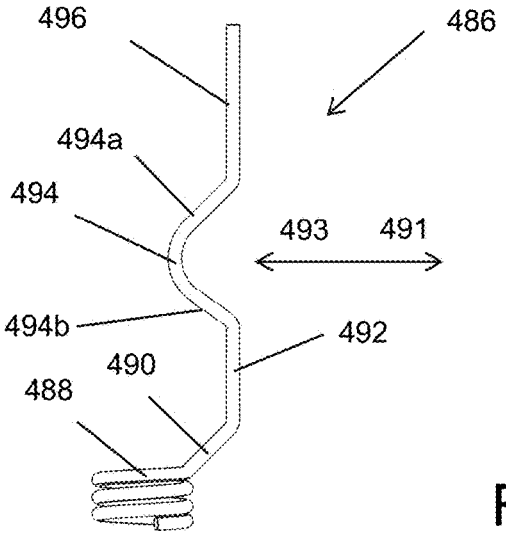
FIG. 33 is a side view of a friction spring of the mop head of FIG. 31.
Figure 34A:
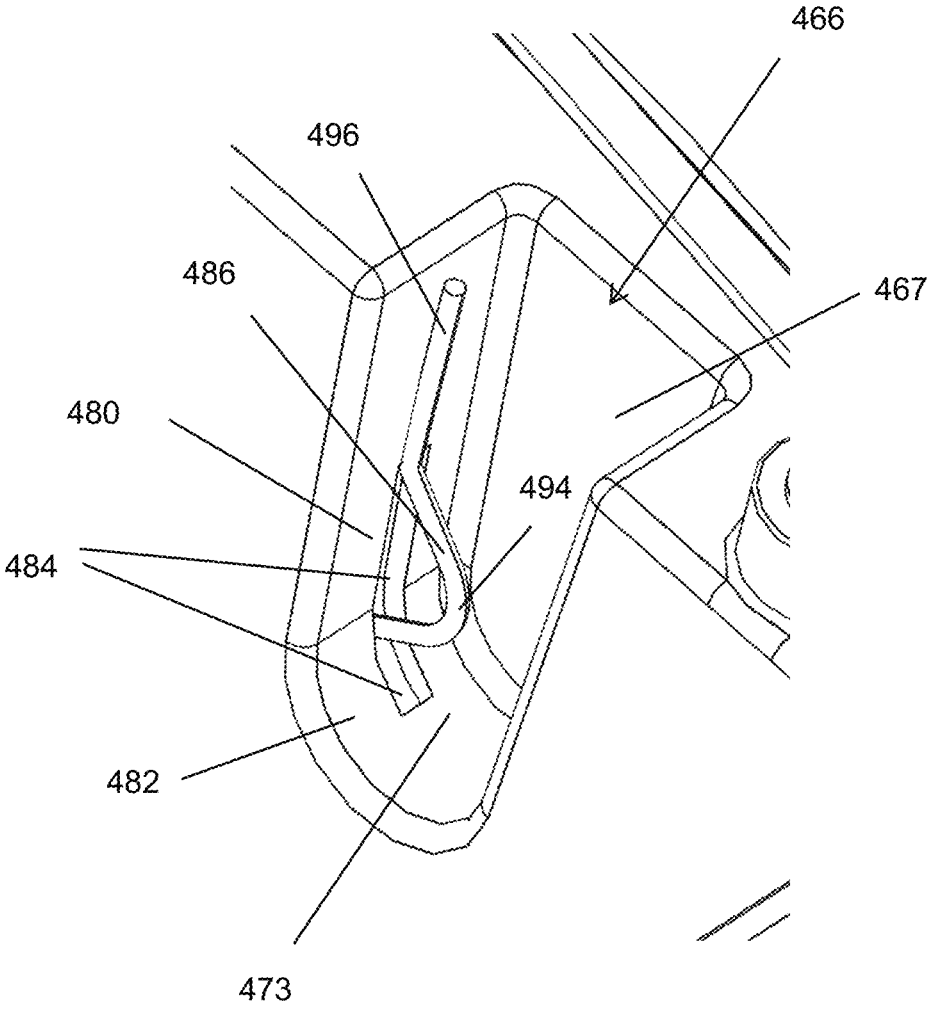
FIG. 34A is a top perspective view of a portion of the mop head of FIG. 31.

As shown in FIG. 33, in some embodiments, the friction spring 486 comprises a spiral portion 488, an angled portion 490, a first vertical portion 492, a shoulder 494, and a second vertical portion 496. The spiral portion 488 comprises an open middle. The spiral portion is mounted around a mounting post 498 extending below the axle housing 466 of the housing of the head 460 as shown in FIG. 32. The post 498 is located in the open middle of the spiral portion 488. The angled portion 490 locates the first vertical portion adjacent the rear side wall 480 of the axle housing. The shoulder 494 extends from the first vertical portion and extends through the spring aperture 484 and into the axle housing 466, as shown in FIG. 34A. The second vertical portion 496 extends from the shoulder 494 and in the axle housing.

The shoulder 494 bears on the supply roller shaft end 472 and causes it to be pressed against the axel housing wall(s) including the bottom wall 482. This spring bias against the end 472 creates friction against the supply roller shaft and against rotation and therefore against the rotation of the roller 470. The friction caused by the spring 486 prevents the absorbent substrate from advancing from the roller 470 by operation of the mop on exterior surfaces. For example, such operation may include a user moving the mop, and therefore the absorbent substrate 68 at one of the operating surfaces 672*b*, 674*b* on the exterior surface, such as a floor. Such operation may include a standard mopping operation, including a forward and/or backward movement operation of the mop head, and therefore the absorbent substrate 68 at one of the operating surfaces 672*b*, 674*b*, on and over an exterior surface, such as the floor, to clean the exterior surface. The motor 124 will overcome friction of the spring to advance the absorbent substrate 68 from the roller when activated by the user, causing the collection roller to rotate and draw the absorbent substrate 68 from the supply roller.

To insert the supply roller into the axle housing 466, 468 and into the operating location 473 (not shown for housing 466), the ends 471, 472 of the supply roller shaft are aligned with the channels 467 and move down therein. When the ends 471, 472 meet the shoulder 494 of the springs, a user provides downward pressure in the direction 495 of FIG. 32 on the roller. The downward pressure on the shoulder, such as on a top side 494*a* of the shoulder, causes the shoulder 494 of the spring to move rearward in the direction 491 (of FIG. 33) and to at least partially flatten. When the shoulder is sufficiently flattened to allow the ends 471, 472 to pass the shoulder, the ends 471, 472 will pass, at least partially, the shoulder and fall into the operating location 473. The shoulder will re-arch moving forward in the direction 493 from its flattened condition to an increased arched position. In some embodiments, the shoulder need not fully flatten for corresponding end 471, 472 to pass the shoulder and move into the operating location. The shoulder of the spring will continue to bear against the ends 471, 472 when in the respective operating location 473 (not shown for housing 466).

To withdrawal the supply roller from the axle housing, the user pulls the supply roller up in the direction 497 of FIG. 32. The upward pressure on the shoulder 494, such as on the bottom side 494*b* of the shoulder, causes the shoulder 494 of the spring to move rearward in the direction 491 of FIG. 33 and to at least partially flatten. When the shoulder is sufficiently flattened to allow the ends 471, 472 to pass the shoulder, the ends 471, 472 will pass the shoulder and be freed of constraint by the spring. The shoulder will re-arch moving forward in the direction 493 from its flattened condition to an increased arched position. In some embodiments, the shoulder need not fully flatten for corresponding ends 471, 472 to pass the shoulder and move out of the axle housing.

In some embodiments, each of the axle housings 466, 468 comprise a friction spring 486, so that two friction springs 486 are used, one in each axle housing 466, 468 against respective ends 471, 472. In some embodiments, only one of the axle housing 466, 468 comprises a friction spring 486.

In some embodiments, the combined friction of the spring (s) against the one or both ends 472, 471 and the friction of the absorbent substrate against the pad(s) can be calibrated to be sufficient to prevent the absorbent substrate from advancing from the roller 470 by operation of the mop on exterior surfaces. In some embodiments, less friction between the pad and the absorbent substrate requires greater friction provided by the spring(s) against one or both ends 472, 471 to prevent the absorbent substrate from advancing from the roller 470 by operation of the mop on exterior surfaces. For example, such operation may include a user moving the mop, and therefore the absorbent substrate 68 at one of the operating surfaces 672*b*, 674*b* on an exterior surface, such as a floor. Such operation may include a standard mopping operation, including a forward and/or backward movement of the mop head, and therefore the absorbent substrate 68 at one of the operating surfaces 672*b*, 674*b*, on and over an exterior surface, such as the floor, to clean the exterior surface. Greater friction between the pad and the absorbent substrate requires less friction provided by the spring(s) against one or both ends 472, 471 to prevent the absorbent substrate from advancing from the roller 470 by operation of the mop on exterior surfaces. Therefore, the material of the pad(s) can be selected to provide the desired friction against the absorbent substrate. In some embodiments, the friction between the spring(s) and one or both ends 472, 471 provides 50 to 80 percent or more of the friction necessary to prevent the absorbent substrate from advancing from the roller 470 by operation of the mop on exterior surfaces. In some embodiments, the friction between the spring(s) and one or both ends 472, 471 provides substantially all of the friction necessary to prevent the absorbent substrate from advancing from the roller 470 by operation of the mop on exterior surfaces.

In some embodiments, the head 460 does not have stop members 172, 324, 332 or grippers for engaging the absorbent substrate, instead the friction spring prevents undesired advancement of absorbent substrate 68 from the supply roll. Therefore, the friction spring(s) can be used in place of gripper(s). In some embodiments, the friction spring(s) eliminate the need for the stop members 172, 324, 332, the actuator 222, 362 and the front roller(s) 28, 374, 376, 378.

In some embodiment, the axle braking mechanism comprises a friction fit between the shaft 503 and the axle housings 466, 468. Therefore, the shaft at the axle housing may be sized to friction fit within the axle housing to provide sufficient rotational friction to the shaft to prevent undesired advancement of absorbent substrate 68 from the supply roll 470 when the collection roller is not advanced, such as by the motor. The friction fit may be provided with or without the use of friction springs.

In some embodiments, the axle braking mechanism comprises one or more friction sleeve(s) (not shown), which can be used with or without friction springs. The friction sleeve (s) are fitted to one or both of the ends 471, 472 of the shaft 503. The friction sleeve engages the axle housings 466, 468 to provide sufficient rotational friction with the sleeve or the shaft of the roller 470 prevent undesired advancement of absorbent substrate 68 from the supply roller. In some embodiments, the friction sleeves are cylindrical and sized to fit to the cylindrical ends 471, 472 of the supply roller shaft 503.

In some embodiments, the pad or the operating surface comprises a surface roughness configured to prevent advancement of the absorbent substrate from the absorbent substrate supply when the operating surface or pad is engaged against the absorbent substrate during at least forward and/or backward movement of the head on an external surface to be cleaned. In some embodiments, the surface roughness of the pad(s) for engagement against the absorbent substrate can be calibrated to provide friction sufficient to prevent the absorbent substrate from advancing from the roller 470 or supply chamber 323 by operation of the mop on exterior surfaces, without the use of a friction sleeve(s) or a friction spring(s) at the shaft 503 or a stop member(s). Therefore, the material of the pad(s) can be selected to provide the desired friction against the absorbent substrate. When pads are not used, the operating surface(s) facing the absorbent substrate can be configured to comprise a surface roughness to provide the desired friction against the absorbent substrate. In some embodiments, the pad surface or operating surface facing the absorbent substrate comprises an arithmetic average roughness (Ra) of equal to or greater than about 1.3 micrometers or about 1.32 micrometers. In some embodiments, the pad surface or operating surface facing the absorbent substrate comprises a surface roughness of about 120 grit or 100 grit (on the ANSI (American National Standards Institute) or CAMI (Coated Abrasive Manufacturers Institute, now part of the Unified Abrasives Manufacturers' Association) scale) or more coarse.

In some embodiments, the static coefficient of friction between the pad(s) (or operating surface facing the absorbent substrate) and the absorbent substrate is greater than the static coefficient of friction between the absorbent substrate and the exterior surface that the mop is to be operated on. In some embodiments and applications, the exterior surface to be operated on comprises ceramic tile, finished hardwood flooring, linoleum flooring, laminate flooring and/or concrete. In some embodiments and applications, the static coefficient of friction between the pad(s) (or operating surface facing the absorbent substrate) and the absorbent substrate is equal to or greater than about 0.5.

A top door 515, shown in FIGS. 34B-34D and 49, is similar to the top door 322 except the door 515 lacks the second stop member 324 and spring mechanisms 420, 422. The door 515 comprises a top 515*a*, opposite sides 515*b*, 515*c*, and hinge arms 515*d*, 515*e* attached at a back 515*f* of the top 515*a*. The hinge arms 515*d*, 515*e* comprise a hook shape and mounting apertures 515*g*, 515*h* at terminal ends of the respective arms.

Figure 34B:
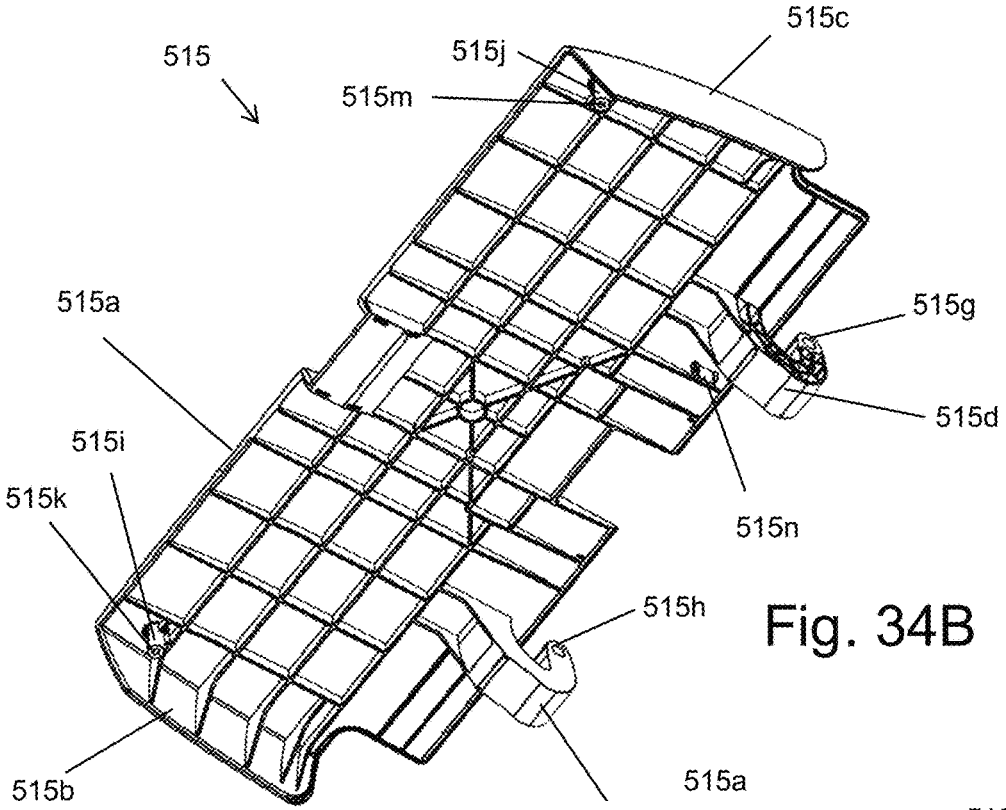
FIG. 34B is a bottom perspective view of a top door of the mop head of FIG. 31.
Figure 34C:
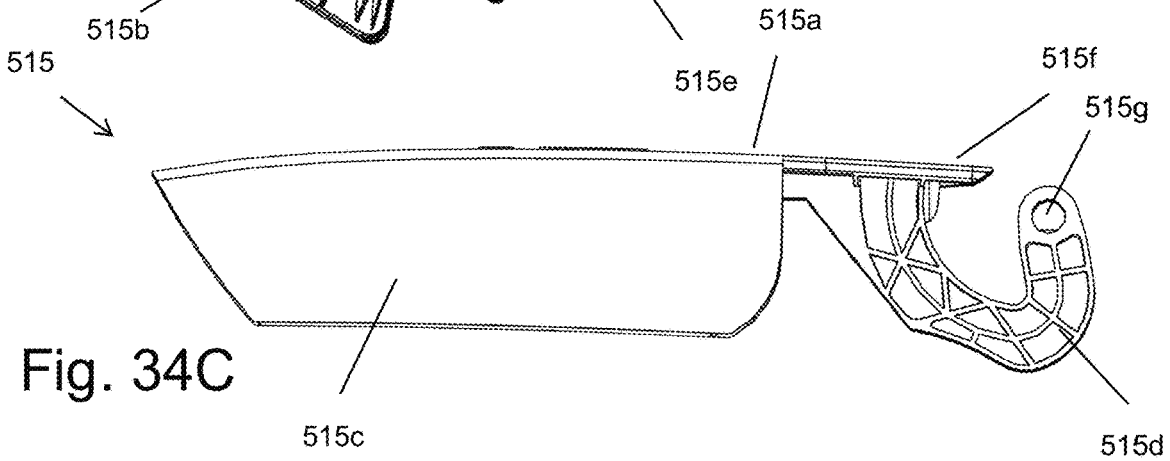
FIG. 34C is a side view of the top door of FIG. 34B.
Figure 34D:
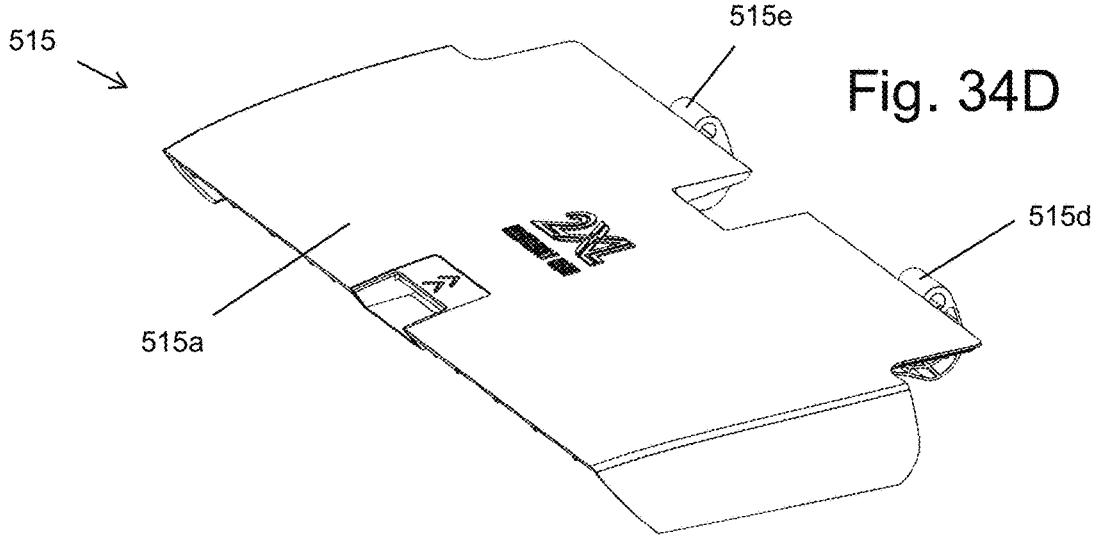
FIG. 34D is a top perspective view of the top door of FIG. 34B.
Figure 34E:
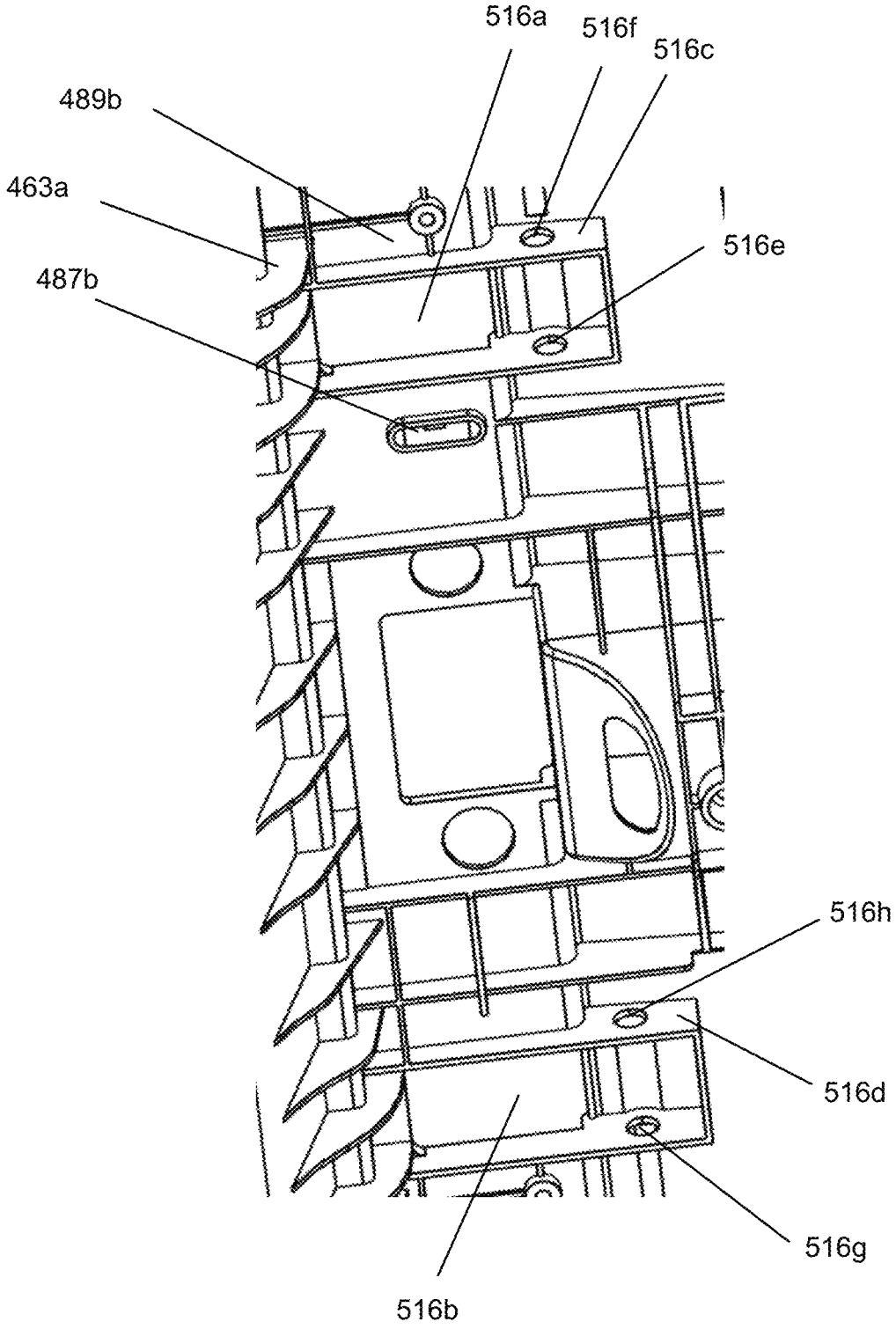
FIG. 34E is a bottom perspective view of a portion of the housing of the mop head of FIG. 31 comprising housing arm openings.

The arms 515*d*, 515*e*, extend through respective housing arm openings 516*a*, 516*b* (FIGS. 31, 34E) in the upper surface 489 of an upper portion 463*a* the housing 463. A bottom side 489*b* of the top of the housing adjacent the openings 516*a*, 516*b* comprises top hinge mounts 516*c*, 516*d*, one adjacent each opening, as shown in FIG. 34E. The arms 515*d*, 515*e* extend through the respective openings 516*a*, 516*b*. Hinge pins 517*a*, 517*b* (FIG. 38) pivotally join the terminal ends of the hinge arms to the hinge mounts 516*d*, 516*c*, respectively. Hinge pin 517*a* extends through opening 516*e* in mount 516*c* through mounting aperture 515*g* and at least into opening 516*f* in mount 516*c*. Hinge pin 517*b* extends through opening 516*h* in mount 516*d*, through mounting aperture 515*h* and at least into opening 516*g* of mount 516*d*.

Figure 38:
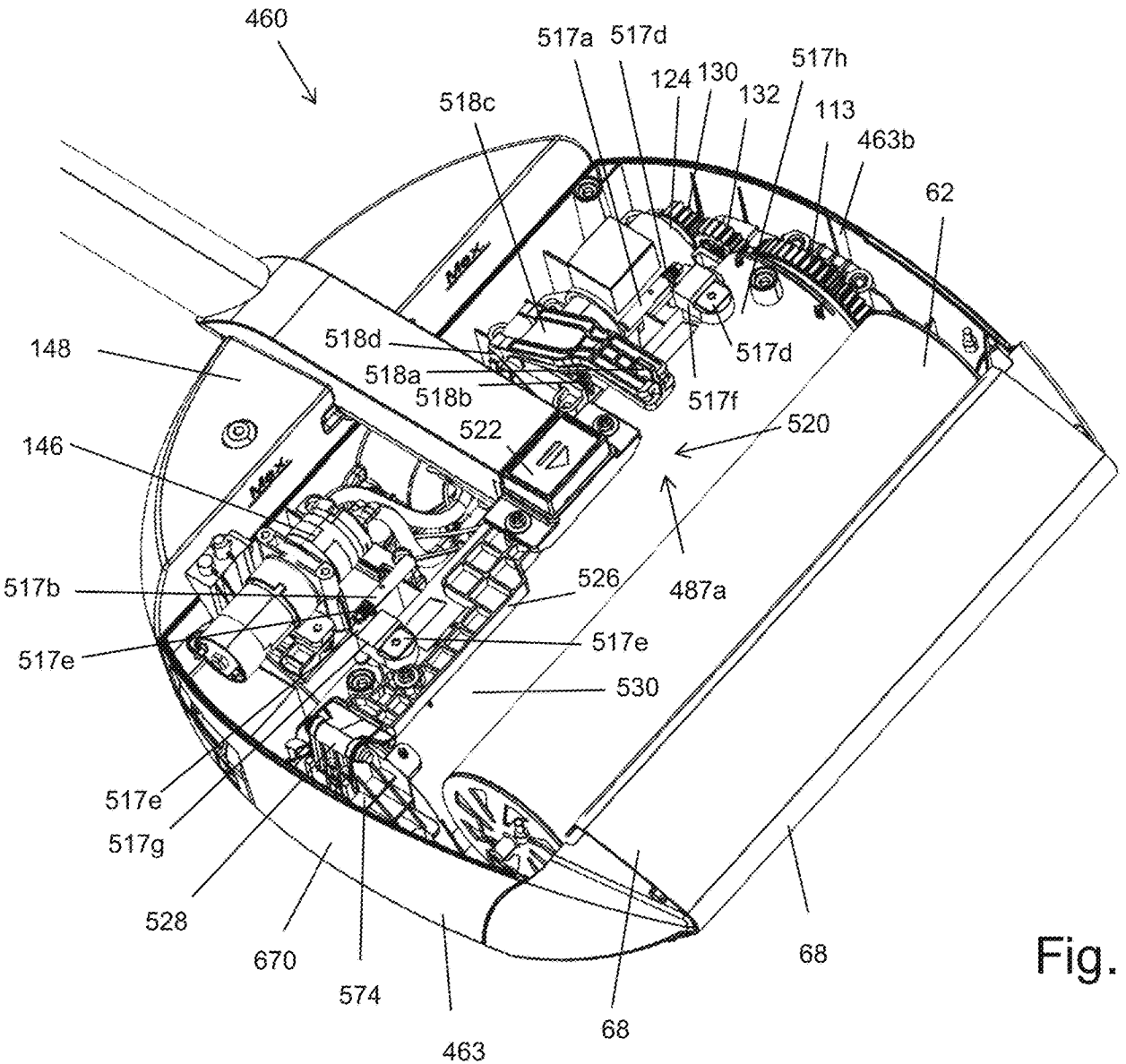
FIG. 38 is a top perspective view of the mop head of FIG. 31, with certain components not shown.
Figure 49:
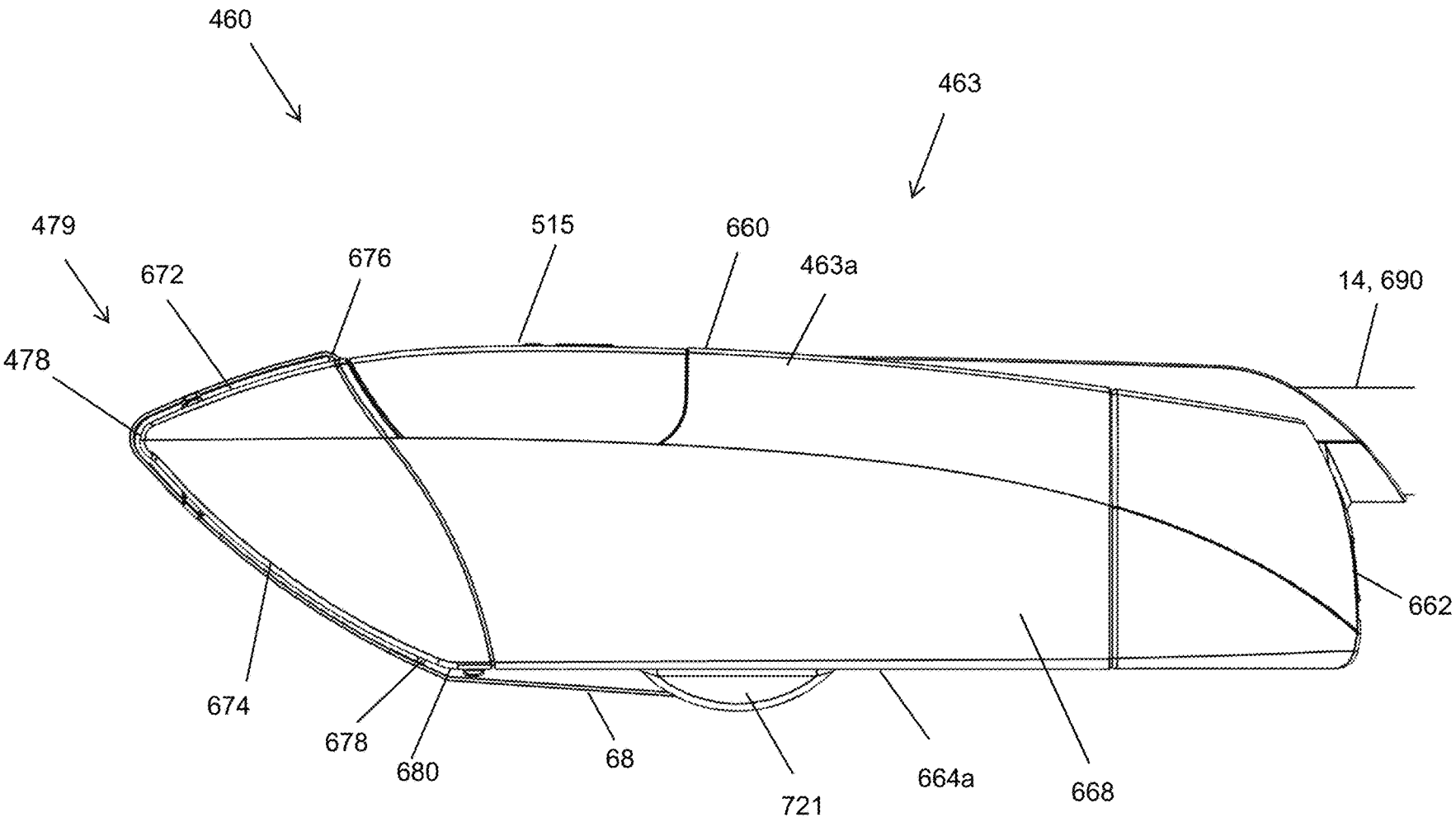
FIG. 49 is a side view of the mop head of FIG. 31.

As shown in FIG. 38, each pin 517*a*, 517*b* is connected to an L-bracket 517*d*, 517*e*. Opposite of the pins, the L-bracket 517*d*, 517*e* is received and mounted to a bottom mount 517*f*, 517*g* of a bottom portion 463*b* (labeled in FIG. 38) of the housing 463. The bottom mounts 517*f*, 517*g* are mounted on a top wall 517*h* of the collection chamber 596. Therefore, the door hinges connect to the bottom mounts 517*f*, 517*g* and the top hinge mounts 516*c*, 516*d* via the pins 517*a*, 517*b* and the L-brackets 517*d*, 517*e*. Therefore, the door hinges connect the top portion 463*a* to the bottom portion 463*b* of the housing 463. The top door 515 pivots at the hinges between a closed position as shown in FIG. 49, and an open position where the top door allows access to the supply roller. In some embodiments, the door 515 in the open position may be ninety degrees from the door's 515 closed position, but other degrees of opening are possible. The doors 58, 322 are hinged in or to the housings 21, 321 in the same manner that door 515 is hinged to housing 463.

In some embodiments, the mop comprises inoperative switch 487*a*, which comprises a spring 518*b* biased button or switch 518*a* extending above an upper surface 489 of the housing, opposite a bottom side 489*b*, and under the top door 515, as shown in FIGS. 31, 34E, and 38. The button 518*a* extends through a button opening 487*b* in the housing as shown in FIGS. 31 and 34E. The switch 487*a* comprises an arm 518*c* carrying the button 518*a*. The arm 518*c* is biased upward by the spring 518*b*. The arm 518*a* is pivotal about a pivot location 518*d* between a raised position and a depressed position. The arm 518*c* is biased to the raised position by the spring 518*b*.

In some embodiments, the inoperative switch 487*a* is operatively connected to the controller 301. The controller 301 is configured to disable or prevent the operation of the mop, including the advancement of the absorbent substrate 68 by the motor 124 and/or the operation of the fluid pump 146 when the button is not in and engaged/depressed position. The top door 515, when in a closed position, holds the button 518*a* in the depressed position. In some embodiments, the bottom side the door has a switch engaging projection 515*n* extending down from the bottom side of the door for engaging the button 518*a* when the door 515 is in the closed position.

When the top door 515 is raised from a closed position, the top door 515 no longer holds down the button 518*a* and the spring bias of spring 518*b* of the button 518*a* drives the button to a raised position. In some embodiments, the switch 487*a* may be connected in line between the power source and the controller or other components so that the power source is disconnected from the controller and/or other downstream components by the switch when the switch is not in the depressed position. Whether the switch signals the controller to prevent operation or whether the switch prevents power from powering portions of the mop, the mop can be configured to prevent its operation when the top door is not closed or not fully closed. In some embodiments, the supply roller is sized to prevent the top door from closing unless the ends 471, 472 of the supply roller are fully seated in the respective operating location 473 (not shown for housing 466). As a result, in some embodiments, the mop will not operate unless the supply roller is properly installed in the mop because if the supply roller is not fully seated, the top door will not fully close, and the inoperative switch will not be in the depressed position.

In some embodiments, the housing of the mop comprises one or more magnets 474, 476 on an upper surface 489 of the housing adjacent the axel housings for releasably holding the top door 515 (not shown in FIG. 31, shown in FIGS. 34B-D and 49) in a closed position until an overcoming opening force is applied, which may be applied by a user's hand in some embodiments. The door comprises metal, or other ferromagnetic material, that is attracted to the magnet. metal or other ferromagnetic material may be mounted to posts, 515*i*, 515*j* extending from a bottom side of the top door as shown in FIG. 34B. In some embodiments, the metal or other ferromagnetic material is a screw 515*k*, 515*m* fixed into the respective post 515*i*, 515*j*, where the head of the screw contacts, and is attracted to, the respective magnets 474, 476 when the door is in the closed position. In some embodiments, the door comprises the magnets and the adjacent mop housing comprises the metal, or other ferromagnetic material, that is attracted to the magnet.

Figure 35:
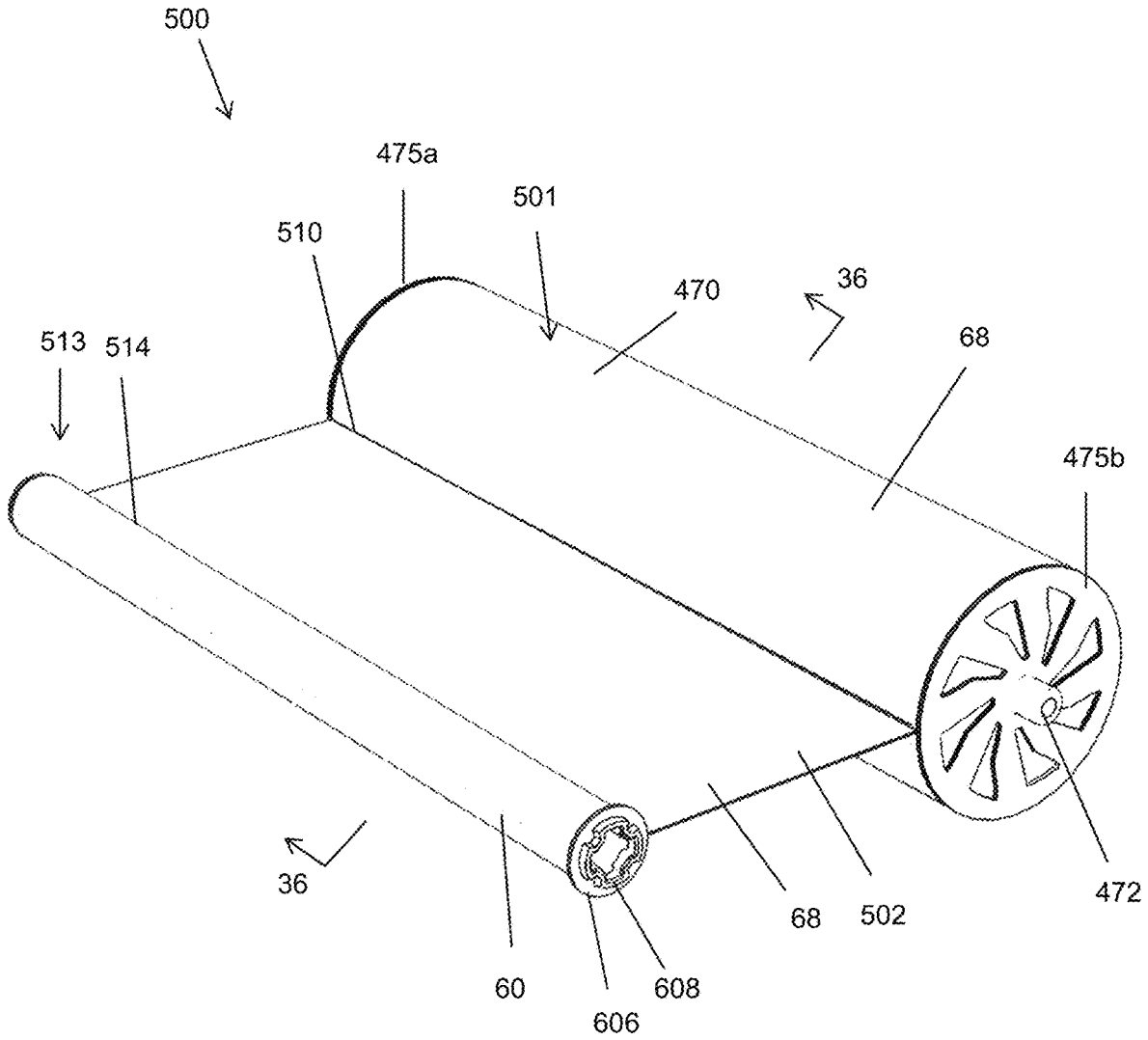
FIG. 35 is a perspective view of a roll arrangement of the invention.

FIG. 35 shows a roll arrangement 500. The arrangement may be used as an initial configuration for installing in a mop head, such as heads 12, 320, 460. The arrangement 500 comprises the supply roller 470, the collection roller 60, and a lead portion 502 of the absorbent substrate 68. The arrangement comprises the absorbent substrate 68. The absorbent substrate comprises a wound portion 501 and a lead portion 502. The wound portion 501 is mounted and wound at the supply roller 470. The supply roller may comprise a supply shaft 503 around which the absorbent substrate is wound. The lead portion 502 of absorbent substrate 68 extends from supply roller to the collection roller 60. The lead portion of the absorbent substrate is connected to the collection roller 60.

Figure 36:
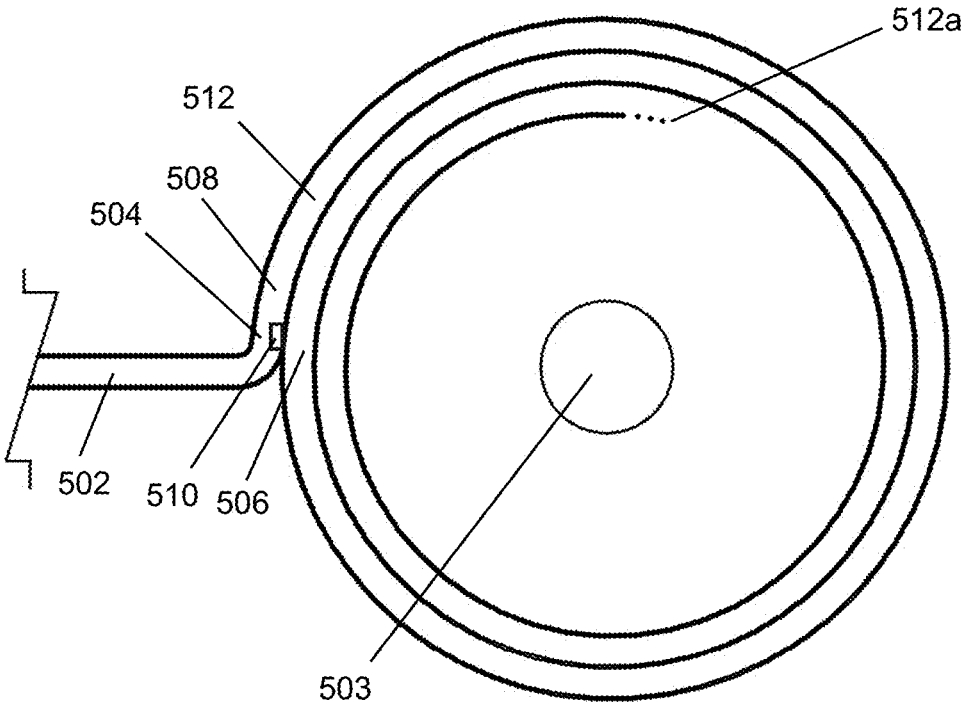
FIG. 36 is a side section view of the roll arrangement of FIG. 35, with certain details not shown, taken along plane 36-36 of FIG. 35.

FIG. 36 shows a side section view of a portion of roll arrangement where only certain outer layers of absorbent substrate are shown on roller 470. The ellipsis 512*a* in FIG. 36 indicates the layers of absorbent substrate extend inward to the shaft 503, which the absorbent substrate is wound around. A proximal end 504 of the lead portion 502 is fixed to the prior layer 506 of the absorbent substrate which is spooled on the supply roller about the supply shaft 503. Therefore, the outer layer 508 is fixed to the prior layer 506 at a fixing location 510. In some embodiments, the fixing location extends from a first end of the supply roller 470 at the first disk end 475*a* to a second end of the supply roll at the second disk end 475*b*. In some embodiments, the fixing location may extend continuously from the first end to the second end of the supply roll on the prior layer 506. In some embodiments, the fixing location may extend discontinuously between the first and second ends of the supply roller.

In some embodiments, the lead portion 502 is fixed to the prior layer 506 at the fixing location by an adhesive, such as glue. The adhesive can be applied at the fixing location and then the overlapping portion of the lead portion is be pressed against the adhesive at the overlapping portion to the prior layer at the fixing location to secure the lead portion thereto.

The fixing force of the adhesive joining the lead portion 502 to the prior layer 506 can be overcome by sufficient pulling force to free upstream material 512 upstream from the fixing location and the absorbent substrate 68 to advance from the supply roll. The pulling force can be applied by an adult user's hand or can be overcome by the advancing power of the motor 124. The adhesive fixating force and or locations of fixation should be such that when the lead portion is freed from the fixing location by sufficient pulling force that the lead portion is not totally disconnected from the supply roller absorbent substrate. Therefore, the absorbent substrate still extends from the supply roller to the collection roller after the pulling force overcomes the fixing force of the adhesive and disconnects the lead portion from the fixing location.

Fixing the lead portion 502 to the prior layer 506 allow a user to easily install a new supply roller and collection roller in to the mop without the absorbent substrate 68 unspooling too far from the supply roller. The length of the lead portion between the supply roller and the collection roller is predefined to match the distance between the supply roll and the collection roll when they are installed in the mop and the absorbent substrate extends from the supply roller around the nose of the mop to the collection roller. In other words, fixing a pre-defined length of the lead portion from the supply roll prevents the excessive runout of the supply roller when installing a new supply roller and collection roller in the mop.

In some embodiments, the distal end 513 of the lead portion 502 is fixed to the collection roller 60 directly, such as by adhering the distal end 513 to the shaft 64 of the roller 60 or by sewing, physically tying, or otherwise physically anchoring the distal end 513 to the shaft 64. The distal end 513 is fixed at one or more locations along a width of the distal end 513. The distal end 513 is fixed along a continuous or discontinuous extent of the width of the distal end 513. The distal end may be adhered with an adhesive. In some embodiments, the distal end 513 comprises a loop that surrounds the collection roller 60 to fix the distal end to the collection roller. The terminal end of the distal end may be fixed back on an upstream portion of the distal end at a second fixing location 514 to form the loop surrounding the collection roller, in the same manner as lead portion is fixed to the prior layer 506 at the supply roller 470.

The mop head 460 comprises a nose 479. The nose comprises a first or upper converging portion 672, and a second or lower converging portion 674. The front or terminal end 478 of the nose 479 does not have rollers, instead a curved or rounded end or profile is provided at the terminal end 478 of the nose 479 as shown in FIG. 32.

The first converging portion 672 comprises a wall 672*a*. The wall 672*a* comprises a first upper operating surface 672*b* and a portion of pad 469. The pad is mounted to the first upper operating surface. The second converging portion 674 comprises a wall 674*a*. The wall 674*a* comprises a first lower operating surface 674*b* and a portion of pad 469. The pad 469 is mounted to the first lower operating surface. The pad 469 extends from the upper converging portion 672, around the terminal end 478, and along the lower converging portion 674.

In some embodiments, the pads 469 is fixed to respective operating surfaces 672*b*, 674*b* so that the pad 469 conforms to the shape and/or contour of the respective operating surface 672*b*, 674*b* and the terminal end 478. In some embodiments, the outer surface of the pad 469 matches the shape and/or contour of the respective operating surface 672*b*, 674*b* and terminal end.

The head 460 comprises upper substrate guides 481 on opposites sides of the pad 469 on the upper converging portion 672 and lower substrate guides 483, 485 on opposites sides of the pad 469 on the lower converging portion 674. The guides maintain the absorbent substrate between the opposite guides and over the pad 469.

In some embodiments, the mop comprises a roller release mechanism 520, as shown in FIGS. 38 to 43. The release mechanism is mounted within the housing 463 to release the collection roller. In some embodiments, the release mechanism comprises a button 522, a pusher 524, a transmission arm 526, and a latch 528.

Figure 39:
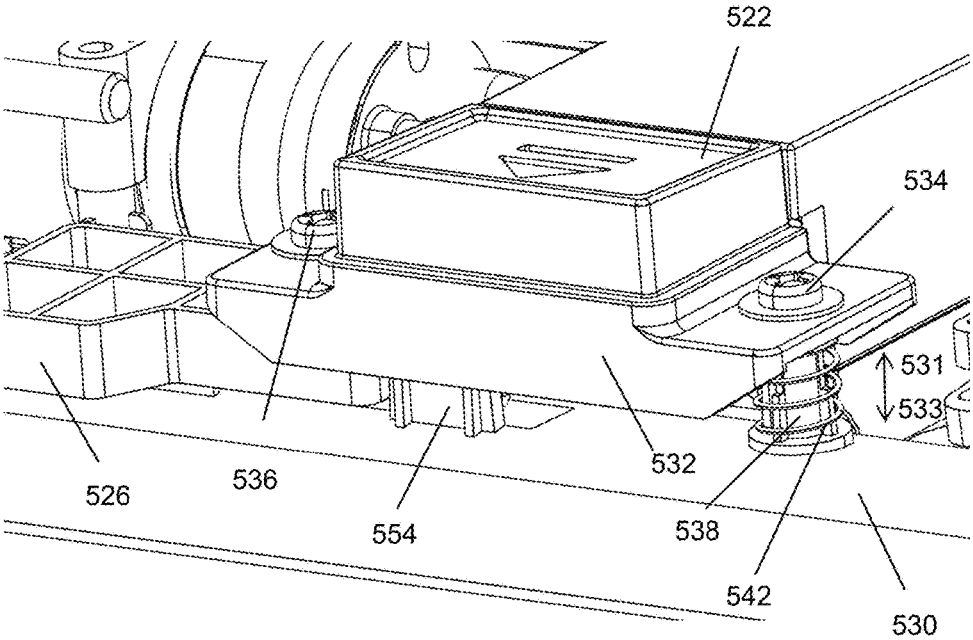
FIG. 39 is a front perspective view of a portion of the roller release mechanism of the mop head of FIG. 31.
Figure 40:
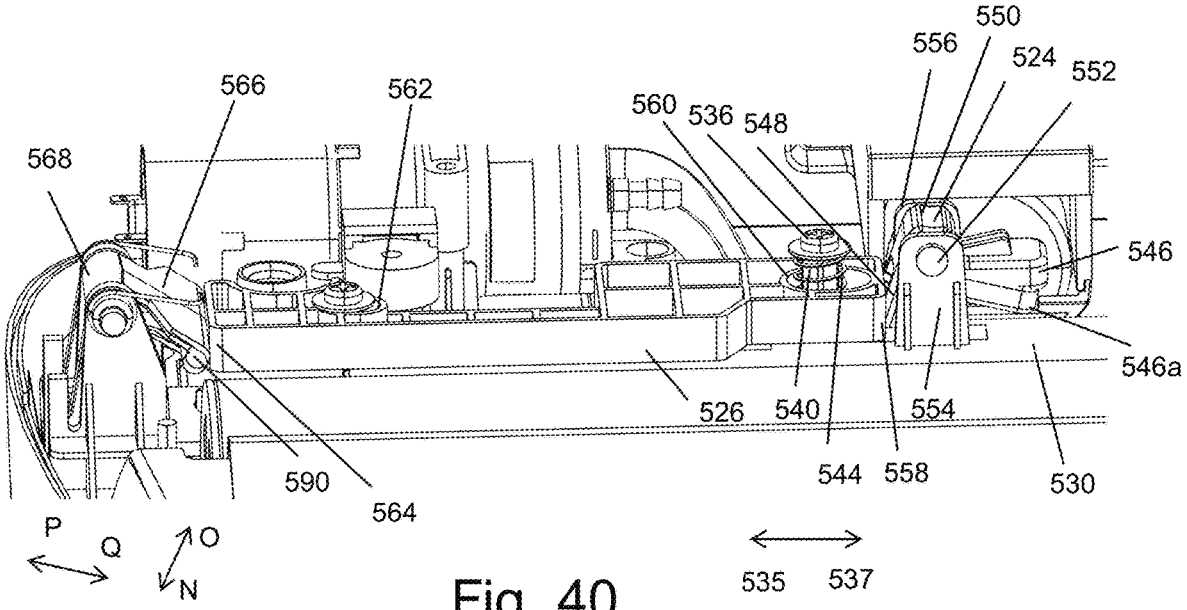
FIG. 40 is a front perspective view of a portion of the roller release mechanism of the mop head of FIG. 31.

A button base 532 of the button 522 is movably mounted to the collection roller cover 530 of the housing 321. FIGS. 39 and 40 shows that the base 532 is attached with fasteners, such as screws 534, 536, to posts 538, 540. The button is moveable up and down in the directions 531 and 533 of FIG. 39. Springs 542, 544 about each post 538, 540 bias the button to a raised position.

A bottom of the button is engageable with the pusher 524. The pusher 524 comprises a pushed arm 546, a pusher arm 548, and a pivot portion 550. The pushed arm 546 is joined to or formed with the pusher arm and the pivot portion. The pivot portion 550 comprises a pass-through aperture (not shown) that a pin 552 passes through. The pin 552 pivotally mounts the pusher 524 between front and rear posts 554, 556. The posts 554, 556 are fixed to the cover 530. The pin extends in and into the posts 554, 556. The pusher pivots about the pin between a home position and a push position. The pushed arm 546 is shown in the home position at 546 and in the push position 546*a* of FIG. 40.

When the button is pushed down in the direction 533, the button contacts and pushes the pushed arm 546 down. The movement of the pushed arm 546 down causes the pusher to pivot about the pin 552 and the pusher arm 548 to move in the direction 535 (FIG. 40) away from the posts 554 and the button 522. When the pusher arm 548 is moved in the direction 535, it pushes the transmission arm 526 in the direction 535 away from the button 522. The pusher arm 548 contacts and pushes the proximal end 558 of the transmission arm 526.

The post aperture 560 and the fastener aperture 562 of the transmission arm 526 are elongated in the 535/537 directions to allow the transmission arm to move, within a range of motion, in the 535/537 directions, away and toward the button 522.

The latch 528 comprises a receiving arm 566, a latch arm 570, and a pivot portion 568. The receiving arm 566 is connected to or formed with the latch arm 570 at the pivot portion 568. A pivot pin 572 mounts the latch 528 to a latch mount 574. The latch mount 574 is fixed to the mop housing 463.

The latch mount 574 comprises a rear portion 576 and a front portion 578. There is a latch opening 580 between the rear and front portions 576, 578. The latch opening 580 is sized to receive the latch 528 therein. The pivot pin 572 extends through an aperture (not shown) in the front portion 578, through the pivot portion 568, and through an aperture (not shown) in the rear portion 576 to pivotally mount the latch 528 to latch mount 574.

The latch arm 570 comprises a hook 582 at a distal end opposite the pivot portion 568. The hook comprises an upper surface 584 for holding an end post 586 of the axle shaft of the roller 60. In some embodiments, the upper surface 584 is flat. In some embodiments, the end post may be a quadrilateral, such as a square or rectangle. In some embodiments the end post may be curved, such as cylindrical. The end post is joined to or formed with the collection axel shaft 588 of the roller 60. The end post 586 is supported on the upper surface 584 of the hook 582.

The receiving arm 566 comprises a contact end 590 opposite the pivot portion 568. A distal end 564 of the transmission arm 526, opposite the proximal end 558, engages the contact end 590 of the receiving arm 566.

Figure 41:
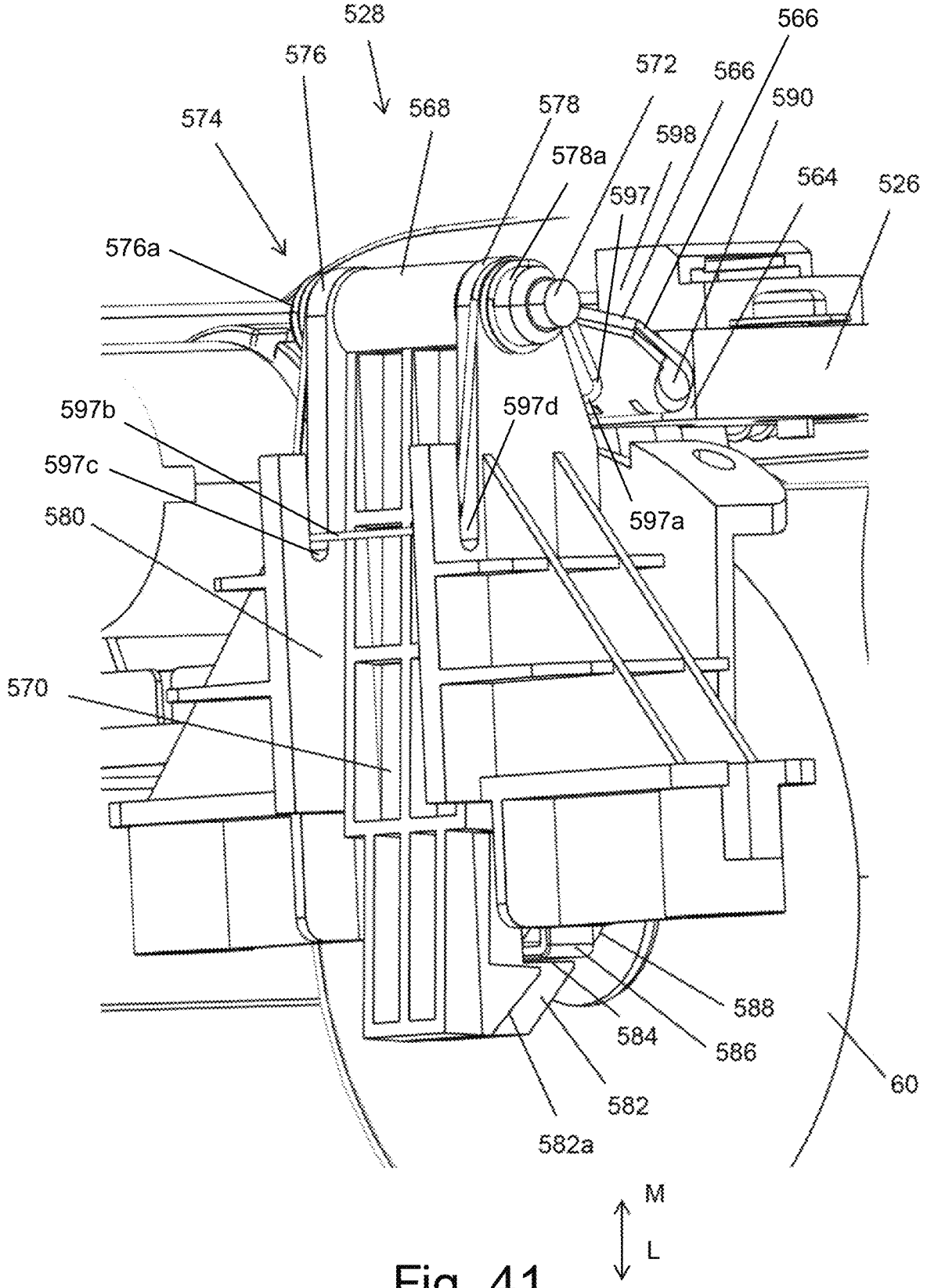
FIG. 41 is a side perspective view of a portion of the roller release mechanism of the mop head of FIG. 31.
Figure 42:
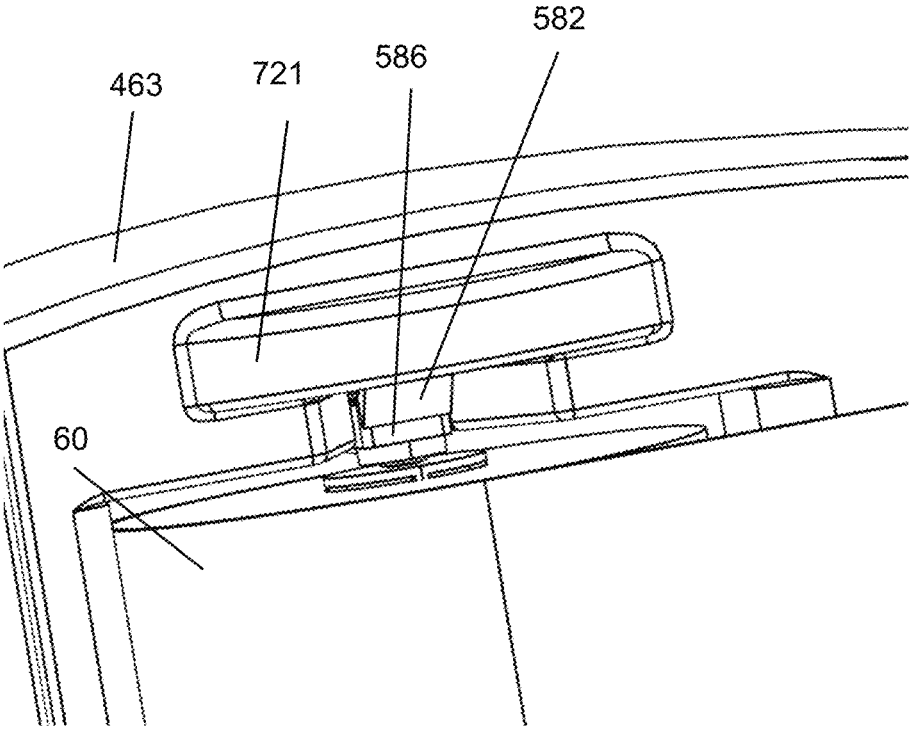
FIG. 42 is a bottom perspective view of a portion of the mop head of FIG. 31.

The latch 528 is pivotal about the pivot portion 568 and the pivot pin 572 between a secured position where the hook 582 is positioned to support the end post 586 (such as at the bottom of the end post 586) and the roller 66, and a released position where the hook 582 is positioned retracted to allow the end post and the roller 60 to move downward, out an exit channel or path 613, and out of the housing 463. FIG. 41 shows a released position at 582*a*, where the hook is retracted from directly under the end post, to allow the end post and the roller 60 to move downward in the direction L and out of the housing.

When a user presses the button 522 downward, the button 522 drives the transmission arm 526 in the direction 535, the transmission arm 526 contacts the contact end 590 of the receiving arm 566 and drives it downward about the pivot portion 568 in the direction N of FIG. 40 as the transmission arm is moved in the direction 535. This causes the latch arm 570 to pivot about the pivot portion 568 in the direction P so that the hook is moved to the released position 582*a* and the end post and roller 60 can move downward in the direction L, out of the operating location 610 (FIG. 43), and out of collection chamber 596 of the housing 463. In some embodiments, when the hook is in the released position 582*a* and no longer supports the end post of the roller, gravity will cause the collection roller to fall out of the operating location 610, the chamber 596 and the housing 463.

Figure 43:
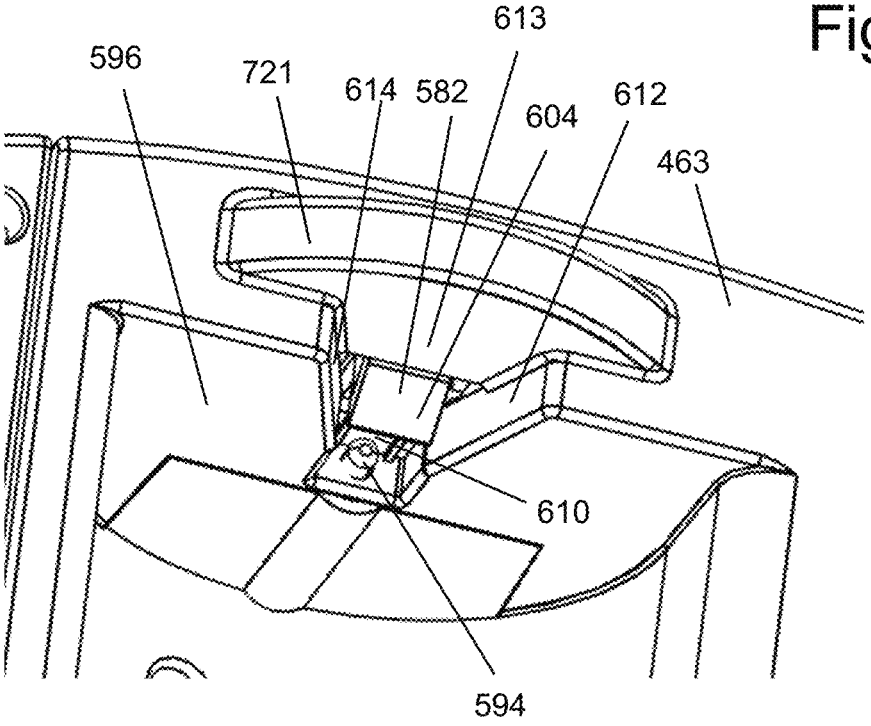
FIG. 43 is a bottom perspective view of a portion of the mop head of FIG. 31.

In some embodiments, an ejection pin 594 is located above the hook as shown in FIG. 43. When the hook is moved to the released position, the spring bias of the spring (not shown) drives the ejection pin 594 down and forces the end post 586 downward. This causes the collection roller to exit the chamber 596 and the housing 463.

The supply roller 62 can be removed first before the collection roller is released. Therefore, the supply roller 62 can hang below the collection roller and the head, connected by the absorbent substrate. Then, a user can release and remove the collection roller from the housing 463 into an external disposal container, such as a trash receptable, without touching the collection roller 60. The collection roller and the supply roller can fall together into a disposal location. This allows a more sanitary and user-friendly process for disposal of the collection roller having used and soiled absorbent substrate. Alternatively, the supply roller can be removed after the collection roller is released and falls out of the housing 463. In which case, the user still need not touch the collection roller to dispose of the roll arrangement.

A spring 597 biases the latch to the engaged position. The operable end 597*a* of the spring 597 is positioned under the arm 566 as shown in FIG. 41. Therefore, the spring biases the arm 566 in the direction O and the latch arm 570 in the direction Q toward the roller 60. The spring 597 also biases the transmission arm 526 in the direction 537 by contact between contact end 590 and the transmission arm 526. The spring 597 is mounted around top posts 578*a*, 576*a* of the front and rear portions 578, 576, at one or more spring loops. A secured end 597*b* of the spring 597, opposite the operable end 587*a* under the arm 566, is positioned and secured in slots 597*d*, 597*c* of the front and rear portions 578, 576, respectively, against unspooling or unloading of the spring.

Figure 44:
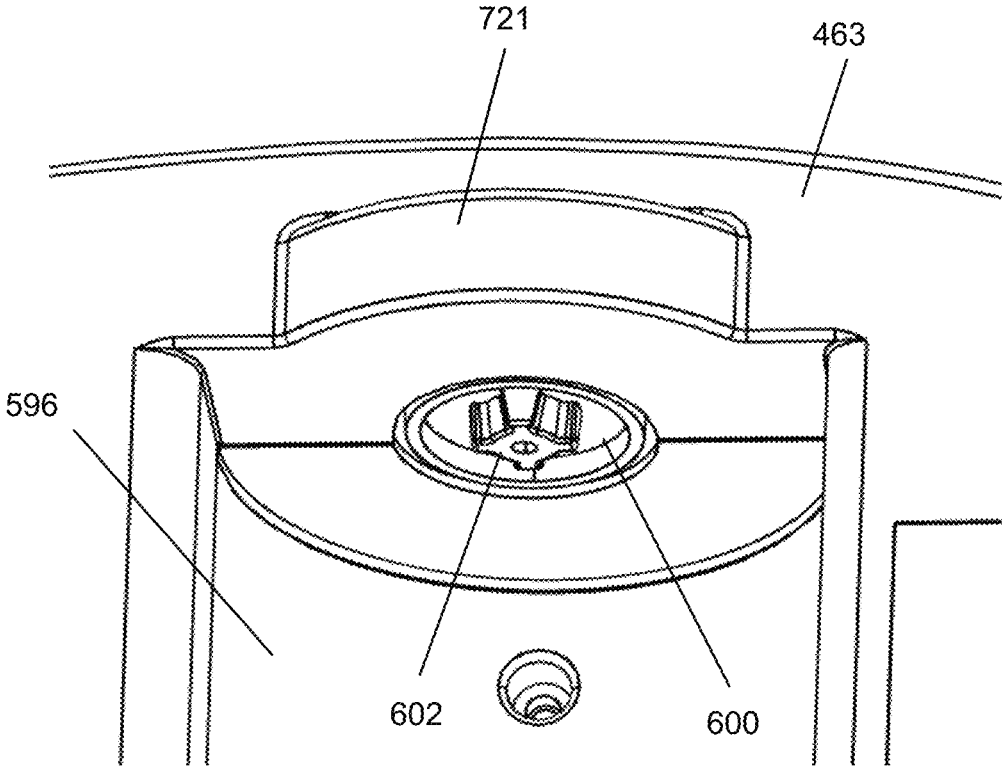
FIG. 44 is a bottom perspective view of a portion of the mop head of FIG. 31.
Figure 45:
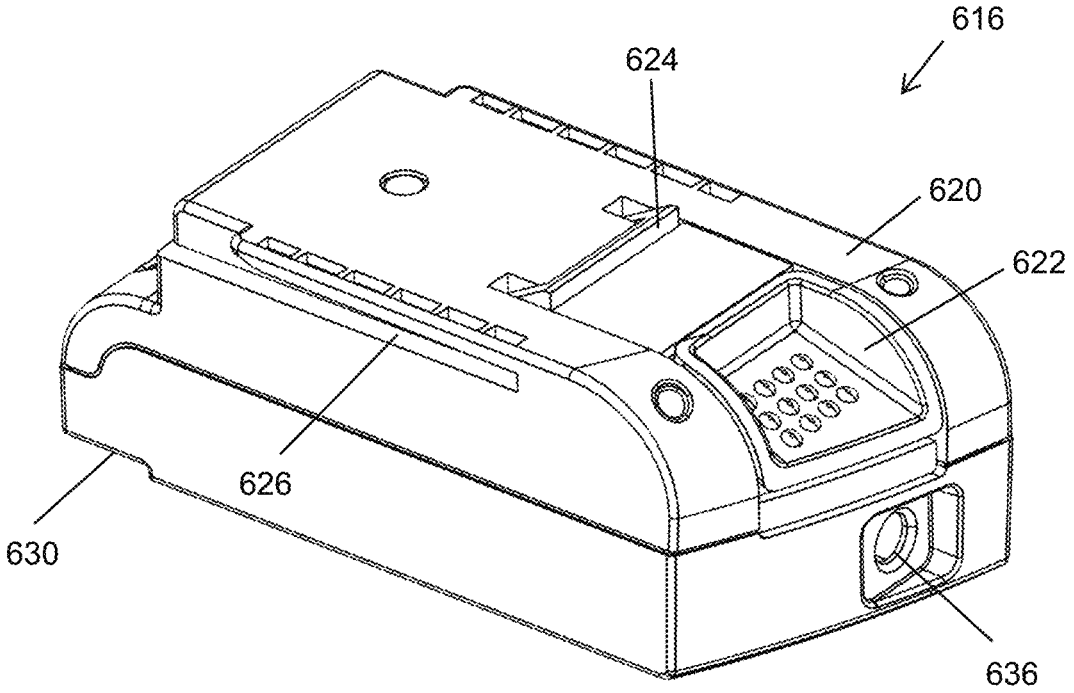
FIG. 45 is a front perspective view of a removable battery unit of the mop head of FIG. 31.
Figure 46:
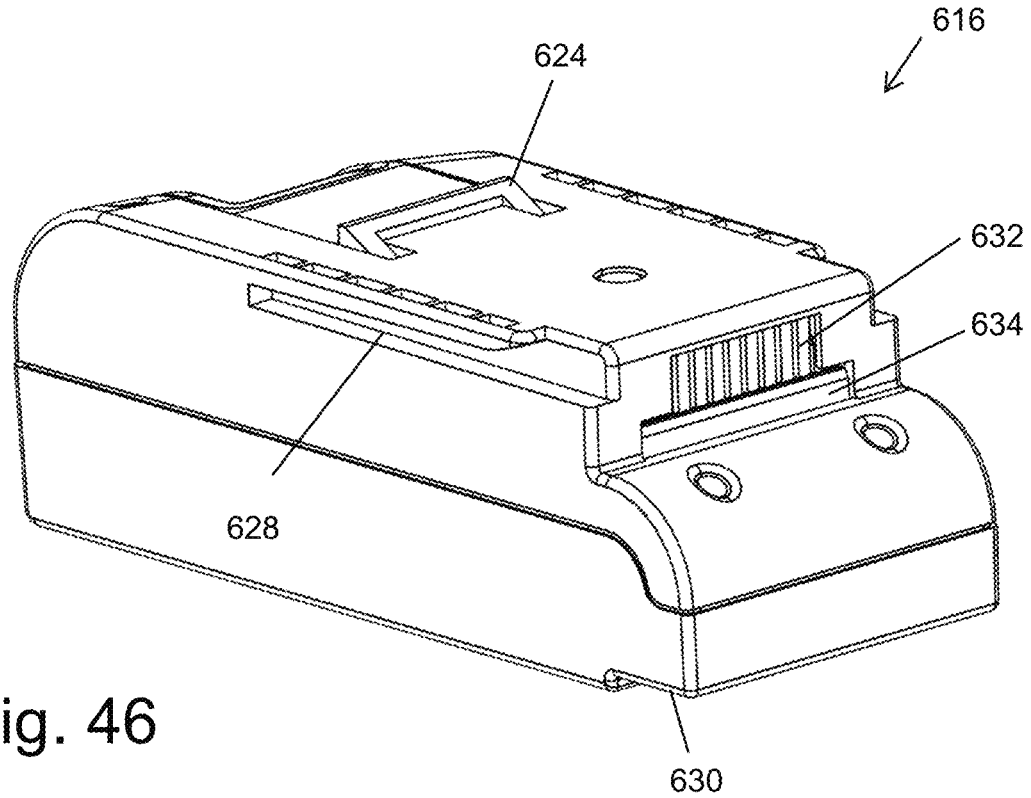
FIG. 46 is a rear perspective view of a removable battery unit of FIG. 45.
Figure 47:
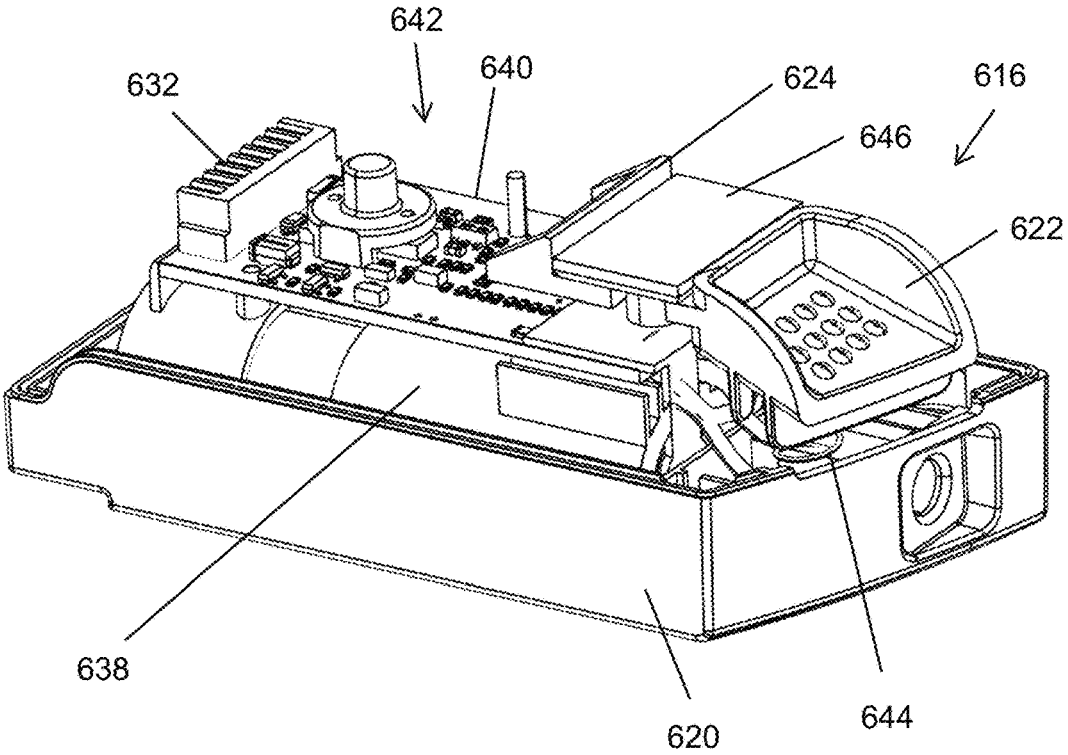
FIG. 47 is a side perspective view of a removable battery unit of FIG. 45 with certain portions not shown.
Figure 48:
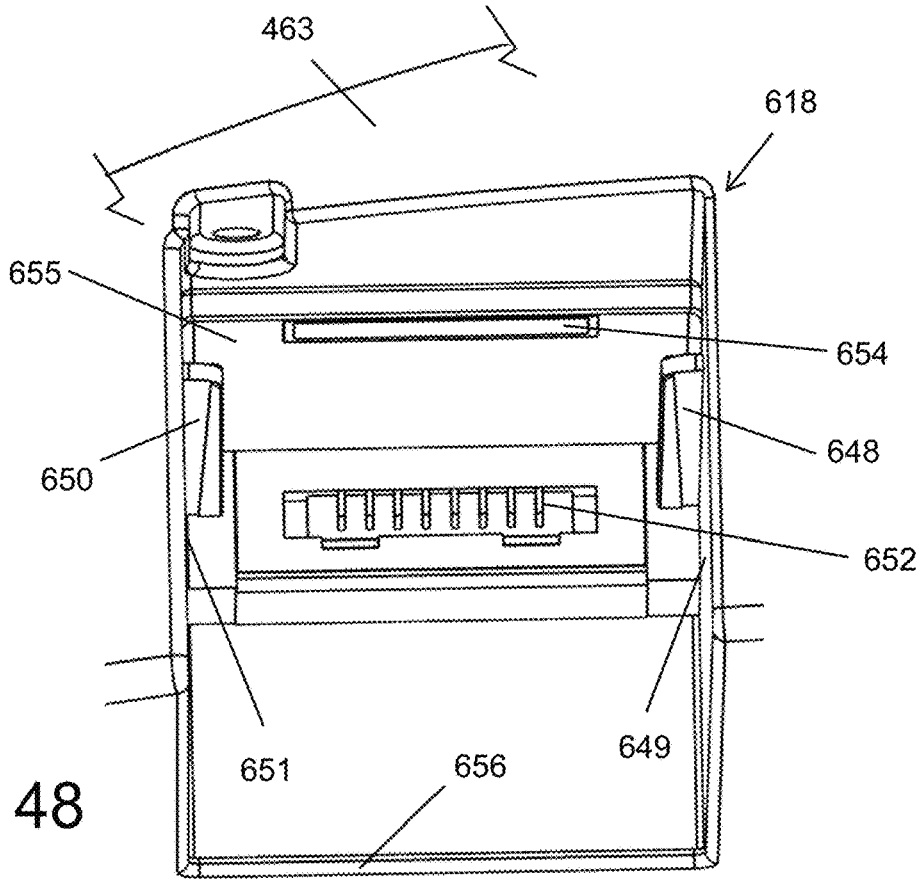
FIG. 48 is a side perspective view of a portion of the mop head of FIG. 31 comprising a battery chamber.

To install the collection roller 60, a driven end 606 (FIG. 35) of the roller is placed in the drive end 600 (FIG. 44) of the roller chamber 596 where the teeth 608 of the driven end 606 of the roller engage with a tooth wheel 602 of the drive end 600. The tooth wheel is connected to gear 113 that is driven by the motor 124. Therefore, the roller 60 is driven by the motor 124.

After the driven end 606 is placed in the drive end 600, the roller 60 is pivoted upward about the driven end 606 so that the end post 586 of the roller approaches the hook. The roller is further pivoted so that the end post contacts the lower angled surface 604 of the hook 582.

The roller is further pivoted upward where the end post 586, moving along the angled surface 604, drives the hook to the released position, in the direction P, and overcomes the bias of the spring 597. When the end post 586 is within the operating location 610, the spring 597 forces the hook forward in the direction Q and under the end post 586 to hold the post end in the operating location and the roller 60 in the roller chamber. When the post end is moved into the operating location 610 the end post 586 forces the ejection pin 594 upward overcoming its downward spring bias. The housing 463 comprises angled sidewalls 612, 614 converging toward the operating location 610 to guide the end post 586 to the operating location, and also providing boundaries to an exit path 613 out of the housing.

Figure 37:
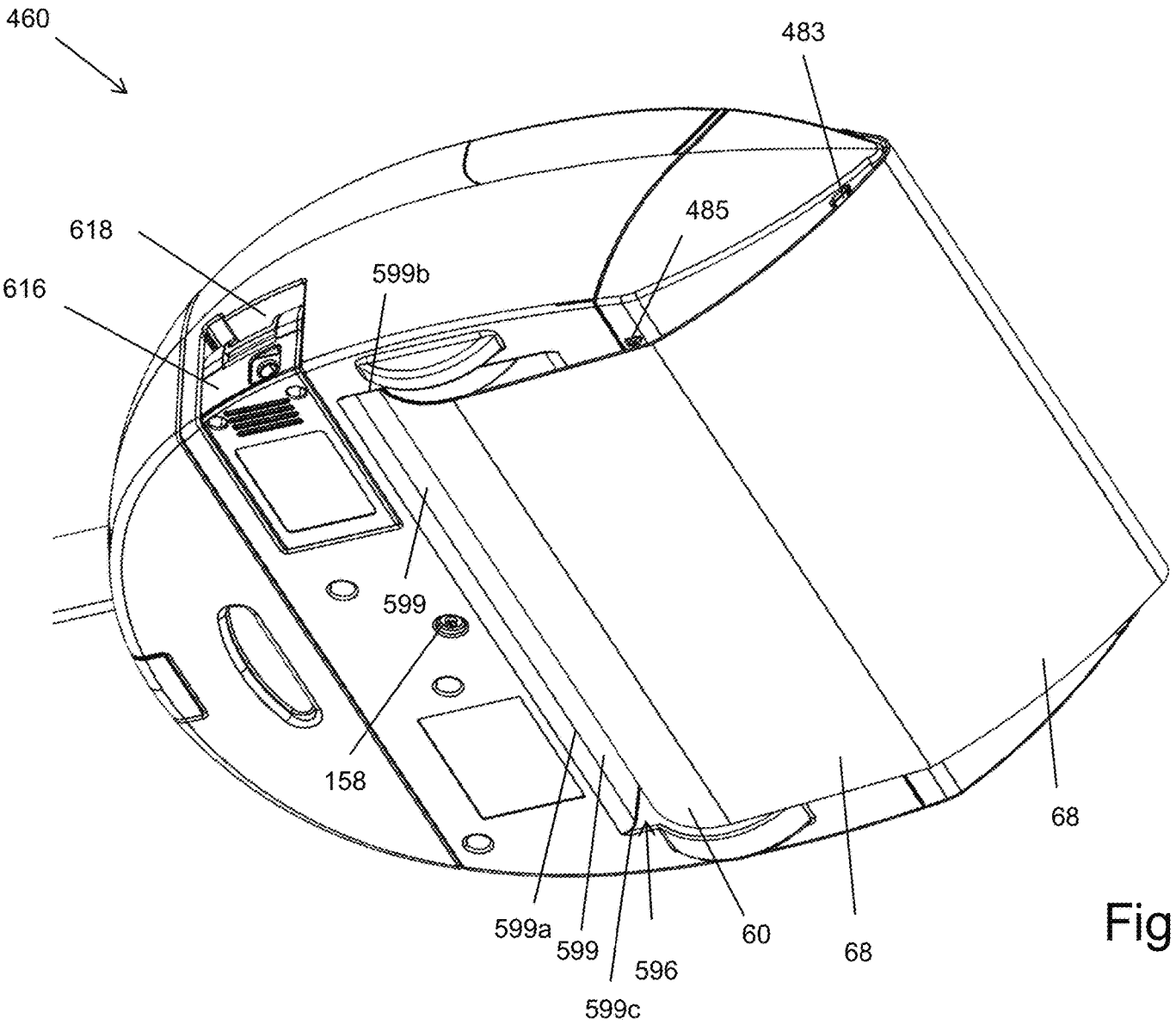
FIG. 37 is a bottom perspective view of the mop head of FIG. 31.

In some embodiments, the mop head 460 comprise a removable battery unit 616, as shown in FIG. 37. The housing 463 comprises a battery chamber 618 where the battery unit 616 is removably installed.

As shown in FIGS. 45 to 48, the removable battery unit 616 comprises a housing 620, a button 622, a battery latch 624, guide slots 626, 628, a rear indent 630, a rear connecting port 632, a rear recess 634, a front charging port 636, a one or more batteries 638, and a spring 644. In some embodiments, the battery unit comprises a circuit board and associated circuitry 642. In some embodiments, the circuitry 642 is configured to control charging. In some embodiments, the circuitry comprises the controller 301 or its functions and is configured to control the operations of the mop, such as advancing the absorbent substrate by the motor 124, controlling the operation of the pump 146, and dispensing liquid from the reservoir 148 out the dispensing port 158, and/or controlling the movement of the stop member(s) based on input from the user, such as by operation of button 234 and handle 165. Therefore, the controller 301 can be housed in the battery unit rather than inside the housing 463 of the mop.

The spring 644 is mounted to an interior of the housing 620 and biases the button 622 to a raised position. The button is connected to the battery latch 624 by a joining member 646. Therefore, the battery latch 624 moves up and down with the button.

The battery chamber 618 comprises side rails 648, 650 on opposite sidewalls 649, 651, a rear pin housing 652 comprising a plurality of pins, a latch recess 654 in a top wall 655, and a rear lower shelf 656. The side rails 648, 650 are received into the respective slots 626, 628 to guide and support the battery unit in the chamber 618. The rear lower shelf 656 supports the rear indent 630 of the battery unit. The battery latch 624 is releasably engaged with the latch recess 654 when the battery unit is seated in the chamber 618. The rear connecting port 632 623 receives the pins of rear pin housing 652, thereby connecting the circuitry 642 and the battery to corresponding components within the housing 463 of the mop head 460.

When the button 622 is pressed down by the user, overcoming the bias of the spring, the battery latch 624 moves down with the button and out of the latch recess 654. The user can withdraw the battery unit 616 from the chamber 618 along the side rails 648, 650. To install the battery unit 616 in the chamber 618, the slots 626, 628 are aligned with the side rails 648, 650 and the battery unit is moved into the chamber 618 until the pins of the pin recess are seated in the connecting port 632 and the battery latch 624 is received in the latch recess 654. The battery latch 624 engagement in the latch recess 654 prevents the withdraw of the battery unit until the button is pressed downward.

Referring to FIGS. 31, 32, 38, 49, 50, 51, the head 460 comprises housing 463 with a top 660, a back 662, a bottom 664, a nose 479, a first side 668, and a second side 670. The nose 479 is opposite the back 662. The shaft 14 or a second embodiment shaft 690 meets the head 460 at the back 662 opposite the nose 479. The nose comprises a top or first converging portion 672, a bottom or second converging portion 674. The top 660 comprises the openable door 515.

The nose 22 comprises a front or terminal end 478. The first converging portion 672 and the second converging portion 674 extend toward the front or terminal end 478. In some embodiments, the pad 469 extends continuously along the first converging portion 672 around the front or terminal end 478 and along the second converging portion 674.

In some embodiments, the pad 469 begins at location 675 at one end adjacent the slot 676 where the absorbent substrate extends onto the first converging portion 672 from the supply roller 62 within housing 463. In some embodiments, the pad 469 ends 678 adjacent the connection at a rear end 680 of the second converging portion 674 where the rear end 680 meets the bottom 664.

FIG. 50 shows the second embodiment mop 459 comprising the head 460, the shaft 690, and a handle 692. In some embodiments, the shaft comprises a first section 694 and a second section 696. The first section meets the second section at a joint 697. In some embodiments, a portion of the terminal end of the first section 694 is sized to be received in to the interior axial opening of the second section 696 adjacent the joint 697. The first and second section may be releasably secured together with a pin 695, which may be spring biased into an aperture of the second section. A handle 692 is joined to the shaft 690 opposite the head 460. The shaft 690 comprises a vertical mid-plane 698, equal-distant, between a top 700 and a bottom 702 of the shaft 690.

The circular nature of the handles 16, 692 allow the respective mops to be used in a range of positions, such as extended from the user during a push a way motion and close to a user during a pull-back motion. The circular handle also provides numerous operator/user gripping locations about the circular handle both when the mop is operated using the lower converging portion 674 and when the mop is inverted and is operated using the upper converging portion 672. The circular nature of the handle 16, 692 further allows for users of different heights to comfortably hold the handle. The circular handle provides an ease of handling and use of the mop in the inverted position where the first converging portion 672 is deployed on the floor, including when operating at floor edge areas, corner areas, and under cabinet kicks (such as the recess often found at the bottom of kitchen cabinets), tables, and other low clearance areas. The edge areas of use can include where a floor meets a wall or cabinet, among other items and structures. The corner areas include where the floor meets two intersecting walls.

Figure 2:
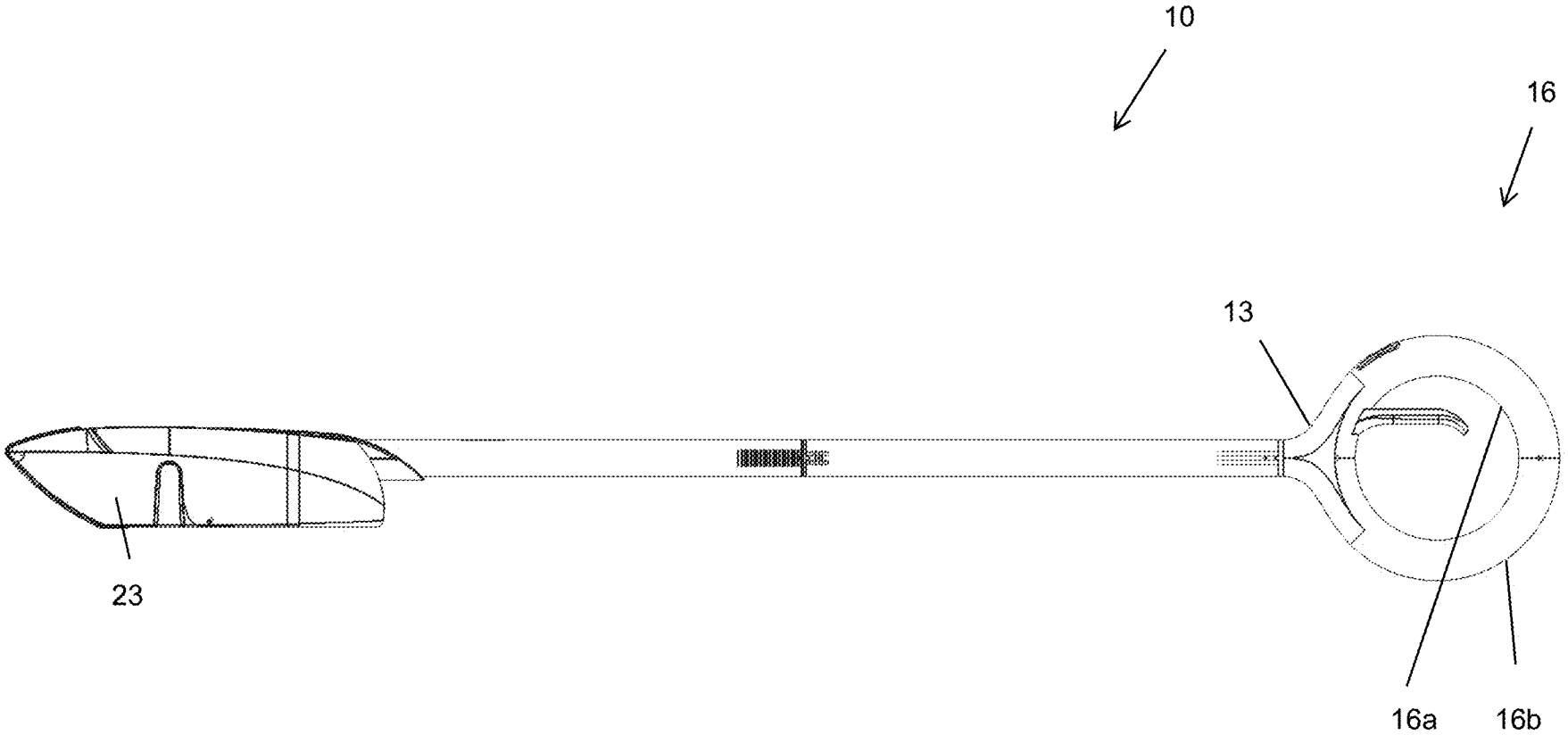
FIG. 2 is a right side view of the mop of FIG. 1.
Figure 3:
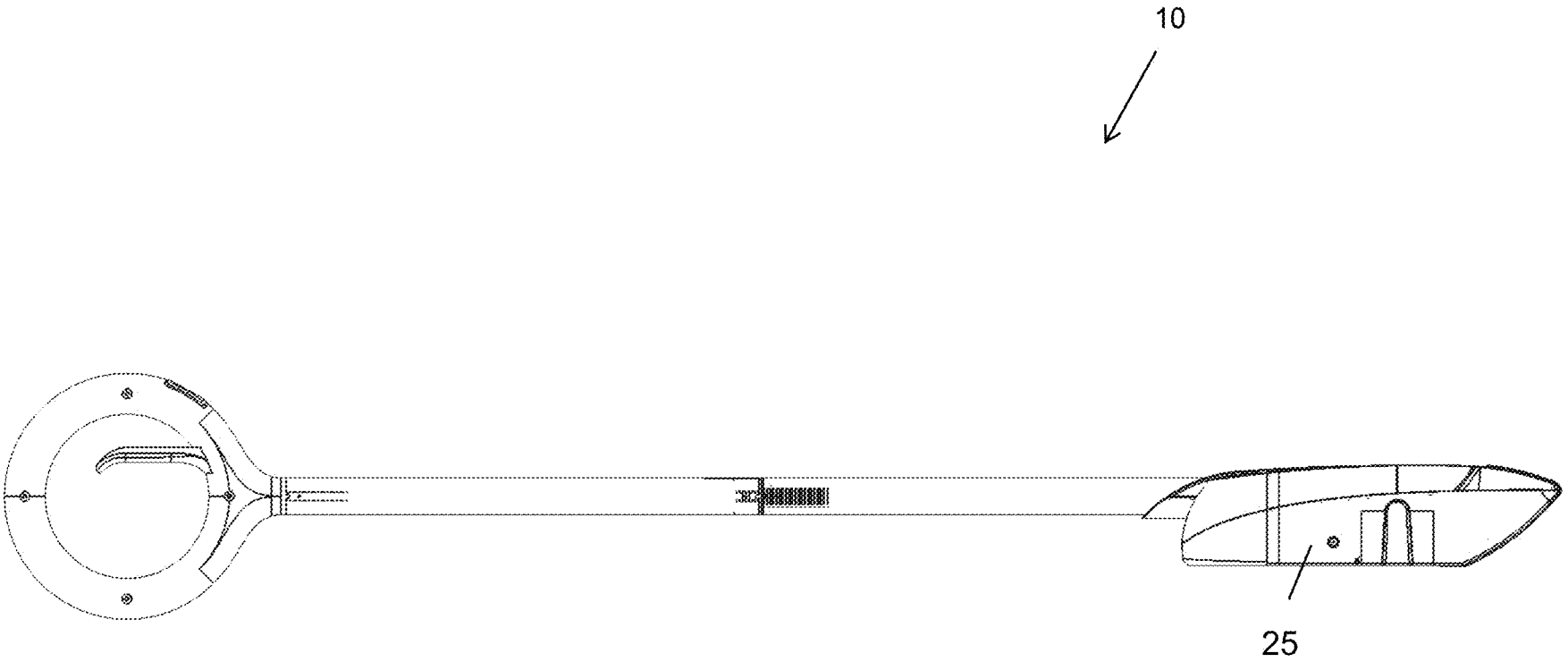
FIG. 3 is a left side view of the mop of FIG. 1.
Figure 4:
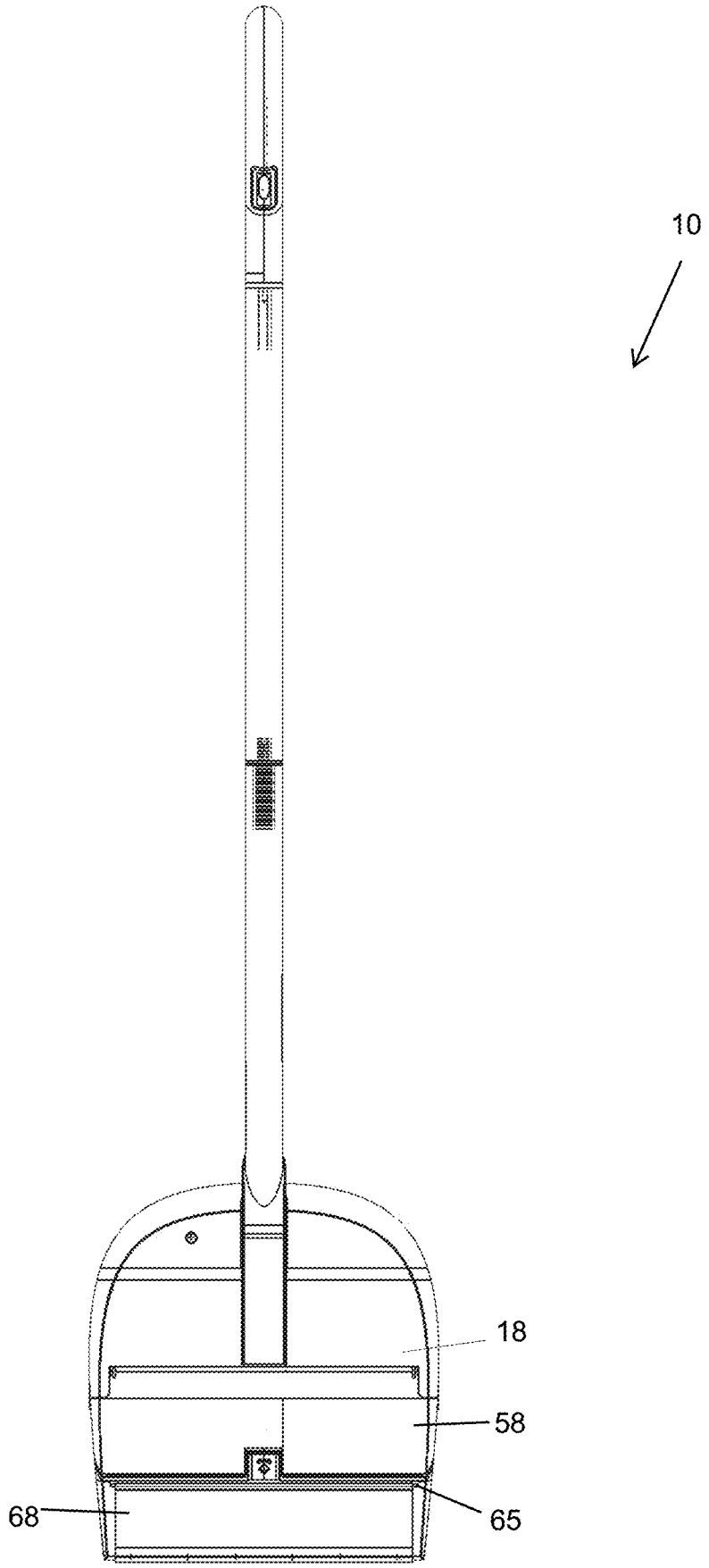
FIG. 4 is a top view of the mop of FIG. 1.
Figure 5:
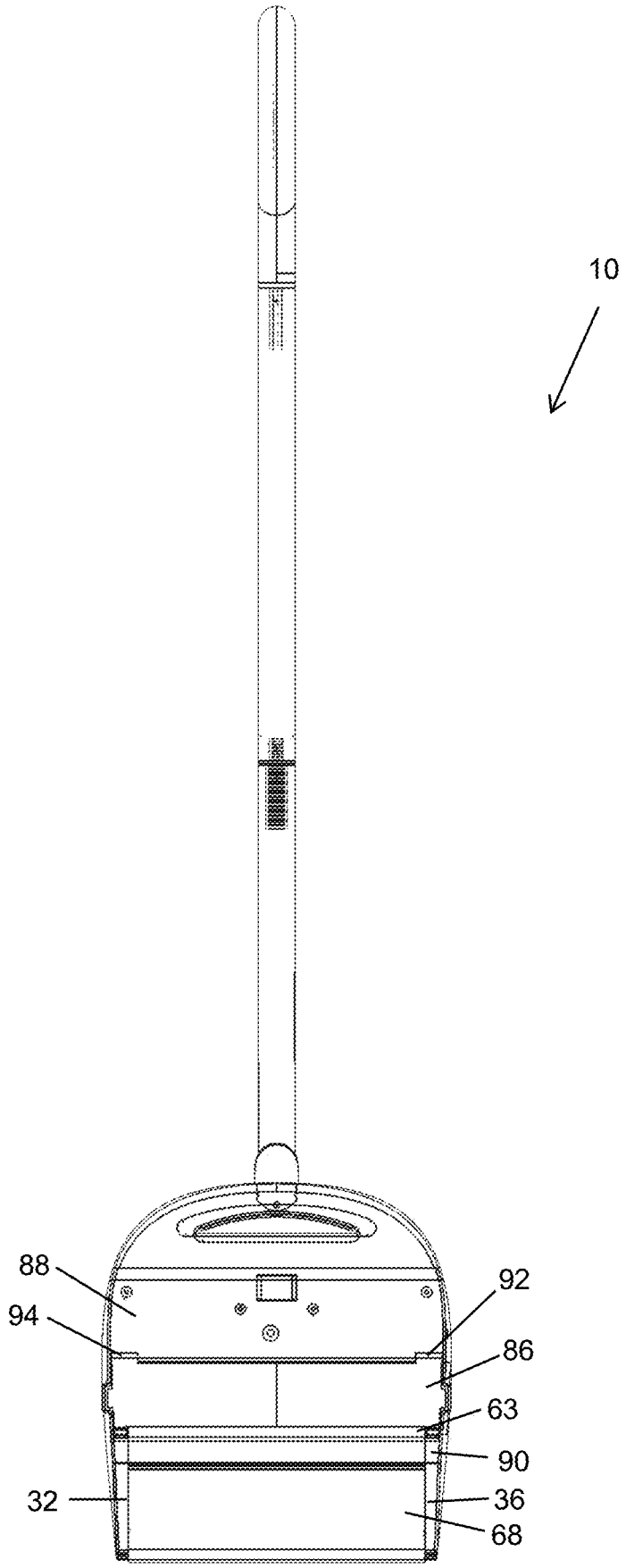
FIG. 5 is a bottom view of the mop of FIG. 1.
Figure 6:
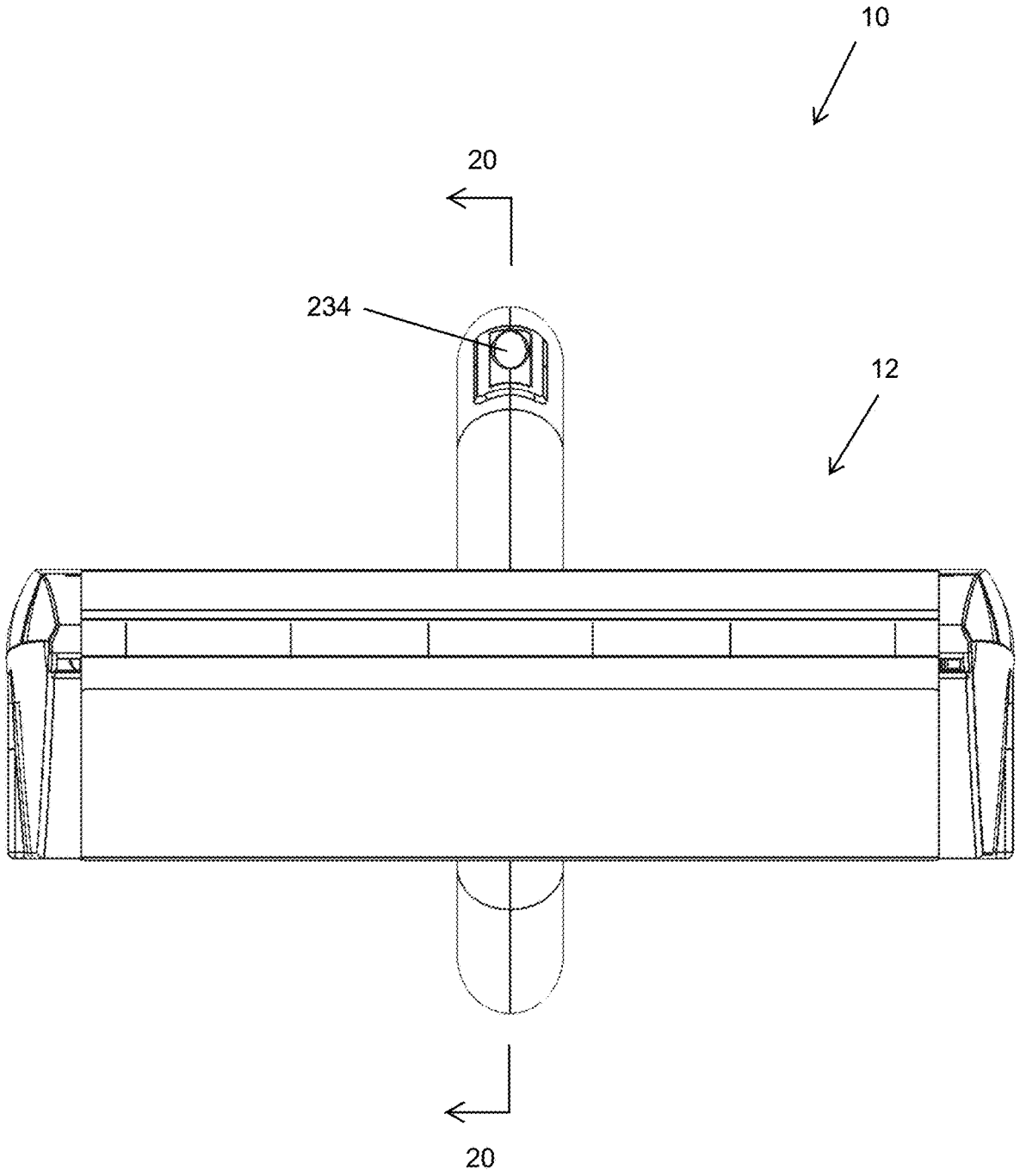
FIG. 6 is a front view of the mop of FIG. 1.

In some embodiments, the handles 16, 692 comprises a circular interior 16*a* (FIG. 2), 692*a* (FIG. 50). In some embodiments, the handle has a circular exterior 16*b*, 692*b*. A bridge 13, 693 connects the circle portion of the handle to the shaft 14, 690. In some embodiments, the circular handle is or comprises ring shape with an interior or center opening. In some embodiments, the handle ring shape is a torus of revolution comprising a circle cross-section.

In some embodiments, the second converging portion 674 is covered from the rear end 680 or the end 684 of the pad to a forward end 686 at or adjacent the front or terminal end 478.

In some embodiments, the second converging portion 674 is curved at least from the rear end 680 or from the end 684 of the pad 469 to a forward end location 688 adjacent the terminal end 478. In some embodiments, a tangent plane 706 intersecting the curve of the second converging portion at the forward end 686 forms a 49 or 50 degree angle 710 from the shaft 690, and more particularly the mid-plane 698. In some embodiments, a tangent plane 708 intersecting the curve of the second converging portion at rear end 680 is a 20 or 21.95 degree angle 712 from the shaft 690, and more particularly the mid-plane 698.

In some embodiments the tangent plane 704 is intersecting the curve of the second converging portion at location 689*a* forms a 36 degree angle 714 from the shaft 690, and more particularly the mid-plane 698. In other embodiments, each of the angles 710, 712, 714 may be formed from the top 700 or bottom 702 of the shaft 690 relative the respective to tangent planes 706, 708, 704 to the same degree.

Therefore, the tangent planes from the forward end to the rearward end of the second converging portion are in the range of 20 degrees to 50 degrees, inclusive, relative to the shaft 690. In some embodiments, the tangent planes from the forward end to the rearward end of the second converging portion are in the range of 20 degree to 90 degrees, inclusive, relative to the shaft 690. Therefore, the mop can be pivoted up to 90 degrees or beyond to the floor.

Figure 51:
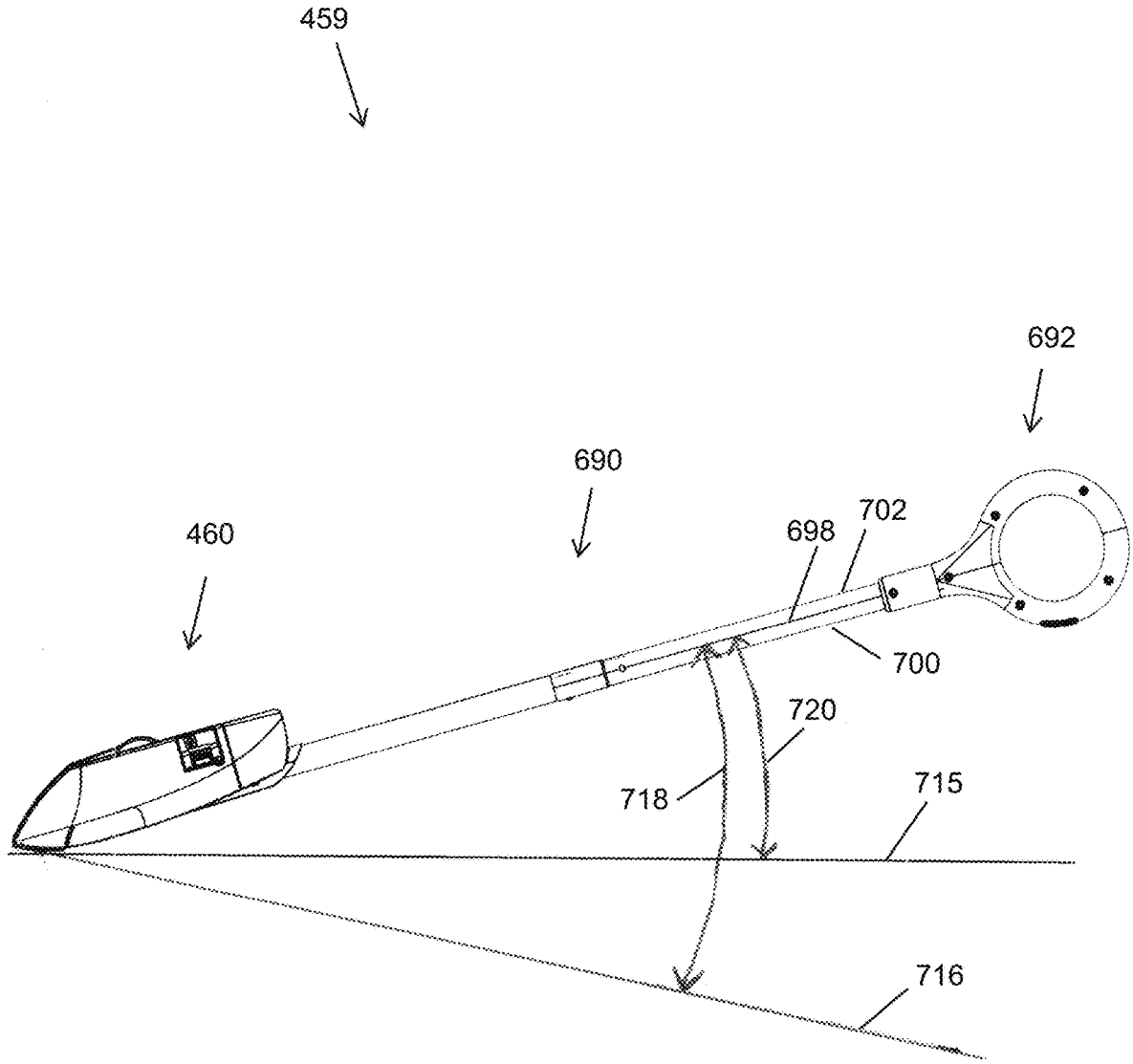
FIG. 51 is a side view of the mop of FIG. 50 in a second orientation of use.

In some embodiments, the first converging portion 672 is curved at least from the beginning slot 676 to the forward end 688 adjacent the terminal end 478. FIG. 51 shows the mop 459 inverted from its position in FIG. 50 so that the first converging portion is positioned to engage the floor 715. This is a lower profile mode of using the mop, which in some applications, may be useful for cleaning under items with lower clearance. For example, use in the inverted position may allow cleaning under the overhanging lip of kitchen cabinets in some applications. In another example, the inverted position may allow cleaning under couches, dressers, stands, or other items positioned close to the floor. Further, in some applications, use of the mop in the inverted position may enable the user to better clean edge or corner areas of a floor or surface, including under cabinet kicks, tables, and other low clearance areas.

In some embodiments, tangent plane 715 is a floor, which intersects the curve of the first converging portion at rear end 677 or location 675, when the first converging portion is on the floor and forms a 16.5 or 15 degree angle 720 from the shaft 690, and more particularly the mid-plane 698. In some embodiments, a tangent plane 716 intersecting the curve of the first converging portion at location 689 or 688 forms a 26 degree angle 718 from the shaft 690, and more particularly the mid-plane 698. In other embodiments, each of the angles 718, 720 may be formed from the top 700 or bottom 702 of the shaft 690 relative the respective tangent planes 716, 715 to the same degree.

Therefore, in some embodiments, the first converging portion has a curve in the range of 15 degree to 26 degrees, inclusive, relative to the shaft 690 from the forward end to the rear end of the first converging portion.

The angles 710, 712, 714, 715, 716 relative to the shaft are also relative to the handle 692, and in particular the mid-plane 722 of the handle that is co-planar with the mid-plane 698 of the shaft. In some embodiments, one or more or all of angles 710, 712, 714, 715, 716 are oblique angles or acute angles.

In some embodiments, the length of the first converging portion is less than the length of the second converging portion. In some embodiments, the front or terminal end 478 of the nose 479 is closer to the top of the head 460 than the bottom. This is also the case for the front or terminal end of the nose of heads 12, and 320.

In some embodiments, the first converging portion comprises a linear length of 2.13 inches, an arch length of 2.14 inches at a radius of 8.29 inches. In some embodiments, the second converging portion comprises a linear length of 3.76 inches, an arc length of 3.80 inches at a radius of 8.49 inches.

Figure 52:
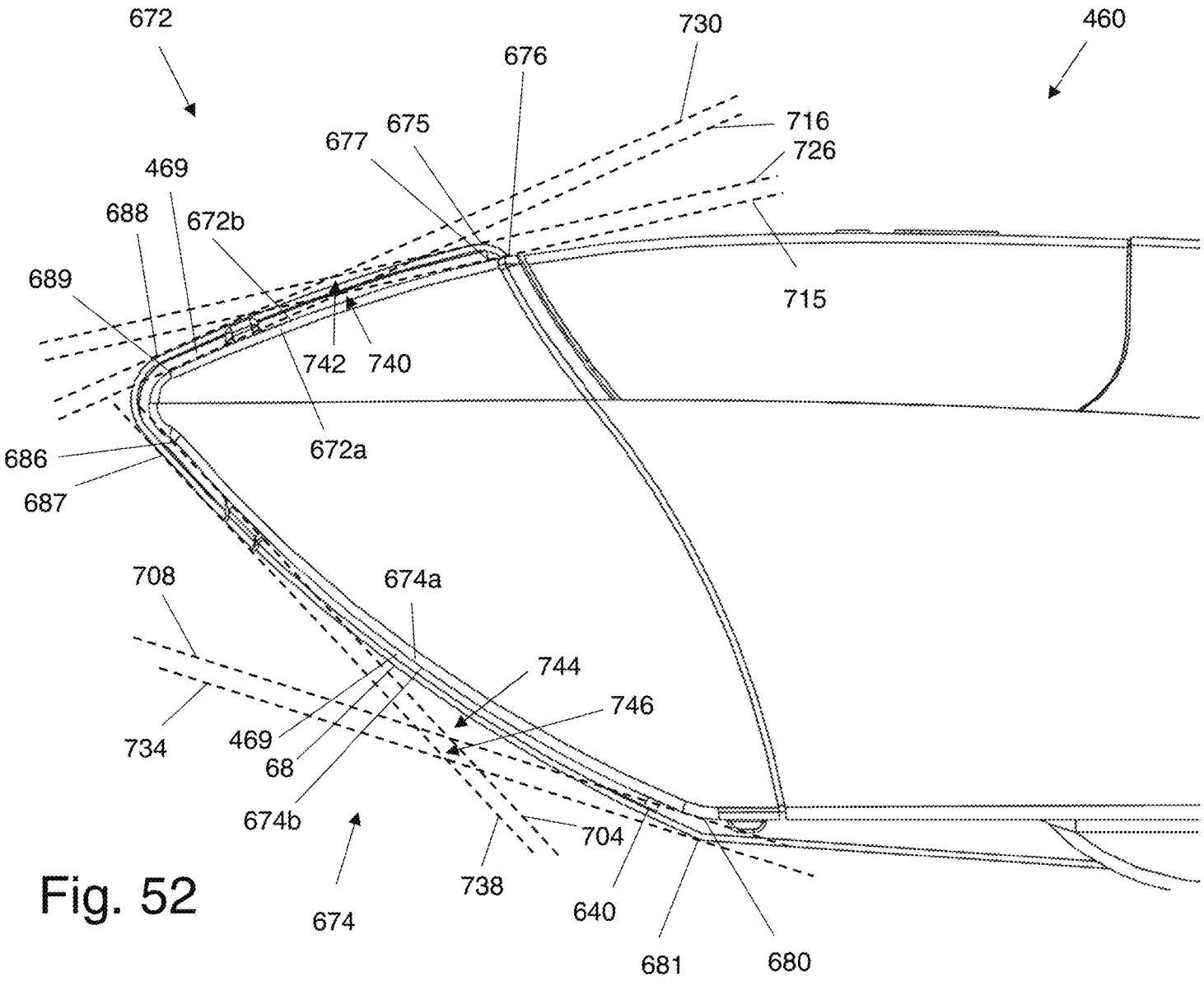
FIG. 52 is a side view of a portion of the mop head of FIG. 31.

FIG. 52 shows certain tangent planes of the mop 459 in more detail. In some embodiments, such tangent planes also exist for mop heads 12, 320. The upper operating surface 672*b* has a rear end 677 at or adjacent the slot 676 for the absorbent substrate 68 from the supply roller 470 to reach the upper operating surface 672*b*. Opposite the rear end is a forward end 689 at the nose 479. The first rear top tangent plane 715 intersects the surface of the upper surface at the rear end 677.

There is a second rear top tangent plane 726 that intersects the absorbent substrate 68 at location 675, which is above the rear end 677 of the upper operating surface 672*b*. In some applications, the second top tangent plane is parallel to the first rear top tangent plane 715. In some applications, the tangent plane (not shown) that intersects the top of the pad 469 at the end 677 is also parallel to and located between the first and second rear top tangent planes 715, 726.

A first front top tangent plane 716 intersects the upper operating surface 672*b* at the forward end 689. A second front top tangent plane 730 intersects the absorbent substrate 68 at location 688, which is above the first forward end 689 of the upper operating surface 672*b*. In some applications, the second front top tangent plane 730 is parallel to the first front top tangent plane 716. In some applications, the tangent plane (not shown) that intersects the top of the pad 469 at the end 677 is also parallel to and located between the first and second front top tangent planes 716, 730.

The lower operating surface 674*b* has the rear end 680. Opposite the rear end 680 is a forward end 686 at front end of the nose 479. The first rear bottom tangent plane 708 intersects the lower operating surface 674*b* at the rear end 680.

There is a second rear bottom tangent plane 734 that intersects the absorbent substrate 68 at location 681, which is above the rear end 677 of the lower operating surface 674*b*. In some applications, the second bottom tangent plane 734 is parallel to the first bottom tangent plane 708. In some applications, the tangent plane (not shown) that intersects the top of the pad 469 at the end 680 is also parallel to and located between the first and second rear top tangent planes 715, 726, when the pad extends to the end 680. FIG. 52 shows that the pad 469 stops short of the end 680 at location 640.

A first front bottom tangent plane 704 intersects the lower operating surface 674*b* at the forward end 686. A second front top tangent plane 738 intersects the absorbent substrate 68 at a location 687, which is above the forward end 686 of the lower operating surface 674*b*. In some applications, the second front lower tangent plane 738 is parallel to the first front bottom tangent plane 704. In some applications, the tangent plane (not shown) that intersects the top of the pad 469 at the end 686 is also parallel to and located between the first and second front bottom tangent planes 704, 738.

In operation, the absorbent substrate 68 is in contact with the surface to be operated on (e.g., surface to be cleaned) between end 680 and the nose on the lower operating surface 674*b*, depending on the angle of the mop relative to the surface to be operated on. When in the inverted opposition in operation, the absorbent substrate 68 is in contact with the surface to be operated on (e.g., surface to be cleaned) between end 677 and the nose on the upper operating surface 672*b*, depending on the angle of the mop relative to the surface to be operated on. The absorbent substrate at any part of the nose can be in contact with the surface to be operated on depending on the user's positioning of the mop relative to that surface.

Methods of cleaning a surface, such as a floor, are disclosed. During use on either the upper or lower converging portion 672, 674, the curved operating surfaces thereof enable a soiling substance lifting use of the mop. In some embodiments, a soiling substance may comprise dirt and/or debris and may comprise solid(s) and/or liquid(s). In one embodiment of operation, the operating surface 674*b* is placed on a surface to be cleaned, such as a floor, behind a soiling substance on the floor. Then the operating surface is slid toward the soiling substance. The operating surface is rocked toward the rear end 680 or location 681 causing a forward portion 686, 687, or a forward portion behind the forward end 686 but in front of rear end 680, to lift up from the floor and to lift the soiling substance with it from the floor. This rocking from a forward portion toward a rearward portion causes a scooping motion and changes the location of contact between the floor and the operating surface to a portion that is toward the rearward portion. Therefore, the head rocks backward along the operating surface.

During the backward rocking the nose lifts away from the floor and forward portion(s) of the operating surface lift away from the floor. If those forward portions of the operating surface were on a soiling substance on the floor, the absorbent substrate will capture the soiling substance and hold the soiling substance. Therefore, when a given forward portion of the operating surface lifts away from the floor during the rocking backwards, the soiling substance captured in the absorbent substrate will be lifted and removed from the floor. In some embodiments, the operating surface is placed on a soiling substance on the floor and then the operating surface is rocked toward a rearward portion of the operating surface causing a forward portion of the operating surface to lift up from the floor and to lift the soiling substance from the floor. Therefore, it is not necessary that the operating surface be slid into the soiling substance on the floor, although it may, before the soiling substance is lifted by the rocking of the operating surface. The rocking of the operating surface on the floor can occur before, during, or after the sliding of the operating surface along the floor.

In some uses, the rearward rocking of the operating surface on the floor is caused, at least in part, by lowering the shaft 14, 690 via lowing the handle 16, 692. In some uses, the rearward rocking of the operating surface on the floor is caused, at least in part, by pushing/sliding the shaft 14, 690 via the handle 16, 692 forward.

The forgoing rocking of the lower operating surface 674*b* applies to the upper operating surface 672*b*, Therefore, when the mop is inverted and operated with the upper operating surface 672*b* on the floor or other surface to be cleaned, the absorbent substrate will the lift soiling substance from the floor when the operating surface is rock toward rear locations 675, 677 in the same manner as described above for lower operating surface 674*b*.

In some embodiments and uses, when the user pushes the mop away from the user on the surface to be cleaned, such a floor surface, the head and nose will pivot relative to the floor surface. The head can move in a scooping motion when rocking where the portion of the applicable operating surface 672*b*, 674*b* deployed to the floor, via the absorbent substrate, will move rearward toward the rear 677, 675, 680, 681 of that respective operating surface. The rocking can start with the portion of the applicable operating surface in contact with the floor at or to the rear of location 686, 687, 688, 689 of the applicable surface, and the rocking will cause the portion of the applicable operating surface in contact with the floor to move toward the rear 677, 675, 680, 681 of that respective operating surface while the portion of the application operating surface rising from the floor will be in front of the portion in contact with the floor at a given time during the rocking. Rocking location of contact with the floor surface causes the front or terminal end of the nose to raise relative to the floor as the mop is pushed away from the user. This provides a lifting motion of the absorbent substrate relative to the floor as the mop is pushed. This lifting motion assists in lifting the soiling substance from the floor surface to be cleaned. Therefore, the curved nature of the nose enables a lifting motion of the nose relative to the floor/surface to be cleaned as the mop is pushed away from the user along the floor. The user can also operate the mop on the front of the nose between locations 686 and 689, if desired. The rocking of either of the operating surfaces 672*b*, 674*b* on a surface to be cleaned, such as a floor, may also be referred to as rolling the respective operating surface 672*b*, 674*b* on the surface to be cleaned. The foregoing rocking uses and method of cleaning a floor also apply to the heads 12, 320, 790.

The mops and heads disclosed herein can be slid, in a mopping operation, on an exterior surface to be cleaned, such as the floor, forward away from the user on a selected operating surface of the head and backwards toward a user on a selected operating surface of the head to cause the absorbent substrate on or over the operating surface to collect and remove soiling substances and clean the exterior surface to be cleaned. The back-and-forth sliding of the head can be done repeatedly over the same exterior surface to be cleaned or can be done once and then the head can be moved to the next area to be cleaned, such as an area adjacent the area just cleaned by the mop.

In some embodiments, the first interior angle 740 at the intersection between the first rear top tangent plane 715 and the first front top tangent plane 716 is 12 or 12.22 degrees. The second interior angle 742 at the intersection between the second rear top tangent plane 726 and the second front top tangent plane 730 is 12.3 or 12.22 degrees.

In some embodiments, the first interior angle 744 at the intersection between the first rear bottom tangent plane 708 and the first front bottom tangent plane 704 is 32.37 or 32 degrees. The second interior angle 746 at the intersection between the second rear bottom tangent plane 734 and the second front top tangent plane 738 is 32.37 or 32 degrees, inclusive. In some embodiments, one or more or all of angles 740, 742, 744, 746 are oblique angles or acute angles.

Although not shown in the figures, in some embodiments, the terminal end 478 is in a middle or is vertically equidistant (when the head is in a horizontal orientation) between the top 660 and the bottom 664 of the housing. In some embodiments, the upper operating surface 672*b* comprises a length from the rear end 677 to the terminal end 478 that is the same as a length of the lower operating surface 674*b* from the rear end 680 to the terminal end 478. In some embodiments, the upper operating surface 672*b* comprises a first angle relative to the shaft 14, 690 that is the same as an angle of the lower operating surface relative to the shaft 14, 690. In some embodiments, the nose 479 is mirror image identical about a horizontal midplane intersecting the terminal end 478 when the head is in a horizontal orientation.

In some embodiments, a gear cover 721 extends below a bottom wall 664*a* of the bottom 664 to house a portion of the roller gear 113, as shown in FIGS. 42-44, 49.

In some embodiments, the controller 301 and the circuitry 642 comprises one or more of microprocessor(s), microcontroller(s), a hardware circuit(s), application-specific integrated circuit(s) (ASIC), digital signal processor(s) (DSP), field-programmable gate array(s) (FPGA), discrete logic circuit(s), or combinations thereof for performing the steps, functions, processes, operations, and capabilities of the mop. In some embodiments, the steps, functions, processes, operations, and capabilities described herein of the mop can be provided in the form of instructions stored in a non-transitory computer readable medium and executable by a processor of a computing device to achieve the corresponding functions, processes, operations, capabilities, or results of the mop.

Figure 53:
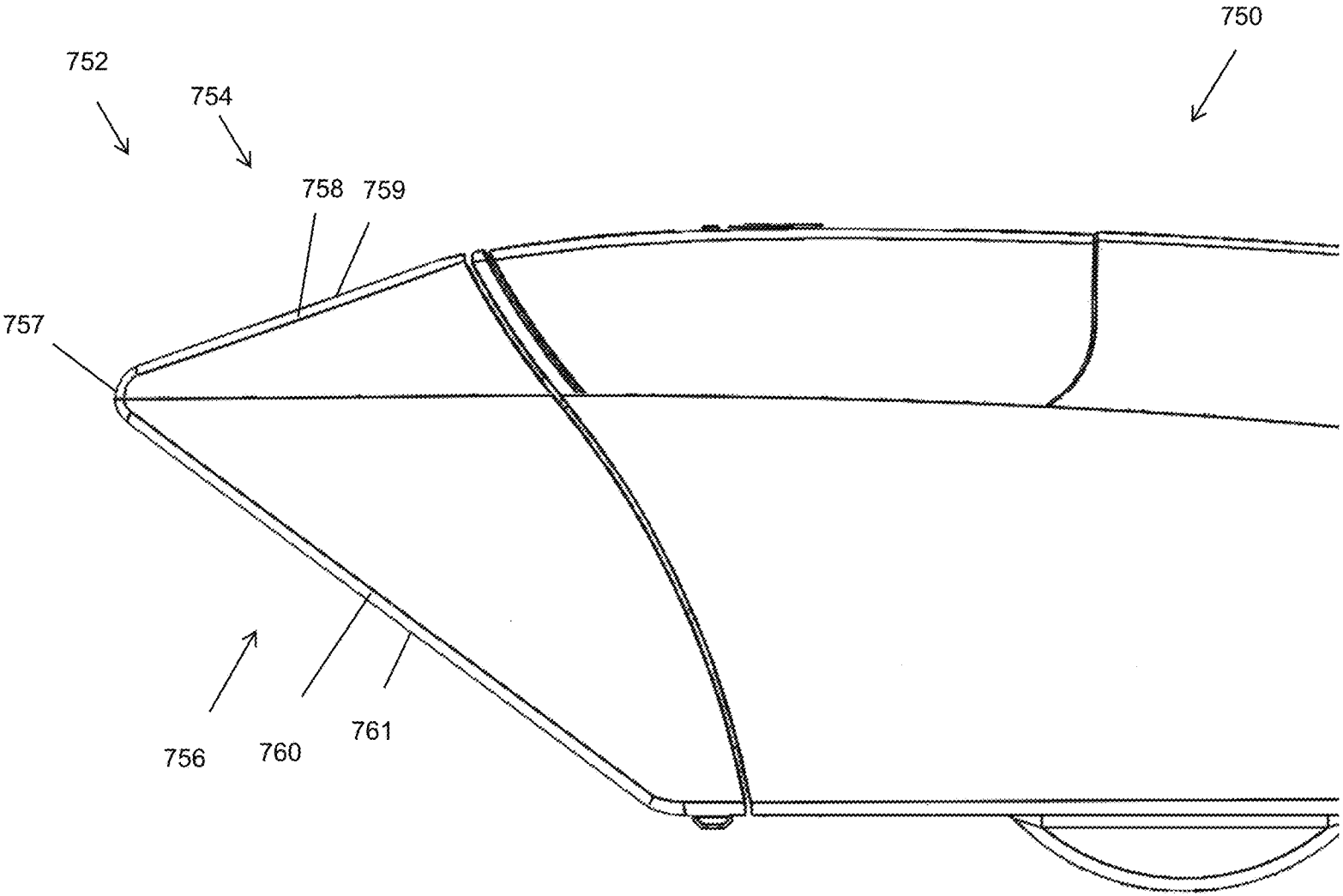
FIG. 53 is a side view of a fourth embodiment mop head usable with the mop of FIG. 50 in place of the mop head shown in FIG. 50 or with the mop of FIG. 1 in place of the mop head shown in FIG. 1.

FIG. 53 shows a portion of a fourth embodiment mop head 750. The mop head 750 comprises a nose 752. The nose comprises a first or upper converging portion 754 and a second or lower converging portion 756. The front or terminal end 757 of the nose 752 does not have rollers, instead a curved or rounded end or profile is provided at the terminal end of the nose 752.

The first converging portion 754 comprises a wall 758. The wall 672*a* comprises a first upper operating surface 759 and a portion of pad (not shown). The pad is mounted to the first upper operating surface. The second converging portion 756 comprises a wall 760. The wall 760 comprises a first lower operating surface 761 and a portion of pad (not shown). The pad (not shown) is mounted to the first lower operating surface. The pad 469 extends from the upper converging portion 754, around the terminal end 757, and along the lower converging portion 756 in the same manner as is provided on head 460.

The head 750 is the same as head 460 except that the first converging portion 754, the first upper operating surface 759, the second converging portion 756, and the first lower operating surface 761 are each flat. The head 750 usable with the mop of FIG. 50 in place of the mop head shown in FIG. 50 or with the mop of FIG. 1 in place of the mop head shown in FIG. 1. The absorbent substrate 68, which extends over the nose 752, as is shown for head 460, is used for head 750 but not shown in FIG. 53. In some embodiments first converging portion and the second converging portion of heads 12, 320, and/or 460 are flat. In some embodiments the first converging portion or the second converging portion is flat while the other of the first converging portion or the second converging portion is curved.

In some embodiments, rather than having an upper operating surface 24*b*, 672*b*, 759 and a lower operating surface 26*b*, 674*b*, 761, the mop has one operating surface, such as the lower operating surface.

Figure 54:
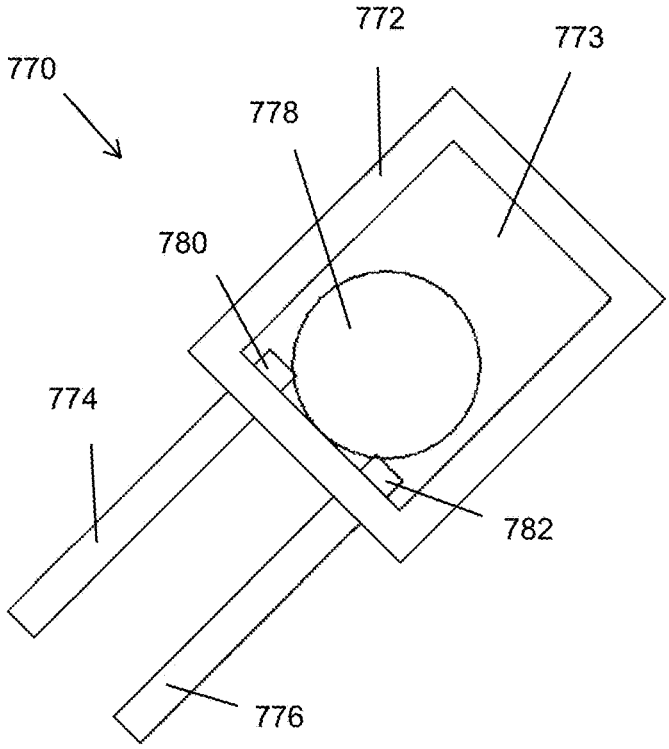
FIG. 54 is an orientation switch shown in an upward orientation.
Figure 55:
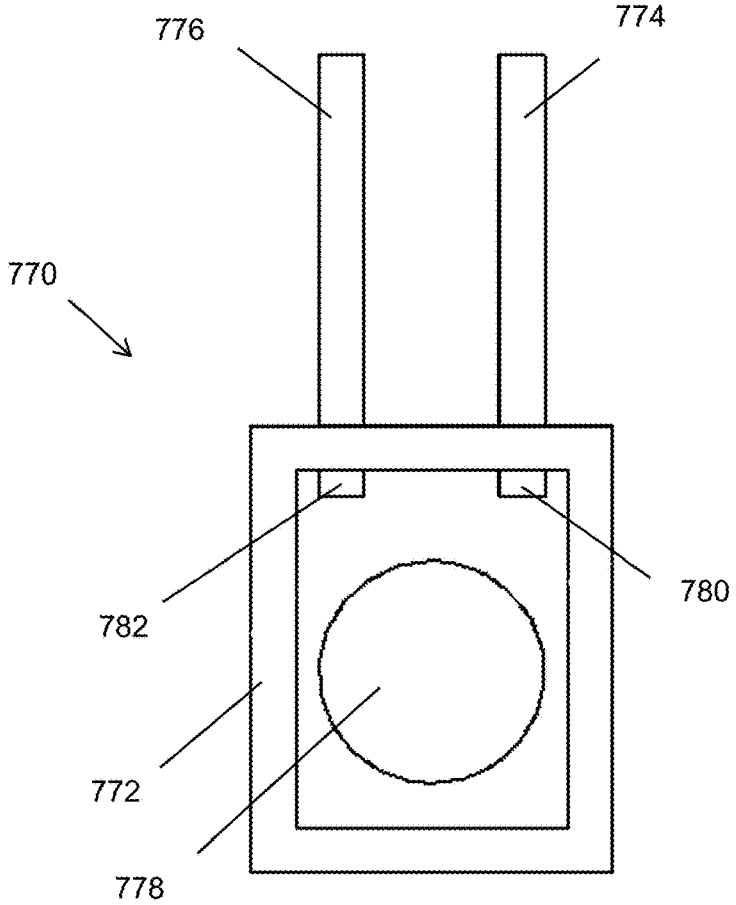
FIG. 55 is the orientation switch of FIG. 54 shown in a downward orientation.

In some embodiments, the controller 301 and/or the circuitry 642 comprise an orientation switch 770, shown in FIGS. 54 and 55. The switch comprises a first lead 774, a second lead 776, and a connection member enclosure 772 enclosing or partially enclosing a chamber 773. The chamber comprises a connection member 778. In some embodiments, the connection member is in the shape of a ball. The first lead 774 and the second lead 776 extend from outside the enclosure 772 into the chamber 773. The first lead, the second lead, and the connection member are made of or comprise electrically conductive material. When in an upward orientation, such as shown in FIG. 54, gravity causes the connection member 778 to contact and make an electronic/electrical connection between the first lead 774 and the second lead 776 at the terminal ends of the leads 780, 782, respectively. When in a downward orientation, such as shown in FIG. 55, the connection member 778 falls away from the leads 774, 776 under the force of gravity thereby breaking the electronic/electrical connection between the leads and the terminal ends.

When the mop is in the inverted position, such as shown in FIG. 51, the orientation switch is in a downward orientation and the connection member 778 falls away from the leads 774, 776 under the force of gravity thereby breaking the electronic/electrical connection between the leads and the terminal ends. This break in connection between the terminal ends causes the fluid pump 146 not to pump and dispense fluid through the fluid dispensing port 158. In some embodiments, this break in contact between the leads 774, 776 breaks or disconnects the power connection from the power source 166 to the pump 146 rendering it inoperative even when the pump handle 165 or pump switch is pressed or activated. In some embodiments, the break in contact between the leads 774, 776 breaks or disconnects an electronic signal or signal path at the controller 301 and/or the circuitry 642 and thereby the controller 301 and/or the circuitry 642 will not instruct or signal the pump 146 to operate even if the pump handle 165 or pump switch is pressed or activated. Therefore, the mop can be configured to prevent the dispensation of fluid at the port 158 when the mop is inverted or otherwise not orientated with the port 158 positioned in a downward direction. In some embodiments, the inoperative switch will remain connected, for example the ball will remain in contact with both leads 774, 776, when the head of the mop is up to and including 90 degrees of horizontal. Therefore, the mop head does not need to be exactly horizontal for the inoperative switch to remain connected and the fluid pump operative when, for example, in the positions shown in FIG. 50.

In another method of use, the first and/or second operating surfaces 24*b*, 26*b*, 672*b*, 674*b* can be deployed to clean wall surfaces, such as vertical wall surfaces. Therefore, the mop can be used on non-horizontal surfaces and non-floor surfaces.

In some embodiments, the head comprises an ultraviolet light 599 adjacent the collection roller 60, such as shown in FIG. 37. The ultraviolet light 599 is directed at the collection roller in the chamber 596. The light 599 may comprise all or a portion of the wall of the chamber 596. The light 599 shown in FIG. 37 extends upward from a bottom edge 599*a*.

The light 559 also extends from first end 599*b* to a second end 599*c* of the chamber 596 along a longitudinal length of the roller 60 and the chamber 596. In some embodiments, the light 599 emits light comprising ultraviolet C light having a wavelength in the range of 100 nanometers to 280 nanometers.

In some embodiments, the light is powered by the one or more batteries 638 and controlled by the controller 301. The controller 301 is configured to illuminate the light 599 when the roller 60 is advanced, such as by the motor 124. In some embodiments, the controller 301 is configured to illuminate the light 599 for a predefined time during and/or after the roller 60 is advanced. Therefore, as and/or after dirty absorbent substrate is collected at the collection roller 60, the ultraviolet light illuminated from the light 599 will kill viruses, bacteria, and other pathogens susceptible to ultraviolet light. In some embodiments, the light 599 is operable by an on/off switch (not shown) on the handle, which may be located adjacent switch 234, independent of the operation of the roller 60.

In some embodiments, the supply roller 62 and the collection roller 60 are not used and the head 12, 320, 460 does not comprise the supply roller 62 or the collection roller 60. Instead, one or more absorbent substrates are fixed to the operating surface(s) 24*b*, 26*b*, 672*b*, 674*b* or to the pad 469 or pads 30, 32 at the operating surface 24*b*, 26*b*, 672*b*, 674*b*. The one or more absorbent substrates may be fixed to the operating surface(s) 24*b*, 26*b*, 672*b*, 674*b* or to the pad 469 or pads 30, 32 by an adhesive, hook and loop fasteners, a one or more grippers, and/or other fixing mechanism. In some embodiments, the one or more absorbent substrates is the same as absorbent substrate 68 except that it is cut or sized to cover the operating surface 24*b*, 26*b*, 672*b*, 674*b* on or over which it is deployed.

Figure 56:
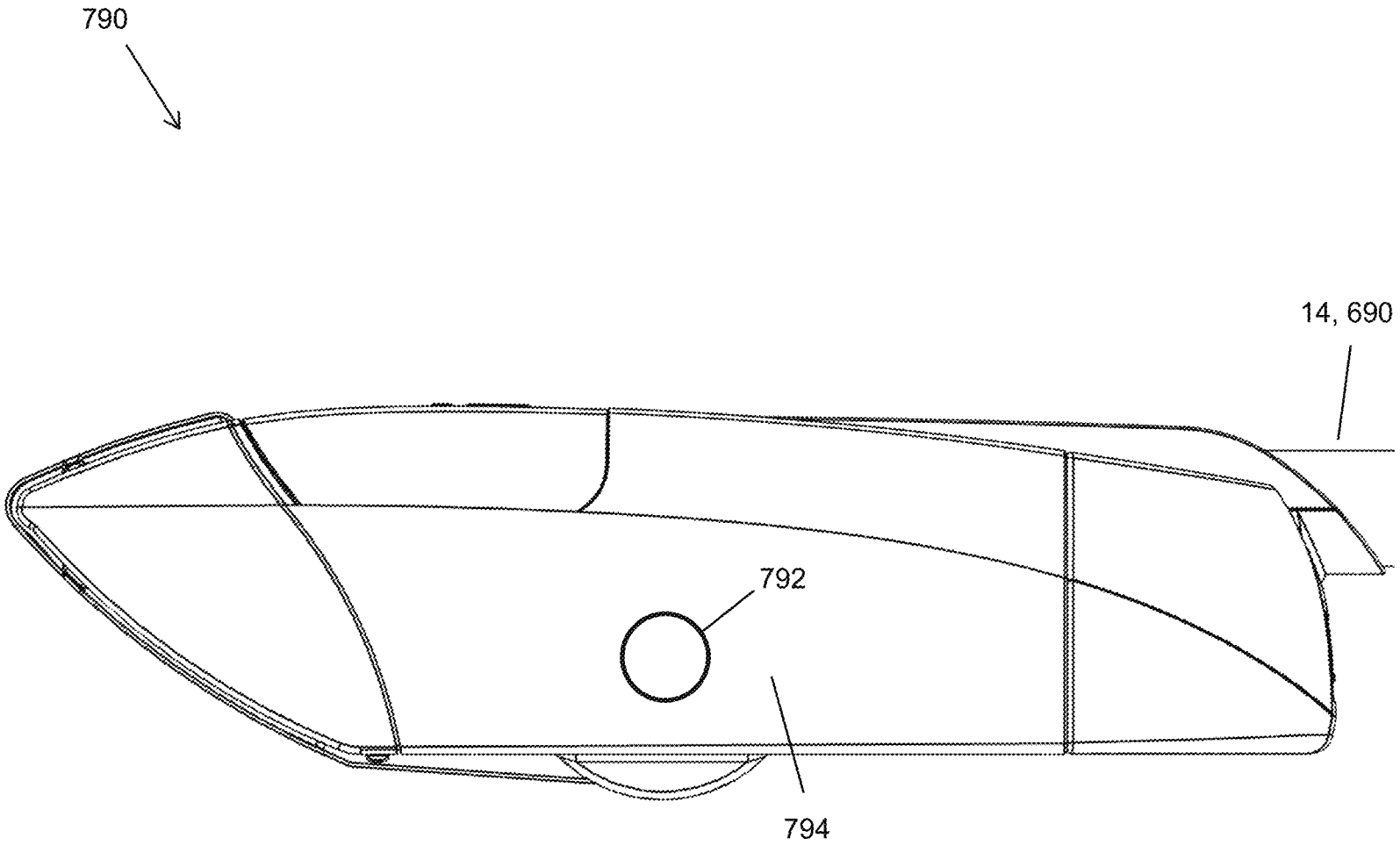
FIG. 56 is a side view of a fourth embodiment mop head.

FIG. 56 shows a fourth embodiment head 790 usable on the mop of FIG. 50 in place of head 460. Head 790 is identical to head 460, except head 790 does not have a motor 124 or gears 130, 132. Instead, the collection roller 60 is manually rotatable/advanceable to draw absorbent substrate from the supply roller 62 by a knob 792. The knob is operably connected to the collection roller. Rotation of the knob, for example with a user's hand, rotates the collection roller 60 to advance the absorbent substrate. In some embodiments, the knob is fixed to the collection roller. In some embodiments, the knob is operably connected to the connection roller through one or more gears. In some embodiments, the knob is connected to the collection roller through a ratchet mechanism or brake mechanism that allows the collection roller to turn in only one collecting direction where the absorbent substrate is further collected on the collection roller. In some embodiments when the knob is turned in the opposite direction of the collecting direction, such opposite direction rotation is not imparted to the collection roller. Allowing rotation only in the collecting direction prevent unspooling or runout of absorbent substrate from the collection roller. In some embodiments, the knob is positioned laterally beyond side. In some embodiments, the knob is embedded in a recess (not shown) in the side wall 794. In some embodiments, the knob is coaxial with the roller 60. In some embodiments, heads 12, 320, comprise a manual knob instead of a motor 124 to advance the collection roller 60. In some embodiments, the manual knob rotates the collection roller 60 to advance the absorbent material from the supply chamber 323. Therefore, in some embodiments, the collection roller can be manually advanced by a user. While a knob is shown for manual advancement, other mechanisms for manual advancement of the collection roller can be used.

Figure 57:
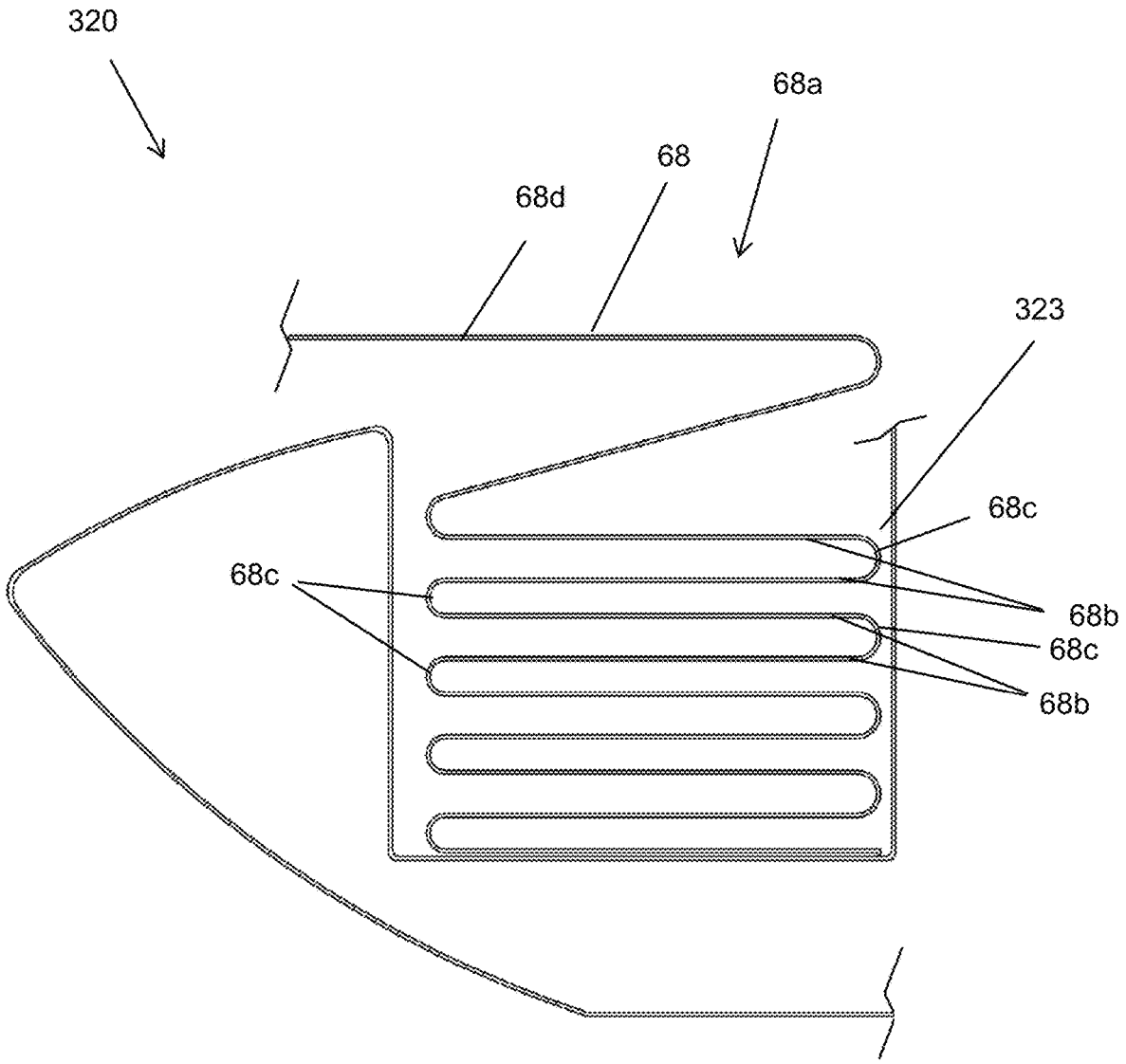
FIG. 57 is a partial side simplified section view of an embodiment of the mop head of FIG. 31 without a supply roller.

FIG. 57 shows the head 320 where the supply chamber 323 does not comprise a supply roller 62, 470, but instead the absorbent substrate is arranged in the supply chamber 323 in a folded arrangement 68*a*. Therefore, in some embodiments and applications, the absorbent substrate is not wound in a roll but instead is stored in the supply chamber in other configurations. FIG. 57 shows the absorbent substrate is folded back and forth on itself in stacked layers 68*b* continuous through turn portions 68*c*. Other configurations of non-rolled arrangements of the absorbent substrate can be provided in the supply chamber 323. The absorbent substrate will extend on the nose of the head as described above. The lead portion 68*d* of the absorbent substrate will extend to and past the stop member(s) and around the terminal end of the nose of head 320 and toward the collection roller or collection chamber. The advancement of the substrate will be controlled by the one or more stop members 332, 324, 172. The supply chamber 323, when comprising the absorbent substrate, provides an absorbent substrate supply for the mop. In some embodiments, the head 12 comprises the supply chamber 323, which may or may not comprise the supply roller 62.

Figure 58:
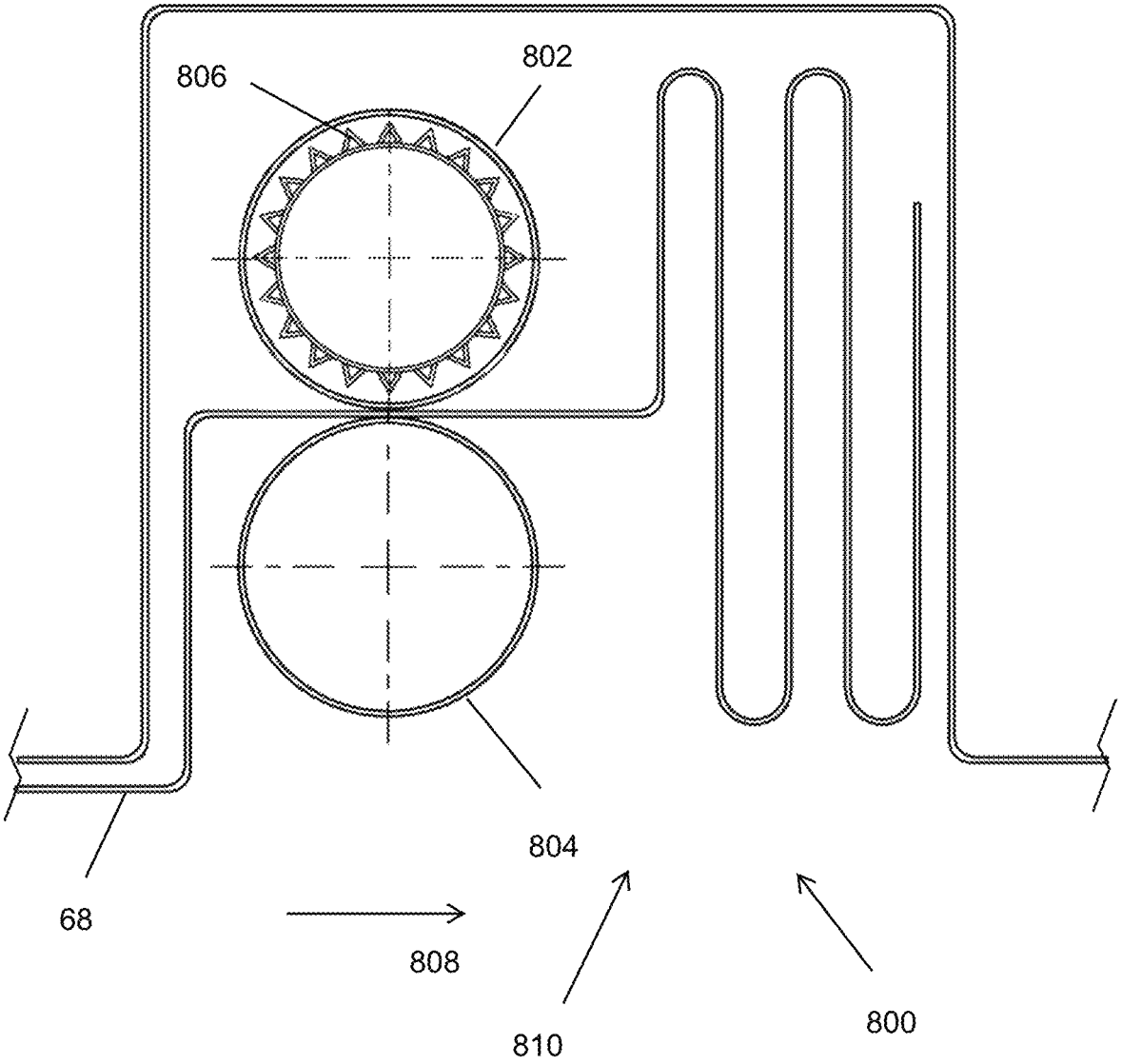
FIG. 58 is a side view an alternative embodiment collection chamber.

FIG. 58 shows an alternative embodiment collection chamber 800. The chamber 800 comprises an alternative embodiment first collection roller 802 and a second collection roller 804. A collection gear 806 is fixed to the first collection roller 802. The gear 806 is driven by the motor 124 through the gears 130, 132. Therefore, gear 806 can be enmeshed with gear 132.

The second collection roller is an idle roller. The substrate is gripped between the first and second collection rollers. The rotation of the first collection roller counter-clockwise, as driven by the motor will cause the absorbent substrate to be drawn from the supply roller or the supply chamber, around the terminal end of the nose and into the collection chamber 800, and in particular, to a collection area 810 behind the first and second collection rollers in the collection chamber 800. The rotation of the first collection roller counter-clockwise will, through contact, via the absorbent substrate, with the second collection roller, cause the second collection roller to rotate in the clockwise direction. Therefore, the first and second collection rollers can draw, as driven by the motor, the absorbent substrate from the supply roller or supply chamber to the collection chamber.

When the collection rollers 802, 804 are not rotated by the motor, they will grip the absorbent substrate in a fixed position, as controlled by the motor 124. Therefore, the absorbent substrate that extends about the nose is stopped from withdraw from the supply chamber or spooling out from the supply roller by a one or more stop members 172, 324, 332 contact with the absorbent substrate, or the axle braking mechanism, such as the friction spring 486, preventing rotation of the supply roller, and the absorbent substrate is stopped from withdraw from the collection chamber by the motor stopping the rotation of the collection roller 802 and the absorbent substrate being gripped between the collection rollers 802, 804. In some embodiments, the motor stops the rotation of the collection roller 802 in one or both directions when the motor is not operating to rotate the motor output shaft and the collection roller 802, either by a brake within or connected to the motor or due to the friction the motor causes against the motor output shaft when the motor is not operating to rotate the output shaft and the collection roller.

In some embodiments, the collection roller 802 and/or gear 806 is rotated manually, rather than driven by the motor 124. For example, a knob, such as knob 792 can be provided and operably connected to rotate the collection roller 802 in the same manner(s) as described in connection with the collection roller of the head 790 of FIG. 56. Therefore, in some embodiments, the collection rollers 802, 804 can be manually rotated by a user.

In some embodiments, the collection chamber 800 with the first and second collection rollers 802, 804 can be used in place of the collection roller 60 in heads 12, 320, or 460. For example, the collection chamber 800 can be provided in, or as a substitute for, chamber 596.

In some embodiments, an alternative embodiment supply roller is used with heads 12, 320, or 460 where the alternative embodiment supply roller comprises end disks, such as end disks 475*a*, 475*b*, where each end disk comprises a central stub-axle extending away from the end disk, such as shown at 472 protruding from disk 475*b* in FIG. 35, but that a supply roller shaft 503 is not used to connect the end disks. Instead of a supply roller shaft, the end disks are fixed to at least a portion of the lateral ends of spooled absorbent substrate, then the spooled absorbent substrate connects the end disks and their associated stub-axles.

Therefore, in some embodiments, the alternative embodiment supply roller described in this paragraph can have the appearance of the supply roller 470 in FIG. 35, except that shaft 503 (labeled in FIG. 36) is not used. In some embodiments, the end disks have a smaller diameter than the diameter of the spooled absorbent substrate. In some embodiments, end disks are not used and the stub-axles are fixed directly to the center of the lateral ends of spooled absorbent substrate.

Some of the non-limiting benefits and/or features of at least some embodiments of the mop disclosed herein comprise the following: an improved means of preventing the undesired advancement or runout of absorbent substrate during operation; one or two operating surfaces that allow for different angles of use relative to the floor or an external surface to be cleaned; an inverted mode of operation that allows for a low-profile angle of use relative to the floor or an external surface to be cleaned; a nose that enables the cleaning of a floor or other surface at a corner, under cabinet toe kicks, and at edges of the floor or other surface; one or more curved operating surfaces that allow a curving or scooping motion of use to enable improve pickup of dirt, debris, and liquids; one or more curved operating surfaces that allow various effective angles of use relative to the floor or external surface to be cleaned; a mop handle that allows a comfortable holding position for a variety of different height users and a variety of different positions and angles of use of the mop; easy loading of absorbent substrate; release and removal of used or dirty absorbent substrate from the mop without a user touching the used or dirty absorbent substrate; and/or a substrate advancement controller configured to instruct an operation of the motor to rotate the collection roller to advance the absorbent substrate.

From the foregoing, it will be observed that numerous variations and modifications may be affected without departing from the spirit and scope of the invention. It is to be understood that no limitation with respect to the specific apparatus illustrated herein is intended or should be inferred. For example, one or more component embodiments may be combined, modified, removed, or supplemented to form further embodiments within the scope of the invention. As a further example, steps provided in the flow diagrams of the figures, could be carried out in a different order to achieve desired results. Further, steps could be added or removed from the processes described. Therefore, other embodiments and implementations are within the scope of the invention.

The invention claimed is:

1. A mop, comprising:

a shaft;

a head connected to an end of the shaft, the head comprising an absorbent substrate supply, a collection roller, and an operating surface;

an absorbent substrate extending from the absorbent substrate supply, across the operating surface, and to the collection roller;

a motor operably connected to the collection roller to drive a rotation of the collection roller, the absorbent substrate advanceable from the absorbent substrate supply by the rotation of the collection roller; and, a substrate advancement controller configured to instruct an operation of the motor to rotate the collection roller a predefined duration depending on an amount of prior advancement of the absorbent substrate; and, the head comprising a supply roller, an idle roller and a rotation sensor, the absorbent substrate supply is located on the supply roller, the rotation sensor is in communication with the controller, the rotation sensor is configured to detect a rotation of the idle roller, the absorbent substrate is in contact with the idle roller between the supply roller and the collection roller, and the controller is configured such that the amount of prior advancement of the absorbent substrate is determined by a measured amount of prior rotation of the idle roller as measured by the rotation sensor.

2. The mop of claim 1, comprising a sensor element, the idle roller comprises the sensor element, the sensor is positioned to detect a movement of the sensor element.

3. The mop of claim 2, the sensor is positioned adjacent the idle roller, at least a portion of the idle roller is within a detection field of the sensor.

4. The mop of claim 2, wherein the sensor is configured to signal to the controller each rotation of the sensor element.

5. A mop, comprising:

a shaft;

a head connected to an end of the shaft, the head comprising a collection roller and an operating surface;

an absorbent substrate extending across the operating surface and to the collection roller;

a motor operably connected to the collection roller to drive a rotation of the collection roller, the absorbent substrate advanceable from an absorbent substrate supply by the rotation of the collection roller; and, a substrate advancement controller configured to instruct an operation of the motor to rotate the collection roller to advance the absorbent substrate a predefined distance depending on an amount of prior advancement of the absorbent substrate; and, the head comprising a supply roller, an idle roller, and a rotation sensor, the rotation sensor is in communication with the controller, the absorbent substrate supply is located on the supply roller, the rotation sensor is configured to detect a rotation of the idle roller, the absorbent substrate is in contact with the idle roller between the supply roller and the collection roller; the controller is configured to determine a distance of advancement of the absorbent substrate based on the rotation of the idle roller.

6. The mop of claim 5, wherein the controller is configured to terminate operation of the motor when the distance of advancement equals the predefined distance.

7. The mop of claim 5, comprising a sensor element, the idle roller comprises the sensor element, the rotation sensor is positioned to detect a movement of the sensor element.

8. The mop of claim 7, the rotation sensor is positioned adjacent the idle roller, at least a portion of the idle roller is within a detection field of the rotation sensor.

9. The mop of claim 7, wherein the rotation sensor is configured to signal to the controller each rotation of the sensor element.

* * * * *